US006209864B1

(12) United States Patent
Taniguchi et al.

(10) Patent No.: US 6,209,864 B1
(45) Date of Patent: Apr. 3, 2001

(54) SHEET POST-PROCESSING APPARATUS

(75) Inventors: Tadasu Taniguchi, Uda-gun; Masaru Tsuji, Nara; Junya Masuda, Kashihara; Takahiro Fukunaga, Fukayasu-gun; Koji Wakamoto, Kitakatsuragi-gun; Masanobu Yamamoto, Nara; Hiroshi Kida, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/317,197

(22) Filed: May 24, 1999

(30) Foreign Application Priority Data

May 29, 1998 (JP) ..... 10-148878
Jul. 13, 1998 (JP) ..... 10-197129
Sep. 29, 1998 (JP) ..... 10-274875

(51) Int. Cl.[7] ..... B65H 31/26; B65H 33/04

(52) U.S. Cl. ..... 271/220; 270/58.07; 270/58.08; 270/58.11

(58) Field of Search ..... 271/220, 188, 271/161, 3.01, 3.02; 270/58.07, 58.08, 58.11

(56) References Cited

U.S. PATENT DOCUMENTS 3,536,318 * 10/1970 Gay et al. .
4,026,543 5/1977 Leclere .
4,220,323 9/1980 Smith .
4,277,061 7/1981 Nagel et al. .
4,443,101 4/1984 Sakurai et al. .
4,640,505 * 2/1987 Placke et al. ..... 271/220
4,789,149 * 12/1988 Ray et al. ..... 271/220
4,858,909 8/1989 Stemmle .
4,945,390 7/1990 Hasegawa et al. .
4,988,085 * 1/1991 Maekawa et al. ..... 270/58.11
4,994,865 * 2/1991 Nishimori et al. .
5,013,021 5/1991 Johdai et al. .
5,044,618 * 9/1991 Ettischer et al. ..... 270/58.01
5,056,774 * 10/1991 Kubota et al. ..... 271/220
5,060,921 10/1991 Higashio et al. .
5,083,760 * 1/1992 Yamazaki et al. ..... 270/58.11

(List continued on next page.)

FOREIGN PATENT DOCUMENTS

19719485 * 1/1998 (DE) .
0416633 3/1991 (EP) .
0566279 10/1993 (EP) .
0769467 * 4/1997 (EP) .
0916516 * 5/1999 (EP) .

OTHER PUBLICATIONS

Japanese Patent Application Laid–open SHO 60 No. 12454 with English Abstract.
Japanese Patent Application Laid–open Hei 1 No. 271361 with English Absract.
Japanese Patent Application Laid–open Hei 3 No. 98948 with English Abstract .
Japanese Patent Application Laid–open Hei 9 No. 110267 with English Abstract.
Japanese Patent Application Laid–open Hei 9 No. 118468 with English Abstract.

*Primary Examiner*—Christopher P. Ellis
*Assistant Examiner*—Kenneth W Bower

(57) ABSTRACT

A sheet post-processing apparatus having a post-processing tray arranged upright, a post-processing device such as stapler etc., an offset tray to which post-processed sheets are discharged, includes: the third and forth discharge rollers for introducing the sheet into the post-processing tray from its bottom and discharging the sheet after post-processing to the offset tray; a sheet guide arranged opposing the post-processing tray, a pusher mechanism and paddlers, for aligning the sheets to be stacked so as to be substantially upright and pressing the sheet by particular portions when the sheet is introduced into the post-processing.

27 Claims, 27 Drawing Sheets

U.S. PATENT DOCUMENTS 5,152,513 * 10/1992 Ogasawara et al. ..... 271/220
5,166,739 11/1992 Katsuki et al. .
5,172,905 12/1992 Vanous et al. .
5,201,517 4/1993 Stemmle .
5,211,385 * 5/1993 Hoorn ..... 271/3.12
5,215,298 6/1993 Stemmle et al. .
5,288,062 * 2/1994 Rizzolo et al. ..... 271/220
5,320,336 * 6/1994 Asami ..... 270/58.08
5,478,062 * 12/1995 Horiuchi et al. ..... 270/58.08
5,480,130 * 1/1996 Sazuki et al. ..... 271/58.11
5,769,412 6/1998 Takemoto et al. .
5,921,538 * 7/1999 Schlough ..... 270/58.08
5,938,192 * 8/1999 Kosasa ..... 271/3.02
5,971,394 10/1999 Kida et al. .

* cited by examiner

Large size

Small size

Larger curl

Smaller curl

S-mode

D-mode

S-mode

D-mode

Lesser amount of sheets

Larger amount of sheets

SHEET POST-PROCESSING APPARATUS

BACKGROUND OF THE INVENTION

1. Field of the Invention

The present invention relates to a sheet post-processing apparatus which is used with an image forming apparatus having copier, facsimile and/or printer functions and which performs post-processing, such as stapling, etc., for sheet-like recorded media sent from the image forming apparatus and outputs the post-processed sheets, and in particular can improve the alignment of the sheets accommodated therein.

2. Description of the Prior Art

In the recent technical field of image forming apparatuses, typified by a copier (the description hereinbelow will be described referring to a copier as an example of an image forming apparatus.), in order to automate the image forming task as well as to automate post-processing tasks for sheet-like media (to be referred to as 'sheet', consistently) after image formation, an automatic document feeder and sheet post-processing apparatus have been used in combination.

The sheet post-processing apparatus is one which handles copy sheets, output from a copier, on which original images are copied and performs post-processing such as stapling, hole-punching and the like for every piece of predetermined number of sheets.

As the prior art for those sheet post-processing apparatuses, Japanese Patent Application Laid-Open Hei 9 No.110,267 and Japanese Patent Application Laid-Open Hei 9 No.118,468 can be referred to.

As the first example, Japanese Patent Application Laid-Open Hei 9 No.110,267, discloses a sheet discharging apparatus. This apparatus is to deal with high-speed image formation, with a simple mechanism without the necessity of inversion conveyance, to thereby enable the sheets to be output in the collated page order when image formation is done in the order in which image data was transferred. For this purpose, this apparatus includes: a direct conveyance path for discharging sheets onto the first output tray, stacking them successively while keeping their positions the same; an inverting conveyance path that branches partway from the direct conveyance path to discharge the sheets, stacking them successively with their image-formed surface turned over with respect to that of the sheets on the first output tray; and an inversion forcing means for exerting an external force on the underside of the sheet so that the sheet can be inverted and output onto the second discharge tray.

Japanese Patent Application Laid-Open Hei 9 No.118,468 discloses another sheet post-processing apparatus having a post-processing device. This apparatus is to perform post-processing with sheets re-arranged in page order, by changing the aligned order of the sheets in the sheet storage portion when the sheets after image formation are delivered out sequentially from either the last page or the first page. For this purpose, this apparatus comprises a sheet aligning means for aligning the sheets, which are delivered to the sheet storage portion from the last page or from the first page, in the first sequential order if from the last page and in the second sequential order if from the first page; and a post-processing device for performing post-processing for the sheet stack aligned in the sheet storage portion.

In such a sheet post-processing apparatus which temporarily holds a stack of the sheets discharged from the copier within the post-processing tray therein and staples the sheets as post-processing, then discharges the stapled sheets to the output tray outside the sheet post-processing apparatus, all operations can be automated but then this device become large in its size. So if a total copying and processing system is configured, the system needs a large space, which limits the site for installation.

Various sizes of sheets are discharged from a copier. Therefore, the post-processing apparatus needs to have a post-processing tray which can hold maximum size sheets. There is a configuration in which the post-processing tray capable of handling maximum size sheets is arranged in an inclined manner, but this configuration still needs a large space for the interior structure.

For this reason, in order to reduce the installation footprint of the sheet post-processing apparatus, Japanese Patent Application Laid-Open Hei 9 Nos.110,267 and 118,468 have proposed that the post-processing tray should be arranged upright (arranged in the vertical direction).

According to the techniques disclosed in the above applications, the sheet which has been lead by the first conveyer roller into the sheet aligner is naturally dropped utilizing gravity, guided by guide pieces. Further, a sheet aligning means is configured so as to switch the sheet held direction in the storage portion, presses the sheet rear end while a regulative switching claw registers the sheet leading edge. Therefore, it is necessary to change the positional relationship between the sheet aligning means and the position of the sheet leading edge, depending upon the sheet size, which complicates the mechanism and raises the cost. Besides, when the image forming apparatus is a composite type having multiple output modes, the output is often made with different sizes, so that it takes time for the aforementioned switching, which may give rise to a speed problem. Moreover, since the sheet is naturally dropped utilizing gravity, it is also expected that the sheets cannot be stacked correctly depending upon the size and material of the sheets and/or due to the influences of humidity, dewing and the like.

Accordingly, there is still great room for improvement even with these conventional technologies, in terms of reducing the installation footprint of the sheet post-processing apparatus, regardless of the sheet size, correctly stacking the sheets discharged to the sheet post-processing tray regardless of the sheet characteristics, effecting the predetermined post-processing for an exactly aligned stack of sheets, and the like.

SUMMARY OF THE INVENTION

The present invention has been devised in view of the above problems and it is therefore an object of the present invention to provide a sheet post-processing apparatus which is minimized in its footprint regardless of the sheet size to be handled.

It is another object of the invention to provide a sheet post-processing apparatus which can stack the sheets discharged to the post-processing tray, properly regardless of the sheet characteristics and which also can effect the predetermined post-processing for an exactly aligned stack of sheets.

In order to achieve the above objects, the present invention is configured as follows:

In accordance with the first aspect of the invention, a sheet post-processing apparatus includes:

- a post-processing tray for stacking the discharged sheets;
- a post-processing portion for performing post-processing for the stacked sheets;
- an output tray for receiving the sheets discharged after post-processing;

a conveying means for conveying sheets from the lower part of the post-processing tray arranged upright and discharging the sheets after post-processing to the output tray; and a sheet guiding means disposed opposing the post-processing tray which presses particular portions of the sheet when the sheet is introduced into the post-processing tray so as to align the stacked sheets onto the post-processing tray, with the sheets being stacked substantially upright.

In accordance with the second aspect of the invention, the sheet post-processing apparatus having the above first feature is characterized in that the sheet guiding means can rotate about an axle located near the upper part of the post-processing tray so that the lower part of the sheet guiding means rotationally moves toward the post-processing tray; and the sheet guiding means guides the sheet upward with respect to the post-processing tray when the sheet is introduced into the post-processing tray and presses the sheet against the post-processing tray face when the sheet is discharged to the post-processing tray.

In accordance with the third aspect of the invention, the sheet post-processing apparatus having the above first feature is characterized in that the sheet guiding means guides the sheet upward with respect to the post-processing tray when the sheet is introduced into the post-processing tray and presses the sheet against the post-processing tray face gradually from the lower part to the upper part when the sheet is discharged to the post-processing tray.

In accordance with the fourth aspect of the invention, the sheet post-processing apparatus having the above second feature further comprises a paddler mechanism which operates in cooperation with the sheet guiding means when the sheet is pressed against the post-processing tray face.

In accordance with the fifth aspect of the invention, the sheet post-processing apparatus having the above third feature further comprises a paddler mechanism which operates in cooperation with the sheet guiding means when the sheet is pressed against the post-processing tray face.

In accordance with the sixth aspect of the invention, the sheet post-processing apparatus having the above fourth feature is characterized in that the sheet guiding means is pressed by the rotary part of the paddler mechanism so as to rotate toward the post-processing tray face.

In accordance with the seventh aspect of the invention, the sheet post-processing apparatus having the above fifth feature is characterized in that the sheet guiding means is pressed by the rotary part of the paddler mechanism so as to rotate toward the post-processing tray face.

In accordance with the eighth aspect of the invention, the sheet post-processing apparatus having the above fourth, fifth, sixth or seventh feature is characterized in that the paddler mechanism has a control means for switching the number of revolutions of the paddler mechanism in accordance with the characteristics of the sheets to be stacked on the post-processing tray.

In accordance with the ninth aspect of the invention, the sheet post-processing apparatus having the above fourth or fifth feature is characterized in that the post-processing tray comprises: a first post-processing tray portion which holds and aligns the lower edge portion of the sheets discharged from the lower part of the post-processing tray; and a second post-processing tray portion which holds whole part of the sheets discharged in the post-processing tray, and the first post-processing tray portion conveys the aligned sheets in the post-processing tray to the post-processing portion, in cooperation with the rotation of the paddler mechanism.

In accordance with the tenth aspect of the invention, the sheet post-processing apparatus having the above first feature, further comprises a rigidity imparting means for imparting rigidity to the sheet discharged to the post-processing tray so as to prevent the sheet from drooping down in the post-processing tray.

In accordance with the eleventh aspect of the invention, a sheet post-processing apparatus includes:

a tray arranged upright for successively receiving the discharged sheets;

an aligning means for setting the sheets in proper alignment on the tray; and a rigidity imparting means for imparting rigidity to the sheets successively accommodated into the sheet tray in such a degree that each sheet can be kept substantially upright and be aligned with the tray face while the sheet is accommodated in the tray.

In accordance with the twelfth aspect of the invention, the sheet post-processing apparatus having the above tenth or eleventh feature is characterized in that the rigidity imparting means comprises a pair of elastic rollers which are in partial contact with each other and deformed at their contact.

In accordance with the thirteenth aspect of the invention, a sheet post-processing apparatus includes:

a tray arranged upright for successively receiving the discharged sheets;

an aligning means for setting the sheets in proper alignment on the tray; and a sheet gripping means which acts on the upper part of the sheets having been successively received and stacked substantially upright in the tray to grip the sheets in a substantially upright manner.

In accordance with the fourteenth aspect of the invention, the sheet post-processing apparatus having the above thirteenth feature is characterized in that the sheet gripping means is configured of a gripping element which acts with a strong enough force on the sheets set substantially upright in the tray to be able to maintain the aligned state of the sheets.

In accordance with the fifteenth aspect of the invention, the sheet post-processing apparatus having the above first feature further comprises a sheet aligning means which is disposed opposing the post-processing tray and presses the lower end part of the sheets having been introduced and held substantially upright in the post-processing tray so as to align the sheets in a substantially upright state, toward the post-processing tray face.

In accordance with the sixteenth aspect of the invention, the sheet post-processing apparatus having the above first feature is characterized in that the sheet guiding means comprises a holding member for holding the lower end part of the introduced sheets and setting the sheets aligned in a substantially upright state, and the sheet lower edge abutment surface of the holding member is formed with a movement limiting element for limiting the movement in the direction opposite to the sheet pressing direction.

In accordance with the seventeenth aspect of the invention, the sheet post-processing apparatus having the above fifteenth feature is characterized in that the sheet post-processing tray can be moved vertically and receives the sheet introduced thereinto at the first, upper position and the sheet aligning means presses the introduced sheet against the post-processing tray face at the second, lower position.

In accordance with the eighteenth aspect of the invention, the sheet post-processing apparatus having the above fifteenth feature, further comprises:

a count storing means for counting the number of the sheets accommodated in the post-processing tray and storing the count result; and a control means for controlling the sheet aligning means so as to align a following sheet introduced into the post-processing tray and the sheet stack therein when the count result from the count storing means surpasses a predetermined number.

In accordance with the nineteenth aspect of the invention, the sheet post-processing apparatus having the above first feature, further comprises:

a sheet supporting means which supports and aligns the lower end part of the sheets held in the post-processing tray and is able to move the held sheet stack, between the first position at which sheets are introduced thereinto and the second position at which the sheet stack is post-processed; and, a support assisting means arranged in parallel with the post-processing tray and raised from the surface of the post-processing tray, for supporting the underside of the sheet stack in time with the movement of the sheet supporting means.

In accordance with the twentieth aspect of the invention, the sheet post-processing apparatus having the above nineteenth feature, further comprises a sheet aligning means disposed opposing the support assisting means, for pressing and aligning the sheet introduced into the post-processing tray toward the post-processing tray face, wherein when the sheet supporting means moves, the sheet aligning means holds and conveys the sheet stack.

In accordance with the twenty-first aspect of the invention, the sheet post-processing apparatus having the above nineteenth feature is characterized in that the support assisting means is configured with a movement limiting element disposed on the post-processing tray face for limiting the sheets so that they do not move in the direction opposite to that for sheet alignment.

In accordance with the twenty-second aspect of the invention, the sheet post-processing apparatus having the above first feature, further comprises:

a sheet supporting means which supports and aligns the lower end part of the sheets held in the post-processing tray and is able to move the held sheet stack, between the first position at which sheets are introduced thereinto and the second position at which the sheet stack is post-processed;

a sheet dimension detecting means for detecting the dimensions of the sheet to be held in the post-processing tray; and a switching control means for switching the position at which the sheet supporting means introduces the sheet based on the detection result from the sheet dimension detecting means.

In accordance with the twenty-third aspect of the invention, the sheet post-processing apparatus having the above first feature, further comprises:

a sheet supporting means which supports and aligns the lower end part of the sheets held in the post-processing tray and is able to move the held sheet stack, between the first position at which sheets are introduced thereinto and the second position at which the sheet stack is post-processed;

a sheet deformation detecting means for detecting the deformation and deformed direction of the sheet to be held in the post-processing tray; and a switching control means for switching the position at which the sheet supporting means introduces sheets based on the detection result from the sheet deformation detecting means.

In accordance with the twenty-fourth aspect of the invention, the sheet post-processing apparatus having the above first feature, further comprises:

a sheet supporting means which supports and aligns the lower end part of the sheets held in the post-processing tray and is able to move the held sheet stack, between the first position at which sheets are introduced thereinto and the second position at which the sheet stack is post-processed;

a sheet amount detecting means for detecting the amount of sheets to be held in the post-processing tray; and a switching control means for switching the position at which the sheet supporting means introduces sheets based on the detection result from the sheet amount detecting means.

In accordance with the twenty-fifth aspect of the invention, a sheet post-processing apparatus includes:

a post-processing tray for stacking the discharged sheets;

a post-processing portion for performing post-processing for the stacked sheets;

an output tray for receiving the sheets discharged after post-processing;

a conveying means for conveying sheets from the lower part of the post-processing tray arranged upright and discharging the sheets after post-processing to the output tray;

a sheet aligning means for aligning the sheet introduced into the post-processing tray;

a moving means for moving the sheets aligned in the post-processing tray relative to the post-processing portion in a vertical direction so as to produce the predetermined positional relationship therebetween; and a pressing means for pressing the sheets toward the reference surface of the post-processing tray when the sheets and the post-processing portion are moved relatively in a vertical direction.

In accordance with the twenty-sixth aspect of the invention, the sheet post-processing apparatus having the above twenty-fifth feature is characterized in that the pressing means does not act on the sheet surface during the step in which the sheet introduced into the post-processing tray is aligned but acts on the sheet surface during the step in which the aligned sheets are moved relative to the post-processing portion.

In accordance with the twenty-seventh aspect of the invention, a sheet post-processing apparatus includes:

a post-processing tray for stacking the discharged sheets;

a post-processing portion for performing post-processing for the stacked sheets;

an output tray for receiving the sheets discharged after post-processing;

a conveying means for conveying sheets from the lower part of the post-processing tray arranged upright and discharging the sheets after post-processing to the output tray; and a sheet supporting means for supporting and aligning the lower edges of the sheets discharged to the post-processing tray, and is characterized in that the sheet supporting means comprises: a sheet guiding slope for guiding the sheet lower edge to the reference surface side of the abutment portion; and a sheet releasing portion for releasing the lower edges of the guided sheets.

In accordance with the twenty-eighth aspect of the invention, the sheet post-processing apparatus having the above twenty-seventh feature is characterized in that the sheet supporting means further comprises an elastic pressing element for pressing the sheet guided by the sheet releasing portion toward the sheet reference surface.

The operation of the present invention thus configuration will be described hereinbelow.

In accordance with the first configuration, the sheet guiding means disposed opposing the post-processing tray arranged upright ensures proper guidance of the sheet discharged from the image forming apparatus to the upright, post-processing tray, without the sheet drooping down, and presses the discharged sheet at particular portions so as to align the sheet with other sheets on the post-processing tray. Therefore, it is possible to receive the sheet discharged from the image forming apparatus without delay and ensure proper alignment as a sheet stack to effect post-processing such as stapling etc. for the sheet stack.

In accordance with the second configuration of the invention, the sheet guiding means disposed opposing the post-processing tray arranged upright ensures proper guidance of the sheet discharged from the image forming apparatus to the upper part of the post-processing tray, without the sheet drooping down, and presses the discharged sheet at the rear end so as to align the sheet with other sheets on the post-processing tray. Therefore, it is possible to receive the sheet discharged from the image forming apparatus without delay and ensure proper alignment of multiple sheets as a sheet stack to effect post-processing such as stapling etc. for the sheet stack.

In accordance with the third configuration of the invention, the sheet guiding means disposed opposing the post-processing tray arranged upright ensures proper guidance of the sheet discharged from the image forming apparatus to the upper part of the post-processing tray, without the sheet drooping down, and presses the discharged sheet gradually from the rear end to the upper end so as to align the sheet with other sheets on the post-processing tray. Therefore, it is possible to receive the sheet discharged from the image forming apparatus without delay and ensure proper alignment of multiple sheets as a sheet stack to effect post-processing such as stapling etc. for the sheet stack.

In accordance with the fourth and fifth configurations of the invention, the sheet guiding means disposed opposing the post-processing tray arranged upright ensures proper guidance of the sheet discharged from the image forming apparatus to the upper part of post-processing tray, without the sheet drooping down, and ensures proper alignment of the rear edge (lower edge) of the sheet with the reference surface after the completion of discharge.

Therefore, it is possible for the post-processing tray to receive the sheet discharged from the image forming apparatus without delay and ensure proper alignment as a sheet stack to effect post-processing such as stapling etc. for the sheet stack.

Further, as the paddler mechanism, at least two paddlers are provided with respect to the direction of the width of the sheets to be stacked on the post-processing tray and can be configured to act on the sheet at different timings. The sheet guiding means opposing the upright, post-processing tray ensures proper guidance of the sheet discharged from the image forming apparatus, toward the upper part of the upright, post-processing tray by preventing the sheet from drooping down and correctly sets the sheet after discharge, with the rear edge (lower edge) of the sheet in proper alignment with the reference surface.

In this case, when the discharged sheet is aligned with the post-processing tray face and also the alignment reference surface by means of multiple paddlers, each paddler is set to act on the sheet at different timing from the others. Therefore, instead of pressing the sheet surface against the post-processing tray face in a rush, the sheet is pressed gradually from one side end to the other, to thereby ensure alignment of multiple sheets in a short time.

Next, in accordance with the sixth and seventh configurations of the invention, the rotary part of the paddler mechanism acts on the sheet guiding means so that the sheet guiding means can press the sheet discharged in the post-processing tray against the post-processing tray face and toward the alignment reference surface in synchronism with the rotation of the paddler mechanism.

Accordingly, upon alignment of the sheet discharged to post-processing tray, the rear edge (lower edge) of the sheet can be set in alignment with the reference surface in time with pressing the sheet against the post-processing tray face. As a result, it is possible to receive the sheet discharged from the image forming apparatus, into the post-processing tray without delay and ensure alignment of the sheet as a sheet stack to effect post-processing such as stapling etc. for the sheet stack.

In accordance with the eighth configuration of the invention, the number of times the paddler mechanism acts on the sheet can be changed in accordance with the characteristics of the sheet.

Accordingly, regardless of the characteristics of the sheet discharged to the post-processing tray, the rear edge (lower edge) of the sheet can be set in proper alignment with the reference surface while the sheet is pressed against the post-processing tray face. As a result, it is possible to receive the sheet discharged from the image forming apparatus, into the post-processing tray without delay and ensure alignment of the sheet as a sheet stack to effect post-processing such as stapling etc. for the sheet stack.

Further, length (height) information as to the sheet to be stacked on the post-processing tray may be selected as the sheet characteristics. In this case, the number of times the paddler mechanism acts on the sheet is switched in accordance with the length of the sheet.

In accordance with the ninth configuration of the invention, the post-processing tray comprises: a first post-processing tray portion which holds and aligns the lower edge portion of the sheets discharged from the lower part of the post-processing tray; and a second post-processing tray portion which holds whole part of the sheets discharged in the post-processing tray. The first post-processing tray portion conveys the aligned sheets in the post-processing tray to the post-processing portion, in cooperation with the rotation of the paddler mechanism.

Therefore, the stack of sheets aligned in the upright, post-processing tray can be conveyed to the post-processing device such as stapler, etc., without disrupting the alignment, and hence it is possible to perform stapling and/or other post-processing for the stack of aligned sheets, in a reliable manner.

In accordance with the tenth configuration of the invention, the sheet discharged to the upright, post-processing tray is made rigid as it is discharged so that the discharged sheet will not droop down in the post-processing tray.

Thereby, the sheet discharged to the post-processing tray will not droop down when it is set in alignment with other sheets, and hence it is possible to receive the sheet discharged from the image forming apparatus without delay and ensure proper alignment as a sheet stack to effect post-processing such as stapling etc. for the sheet stack.

The sheet guiding means may be configured to act on the areas to which the rigidity imparting means imparts rigidity. This configuration makes it possible to press the sheet, without flexing, against the post-processing tray face and hence press and align the sheets as a sheet stack. As a result, it is possible to receive the sheet discharged from the image forming apparatus without delay and ensure proper alignment as a sheet stack to effect post-processing such as stapling etc. for the sheet stack.

In accordance with the eleventh configuration of the invention, the sheet discharged to the upright, post-processing tray is imparted rigidity in such a degree that the sheet will not droop down in the upright, post-processing tray until the aligned sheets are subjected to post-processing such as stapling etc.

Thereby, the sheets will be kept with aligned posture without drooping down in the upright, post-processing tray, at least until the sheets are subjected to post-processing such as stapling and the like, and hence it is possible to perform post-processing such as stapling etc., for the sheets as a sheet stack. Moreover, after the completion of post-processing, there is no fear of the problem of traces of ridges remaining because of the rigidity being imparted temporarily.

In accordance with the twelfth configuration of the invention, a simple configuration, using elastic deformation of a pair of elastic rollers is used to impart rigidity to the sheet discharged to the upright, post-processing tray, to such a degree that the sheet will not droop down in the upright, post-processing tray until the aligned sheets are subjected to post-processing such as stapling etc.

Thereby, without the necessity of any extra special complicated mechanism, the sheets will be kept with an aligned posture without drooping down in the upright, post-processing tray, at least until the sheets are subjected to post-processing such as stapling and the like, and hence it is possible to perform post-processing such as stapling etc., for the sheets as a sheet stack. Moreover, after the completion of post-processing, there is no fear of the problem of traces of ridges remaining because of the rigidity being imparted temporarily.

In accordance with the thirteenth configuration of the invention, the upper part of the sheets stacked substantially is gripped to hold the sheets in a substantially upright manner.

Therefore, the sheet discharged to the upright, post-processing tray will not droop down until the aligned sheets are subjected to post-processing such as stapling etc. Further, it is possible to receive the sheet discharged from the image forming apparatus without delay and ensure proper alignment as a sheet stack to effect post-processing such as stapling etc. for the sheet stack.

In accordance with the fourteenth configuration of the invention, the sheet gripping means is configured so as to hold the sheets set substantially upright in the tray, with a strong enough force to be able to maintain the aligned state of the sheets.

Therefore, the sheets discharged to the upright, post-processing tray will be held and will not have their alignment disrupted until the aligned sheets are subjected to post-processing such as stapling etc. As a result, the sheets can be handled as an aligned stack of sheets and subjected to post-processing such as stapling etc.

In accordance with the fifteenth configuration of the invention, the lower edge of the sheet held in the upright, post-processing tray is pressed inward (toward the tray face) so as to push the sheets held in the post-processing tray toward the interior side, in preparation for smooth entrance of a following sheet.

In accordance with the sixteenth configuration of the invention, the abutment surface for supporting the lower end face of the stack of sheets aligned in the post-processing tray is formed with a treatment which makes the lower edges of the sheets move easily in the pressed direction of sheets and not liable to move in the opposite direction. Thus, lower edge portion of the sheets pressed and aligned toward the post-processing tray face will not return after the released of pressing from the sheet aligning means and the alignment of the sheets will not be disrupted.

In accordance with the seventeenth configuration of the invention, it is possible to align the sheet by the vibrations arising during the movement from the first, upper position to the second, lower position and then further align the sheet toward the post-processing tray face.

In this configuration, when another sheet is introduced into the post-processing tray while the sheet introduced to the second, lower position is pressed by the sheet aligning means toward the post-processing tray face, the post-processing tray may be moved toward the first, upper position in time with the sheet entrance. In this case, the topmost sheet of the sheet stack in alignment with the post-processing tray face will not be easily disrupted from its aligned state by the movement of the following sheet.

Further, in this configuration, when another sheet is introduced into the post-processing tray while the sheet introduced to the second, lower position is pressed by the sheet aligning means toward the post-processing tray face, the post-processing tray may be moved toward the first, upper position in time with the sheet entrance, with the sheet aligning means pressing the topmost sheet face of the already aligned sheets. In this case, the topmost sheet of the sheet stack in alignment with the post-processing tray face will not be easily disrupted from its aligned state by the movement of the following sheet.

In accordance with the eighteenth configuration of the invention, when the number of the sheets in the post-processing tray becomes equal to or greater than a predetermined number, the aligning action of a following sheet introduced into the post-processing tray and the sheet stack therein will be performed. Therefore, this configuration eliminates unnecessary movement of the moving portions so that mechanical noise can be reduced as much as possible.

In accordance with the nineteenth configuration of the invention, it is possible to prevent the bottommost sheet located on the underside of the sheet stack held in the post-processing tray from being rubbed and misplaced by the tray face when the supporting means moves up and down. Thus, this configuration makes it possible to move the aligned sheet stack to the predetermined post-processing station without disrupting the alignment of the sheet stack and hence ensure reliable post-processing for the aligned sheet stack.

In this configuration, the support assisting means may be configured as a sheet underside supporting means which can move in relation with the movement of the sheet supporting means along the post-processing tray face. In this case, it is possible to reduce the friction between the post-processing tray face and the underside of the sheet stack held in the post-processing tray, arising when the supporting means moves up and down, as much as possible, thus preventing disalignment of the sheets. Further, it is possible to move the aligned stack of sheets to the post-processing station without disrupting the alignment and hence ensure reliable post-processing for the aligned sheet stack.

Moreover, in this configuration, rotating members (rollers) may be arranged on the face of the upright, post-processing tray, as the support assisting means. In this case, by a simple structure, it is possible to prevent disalignment of the sheets caused by the friction between the post-processing tray face and the underside of the sheet stack held in the post-processing tray when the pusher moves up and down.

In accordance with the twentieth configuration of the invention, it is possible to assist the movement of the sheet stack aligned in the post-processing tray so that the alignment of the sheets will not be disrupted. Further it is possible to move the aligned stack of sheets to the post-processing station without disrupting the alignment and hence ensure reliable post-processing for an aligned sheet stack.

In accordance with the twenty-first configuration of the invention, the sheets held in the post-processing tray can be smoothly guided toward the aligned position, and then the movement of the aligned sheets can be limited to thereby perform reliable post-processing.

In this configuration, the sheet movement limiting element may be arranged in a position in the area which the leading edge of the sheet introduced into the post-processing tray by the conveyer means will not collide with. In this case, the leading edge of the sheet held in the post-processing tray can be smoothly guided toward the upper part of the tray.

In accordance with the twenty-second configuration of the invention, it is possible to smoothly receive various sizes of sheets discharged to the upright, post-processing tray and ensure proper alignment of the discharged sheets with respect to the direction of height. Accordingly, it is possible to smoothly receive a following sheet by preventing the following sheet from disrupting the posture of the sheet stack which was aligned in the predetermined manner. In this configuration, the same effect is produced when the sheet supporting means is configured to switch the position at which a sheet is introduced in accordance with the sheet size.

Further, the post-processing tray may have side-edge limiting elements which act on the edges on the both sides of the sheet to be received to produce predetermined alignment. In this case, the sheet supporting means is configured so as to switch its position for receiving a sheet in accordance with the sheet size so that the side-edge limiting elements will act on the edges on both sides of the received sheet in the most effective manner. In this case, the side-edge limiting elements also act on the side edges of the sheet at the most ideal positions, with respect to the direction of its width, thus ensuring proper alignment.

Moreover, the sheet supporting means may be configured so as to switch its position for receiving a sheet depending upon the size of the sheet with respect to the height direction of the upright, post-processing tray; that is, the position will be set lower when a small-sized (short) sheet is received than when a large-sized (long) sheet is received. This case also makes it possible to smoothly receive the sheet discharged to the upright, post-processing tray and ensure proper alignment of the discharged sheets with respect to the direction of height, without difficulties.

In accordance with the twenty-third configuration of the invention, by taking into account the direction of the curl or the amount of curling of a following sheet, for example, it is possible to smoothly receive the following sheet by preventing the sheet from disrupting the posture of the sheet stack which was aligned in the predetermined manner.

The sheet supporting means may be configured to switch its position for sheet reception so as to deal with the case where the sheets held in the tray have a curl projected to the side to which the following sheet is introduced. That is, the position for sheet reception is set so that the sheet discharged by the conveyer means can be received without being affected by surrounding components, or so that part of the curing of the sheets in the tray will abut the conveying means. Also in this case, it is possible to smoothly receive the sheet discharged to the upright, post-processing tray and ensure proper alignment of the sheet, without any difficulties.

In accordance with the twenty-fourth configuration of the invention, it is possible to smoothly receive the sheet discharged to the upright, post-processing tray and ensure proper alignment of the sheet with no dependency upon the amount of sheets held in the post-processing tray, without any difficulties.

Further, in this configuration, the sheet supporting means may be configured so that the position for sheet reception is gradually set higher in accordance with the amount of the sheets held by the sheet supporting means. In this case, the position for sheet reception can be set in accordance with the sheet storage conditions which will vary time to time.

In accordance with the twenty-fifth configuration of the invention, when the sheets discharged to the upright, post-processing tray have been set in alignment as a sheet stack and the pusher mechanism is moved down to (introduced into) the post-processing station, the lower edge face of the sheet stack is set to the reference surface of the post-processing tray and then the sheet stack is subjected to post-processing such as stapling. Thus, post-processing for a stack of sheets at the predetermined positions can be performed without disrupting the alignment of the sheet stack.

In this configuration, it is also possible to arrange the pressing means so as to act symmetrically with respect to the center of the sheets aligned in the post-processing tray. In this case, the sheet stack is pressed and supported uniformly toward the reference surface of the post-processing tray. Hence, the sheets can be supported in a stable manner without disrupting the alignment of the sheet stack, until the post-processing is completed.

In accordance with the twenty-sixth configuration of the invention, no load acts on the sheet discharged to the post-processing tray, so that it is possible to improve the alignment of the sheets. Further, since the sheet stack is set to the reference surface of the post-processing tray without the alignment of the sheet stack disrupted and then is subjected to post-processing such as stapling, it is possible to perform post-processing for a stack of sheets at the predetermined position with the alignment maintained.

In accordance with the twenty-seventh configuration of the invention, the lower edge of the sheet discharged to the post-processing tray is guided to the abutment surface, and then the lower edge of the sheet is released. As a result, even a sheet curling at its ends can be received and aligned with the other sheets along the abutment portion.

In accordance with the twenty-eighth configuration of the invention, the lower edge of the sheet discharged to the post-processing tray is guided to the abutment surface and then the lower edge of the sheet is pressed whilst being released in some degree. As a result, for example, even a sheet curling at its ends can be received, set to the reference surface side in the abutment portion and aligned with the other sheets.

In this configuration, it is also possible to configure the elastic pressing element so that it extends lower than the sheet edge abutment surface of the sheet supporting means.

In this case, for example, even a sheet curling at its lower end can be received, set to the reference surface in the abutment portion and aligned with the other sheets. Thus, it is possible to prevent the lower edge of the sheet from catching into the lower side of the elastic pressing element and hence the sheet edge and the edge of the pressing element will not be damaged.

DESCRIPTION OF THE PREFERRED EMBODIMENTS (The first embodiment of the present invention)

The first embodiment of the present invention will hereinafter be described with reference to FIGS. 1 through 8C.

Figure 1:
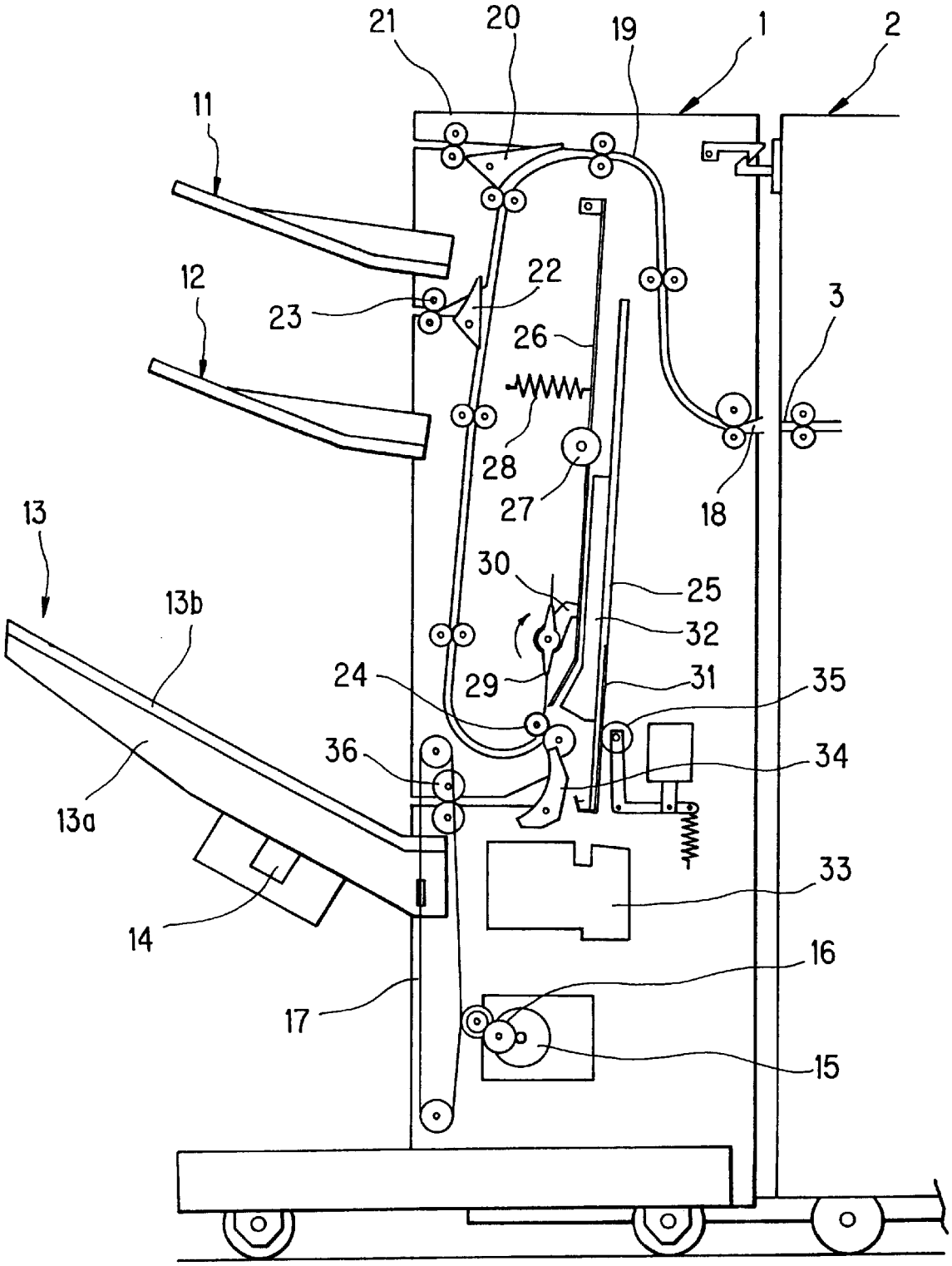
FIG. 1 is an overall sectional view schematically showing a sheet post-processing apparatus in accordance with the embodiment of the present invention.

A sheet post-processing apparatus 1 of this embodiment, is installed, as shown in FIG. 1, on the sheet output port 3 side in an image forming apparatus 2, which is typically represented by digital copiers, digital color copiers and other usual copiers, and performs post-processing such as stapling, etc., for the sheets, including paper, OHP sheets etc., discharged after image formation from this image forming apparatus as well as performing sheet sorting and other processes.

Other than stapling mentioned above, post-processing tasks for sheets, to be handled by sheet post-processing apparatus 1 may include hole-punching, gluing and the like. In this embodiment, the description will be made referring to an example of stapling as the post-processing.

First, arranged on the left side of sheet post-processing apparatus 1 are three individual trays, i.e., from the top, an upper fixed tray 11, a lower fixed tray 12 and an offset tray 13 which can move up and down and perform offset sorting.

Image forming apparatus 2 used in this embodiment is a composite digital machine having multiple operating modes such as facsimile mode, printer mode and the like besides the copy mode, and is set in a manner so that, for example, upper fixed tray 11 is used as the output tray in the fax mode and lower fixed tray 12 is used as the output tray in the printer mode, to thereby sort out the output sheets in one mode from those in another mode.

Offset tray 13 is set as the output tray for the copy mode, to which stapled sheets with images recorded thereon may be output or to which sheets without stapling may be output, in accordance with the instructions from the operator.

Further, in some instances where imaged sheets output in the printer mode need to be stapled as multiple leaflets of sheets, it is possible to set offset tray 13 as the output tray for imaged sheets in a mode other than the copy mode.

Here, the above offset tray 13 can smoothly move vertically, or up and down by the driving force transmitted from an up-and-down motor 15 by way of a power transmission system 16 comprised of gears etc., and a driving wire 17 so that offset tray 13 will be able to receive the sheets discharged thereto.

Further, offset tray 13 has a two-layered structure of an offset tray reinforcing plate 13*a* underneath and an offset tray plate 13*b* above so that offset tray plate 13*b* can be moved horizontally, perpendicular to the conveyed direction of sheets, relative to offset tray reinforcing plate 13*a* by the driving force from an offset motor 14.

This configuration enables offset sorting of multiple copies of sheets or sheet stacks discharged from sheet post-processing apparatus 1. That is, when offset sorting is needed, offset tray plate 13*b* is moved left to right or right to left every time a sheet is discharged, so that sheets or the like are stacked on offset tray 13 on opposing sides.

This provides a markedly simple sorting of sheet stacks even if the sheet stacks are not stapled.

Next, components arranged inside this sheet post-processing apparatus 1 will be described.

Sheet post-processing apparatus 1 includes therein: a main conveyance path 19 for successively conveying input sheets downstream; switching gates 20 and 22 disposed partway in this main conveyance path 19 to lead the sheet to desired output trays; a post-processing tray 25 arranged upright at the approximate center of the apparatus for aligning the output sheets and then subjecting the sheets to processing such as stapling and the like; and a stapler 33; and a final discharging means (discharge assist roller) 35.

Specifically describing the configuration of this sheet post-processing apparatus 1, the apparatus includes: a sheet input port 18 for receiving the sheet with an image thereon from an output port 3 of image forming apparatus 2; main conveyance path 19 for successively conveying the input sheet downstream; first switching gate 20 with a first discharge roller 21, disposed partway in main conveyance path 19 and guiding the sheet to upper fixed tray 11; and second switching gate 22 with a second discharge roller 23 disposed more downstream and guiding the sheet to lower fixed tray 12.

Further, post-processing tray 25 is arranged upright on the downstream side of main conveyance path 19. There is a third discharge roller 24 for feeding the sheet from main conveyance path 19 to this post-processing tray 25 from the lower part to the upper part.

The sheet which has been fed by means of third discharge roller 24 from the lower part to the upper part of post-processing tray 25 is directed upward along a sheet guide 26 and sheet guiding roller 27, which are disposed opposing the upright, post-processing tray 25, regardless of the sheet's size and length.

Arranged on the rear side of sheet guide 26 is a paddler mechanism 29 which aligns the sheet discharged to post-processing tray 25, toward the post-processing tray 25 face and along the alignment reference surface of a pusher mechanism 31 which is disposed below post-processing tray 25 to hold the lower edges of the sheets and move up and down between the predetermined positions with sheets held thereon.

This paddler mechanism 29 is made up of elastically deformable elements and rotates clockwise at the predetermined times so as to act on the sheet surface to thereby align the underside of the sheet onto the post-processing tray 25 face and also align the lower edge of the sheet along the reference face of pusher mechanism 31 located in the lower part of post-processing tray 25.

Provided as the rotating mechanism for driving paddler mechanism 29 is a cam mechanism 30 for rotating the above-described sheet guide 26 toward post-processing tray 25. This sheet guide 26 is normally supported by a spring 28 so that the guide retracts from the post-processing tray 25 side, and rotates toward the post-processing tray 25 face as paddler mechanism 29 rotates, to thereby press the sheet surface.

Provided on both side of post-processing tray 25 are a pair of sheet-side aligning elements 32 for aligning both sides of the sheet so that the sheet discharged in post-processing tray 25 is aligned correctly by the aligning action at the lower sheet edge and the aligning action at the sheet sides, to wait for the post-processing device to operate.

Figures 2A, 2B, 2C, 2D:
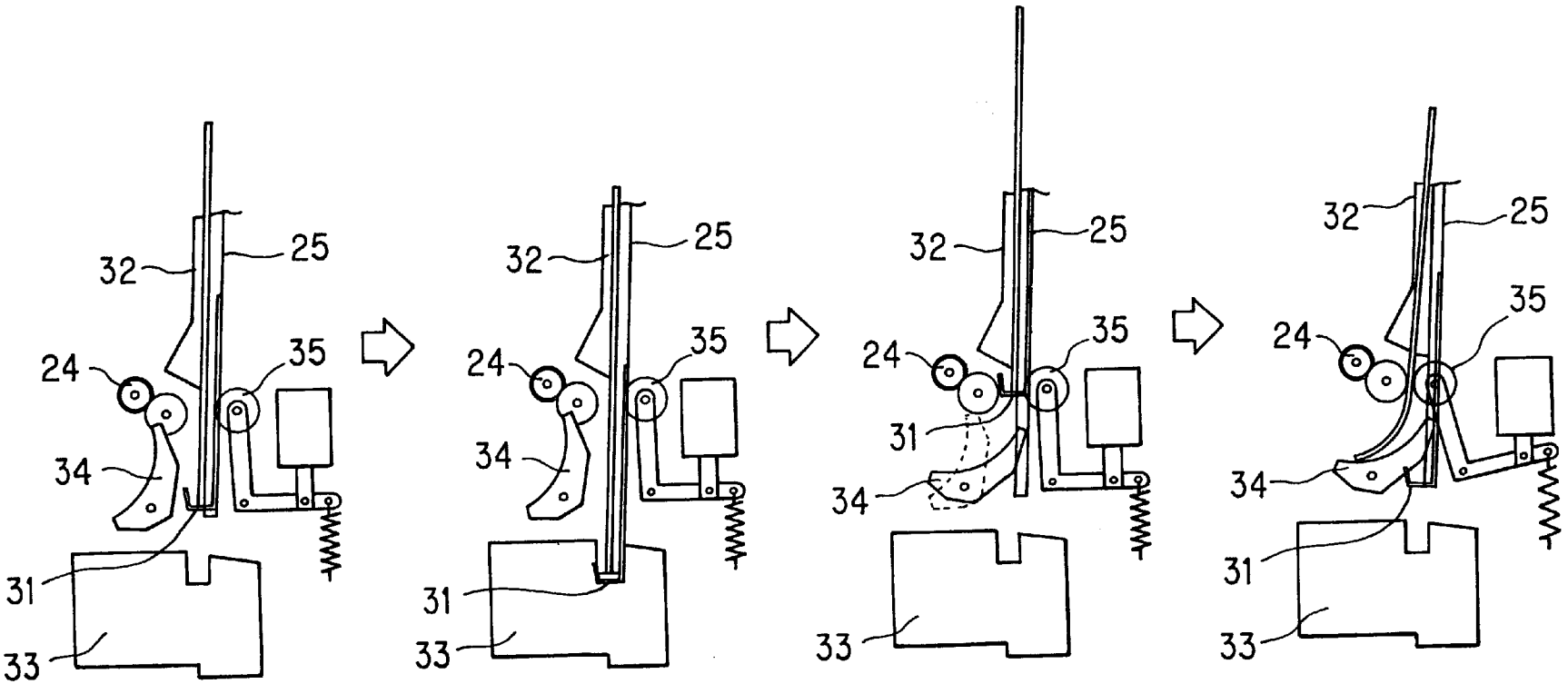
FIGS. 2A to 2D are diagrams showing the stapling procedures of a sheet post-processing apparatus in accordance with the embodiment of the present invention.

Then, when pusher mechanism 31 moves down to the position of stapler 33, the sheets aligned in post-processing tray 25, also move downwards with their lower edges abutted on the reference surface of pusher mechanism 31, whereby the sheets are stapled. FIGS. 2A and 2B show the situations up to this stage.

Then, the thus stapled stack of sheets is temporarily moved upwards by pusher mechanism 31, then pusher mechanism 31 again descends after the switching of third switching gate 34, so that the stapled sheet stack is conveyed and discharged onto offset tray 13 by means of discharge assist roller 35, which had been retracted before this stage, and a fourth discharge roller 36. FIGS. 2C and 2D show the situations up to this stage.

The overall configuration and sheet handling process of sheet post-processing apparatus 1 shown in FIG. 1 have been described heretofore. FIGS. 2A through 2D show the steps of stapling of the aligned sheets, in sequential order from the aligned state of sheets to the stapling step and sheet discharging state after stapling.

Next, further manipulation to achieve improved alignment of sheets in sheet post-processing apparatus 1 having the above configuration will be described.

Figure 3:
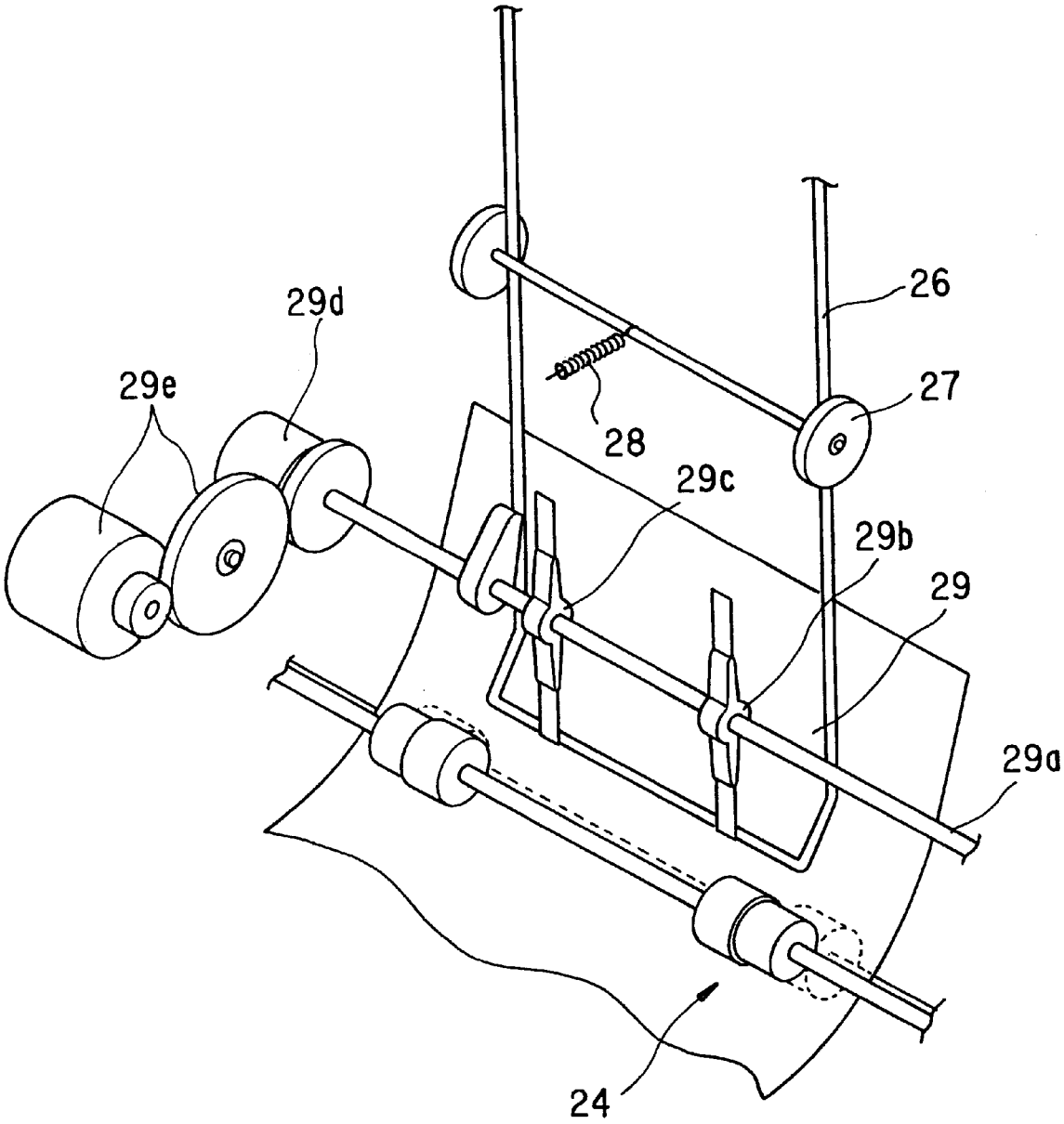
FIG. 3 is an overall perspective view showing the configuration of a sheet aligning device in a post-processing tray in accordance with the embodiment of the present invention.

First, paddler mechanism 29 for aligning the sheet with post-processing tray 25 arranged upright includes: as shown in FIG. 3, a rotary shaft 29*a* which is laid across the width of post-processing tray 25; multiple paddlers 29*b* and 29*c* fitted on rotary shaft 29*a* and separated a predetermined distance away from each other; and rotational driving couplings 29*d* and 29*e* for rotating rotary shaft 29*a* and multiple paddlers 29*b* and 29*c*.

These rotary driving couplings 29*d* and 29*e* drive rotary shaft 29*a* and multiple paddlers 29*b* and 29*c* every time a sheet is discharged by third discharge roller 24 from the lower part to the upper part of post-processing tray 25, so that the sheet is aligned with post-processing tray 25.

Since various types of sheets are discharged to post-processing tray 25, differing in their features, such as size, thickness, surface roughness, etc., the degree of alignment by paddler mechanism 29 and sheet-side aligning elements 32 of each sheet type may be different.

To deal with this, the number of revolutions of paddler mechanism 29 is changed in conformity with the features of the sheet to be aligned on post-processing tray 25, so that it is possible to improve the degree of alignment, regardless of sheet characteristics.

For example, in the case of a large-sized sheet such as A3 or B4, the contact area of the sheet surface is greater than that of a small-sized sheet, so that multiple paddlers 29*b* and 29*c* are rotated two and a half times. On the other hand, in the case of a small-sized sheet such as A4 or B5, the contact area of the sheet surface is smaller than that of a large-sized sheet, so that multiple paddlers 29*b* and 29*c* are rotated two times. This switching of the number of revolutions can be controlled using a clutch 29*d* on the basis of sheet size information from image forming apparatus 2.

It is also possible to make multiple paddlers 29*b* and 29*c* act on the sheet at different timings, to thereby achieve improved alignment of the sheet on post-processing tray 25. Illustratively, by pressing the sheet onto the face of post-processing tray 25, gradually from one side end to the other, air between the sheets can be pushed out slowly, to thereby improve the face alignment between adjacent sheets.

Next, description will be made on the manipulation for preventing the sheet discharged to upright, post-processing tray 25 from drooping down in post-processing tray 25.

First, when a sheet is attempted to be aligned in upright, post-processing tray 25, there are instances where the sheet cannot be set properly, that is, the upper part of the sheet flexes or the middle part of the sheet warps due to sheet characteristics or due to lack of the rigidity of the sheet.

To deal with this, a third discharge roller assembly 24 is configured as shown in FIG. 3 so as to form ridges on the surface of the sheet discharged to post-processing tray 25, to thereby achieve improved alignment of the sheet within post-processing tray 25 which is arranged upright.

The degree of the ridges formed on the sheet should be as great enough to maintain the alignment up to the completion of the post-processing operation such as stapling etc. in post-processing tray 25 but should be low enough that the ridges will be inconspicuous after the completion of post-processing operation.

Figure 4:
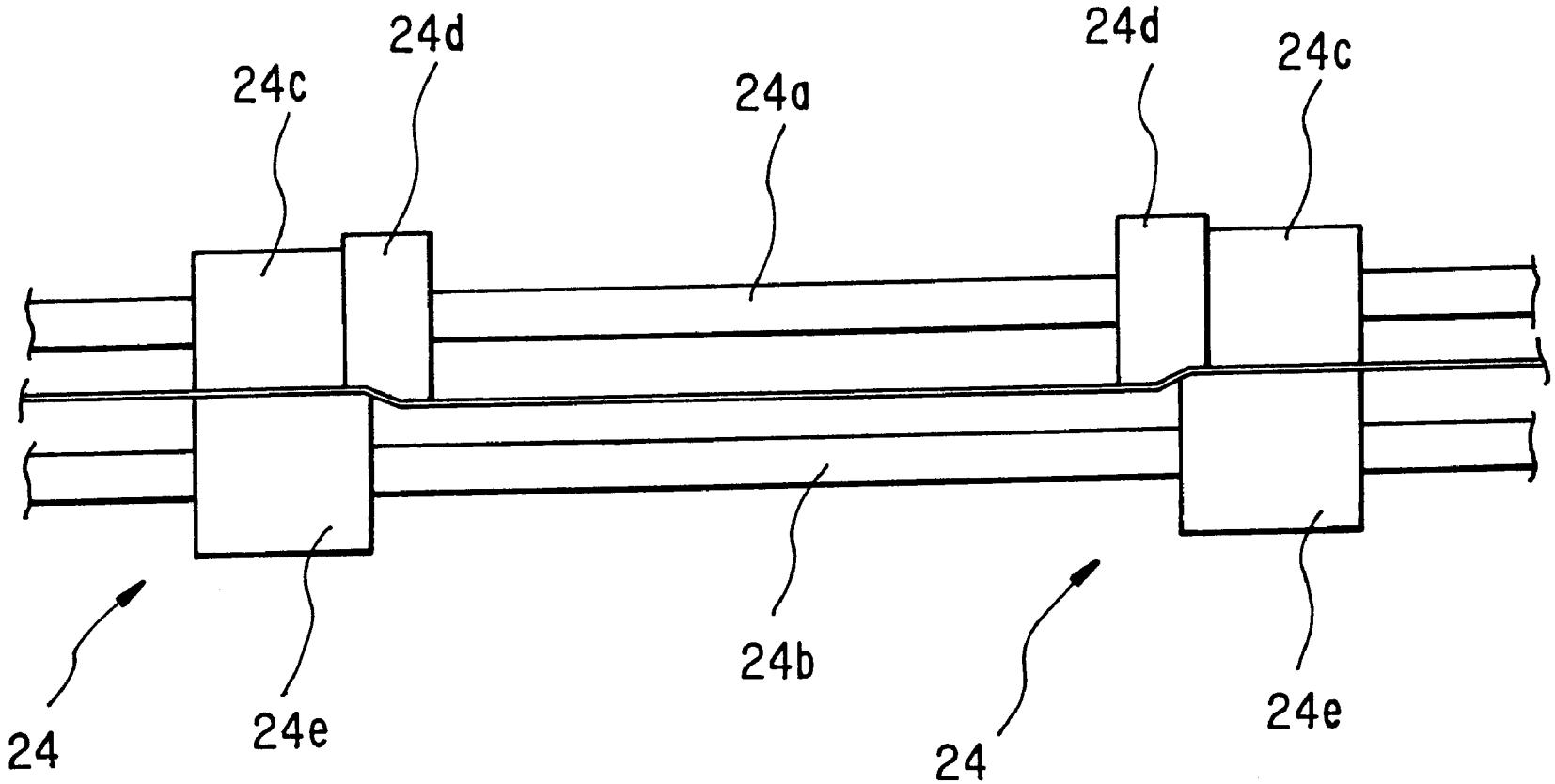
FIG. 4 is a sectional view showing the configuration of elastically deformable rollers for imparting appropriate rigidity to the sheet discharged to an upright, post-processing apparatus for preventing the sheet from drooping down in a post-processing tray in accordance with the embodiment of the present invention.

FIG. 4 shows third discharge roller assembly 24 having the mechanism for forming such ridges on the sheet. In this assembly, an upper rotary shaft 24*a* having roller elements 24*c* formed of polyacetal resin and rubber roller elements 24*d* formed of sponge-like rubber, both fitted thereon are arranged opposing a lower rotary shaft having robber roller elements 24*e* formed of sponge-like rubber, fitted thereon.

In this arrangement, rubber roller elements 24*d* on the upper side and rubber roller elements 24*e* on the lower side press each other so that the edges of both produce deformed nips, which produce appropriate ridges on the surface of the sheet as it is nipped and conveyed.

Since the areas around the ridges on the sheet produce stronger resistance against the flexure of the sheet than any other part, when paddler mechanism 29 shown in FIG. 3 or sheet guide 26 that rotates with the rotation of paddler mechanism 29 is configured to press the sheet in the ridged areas, it is possible to further enhance alignment of the sheet without producing any sheet flexure.

Next, another example of sheet guide 26 acting on the sheet surface together with paddler mechanism 29.

Figure 5C:
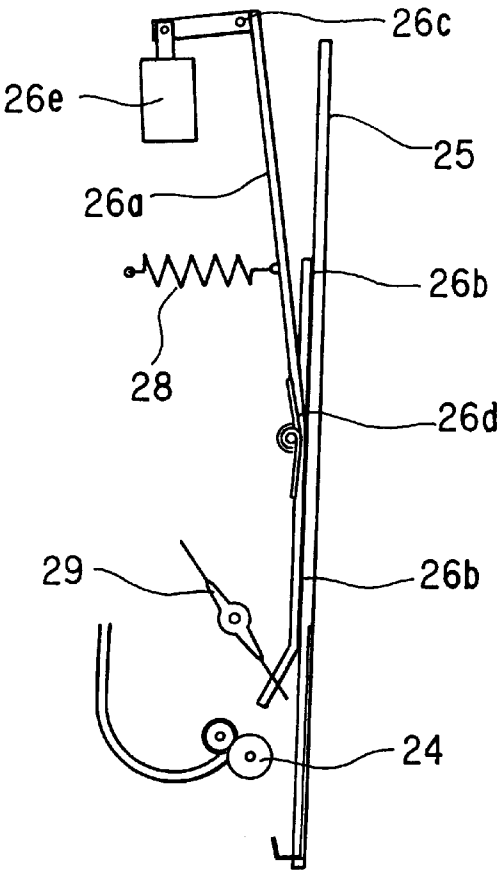
FIGS. 5A to 5C are overall sectional views showing a sheet pressing and aligning device in a post-processing tray in accordance with another embodiment of the present invention.
Figure 5B:
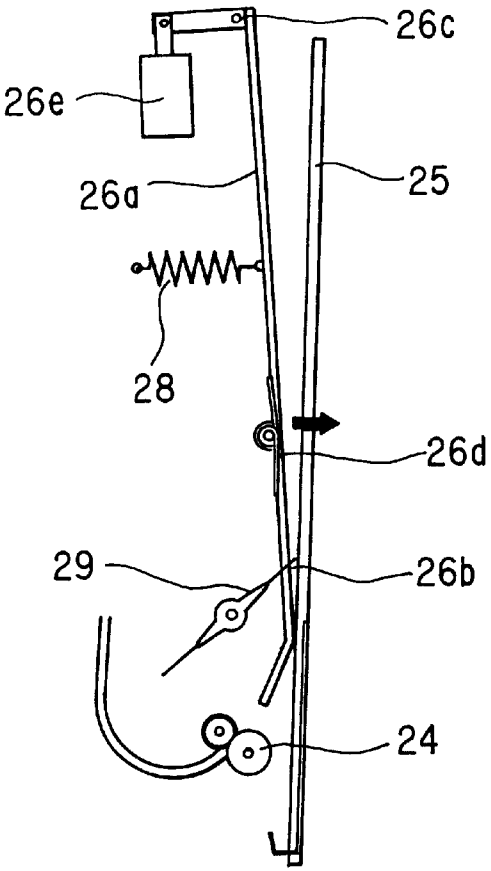
Figure 5A:
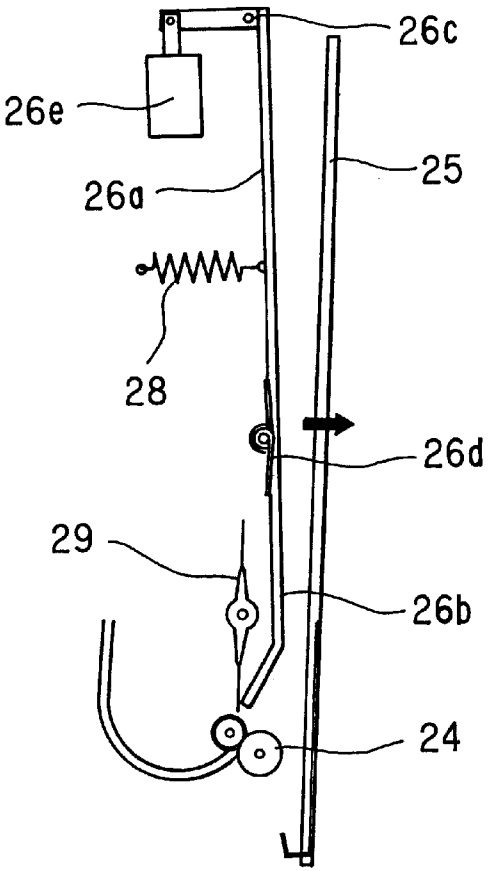

FIGS. 5A to 5C show a variation of a sheet guide 26 for guiding the sheet discharged from the lower part to the upper part of post-processing tray 25. This sheet guide 26 comprises a rotational piece 26*a* which pivots about an axle 26*c* located above post-processing tray 25; and a sheet pressing piece 26*b* which is suspended at the lower end of rotational piece 26*a* so as to be deflectable. This sheet guide 26 is rotated in the direction of the arrow by means of a solenoid 26*e*.

Here, sheet pressing piece 26*b* deflectably suspended at the lower end of rotational piece 26*a,* is kept in the predetermined position by the urging force of a spring 26*d* while being kept away from post-processing tray 25 by spring 28 as shown in FIG. 5A so as to guide the sheet which is fed into post-processing tray 25 from its bottom to top.

Next, when the sheet is discharged into post-processing tray 25, solenoid 26*e* acts on rotational piece 26*a* of sheet guide 26 so as to rotate sheet guide 26 as a whole as shown in FIG. 5B whereby sheet pressing piece 26*b* of sheet guide 26 presses the lower part of the sheet.

A further continuous action of solenoid 26*e* on rotational piece 26*a* of sheet guide 26, causes sheet pressing piece 26*b* to deflect about the lower end of rotational piece 26*a* of sheet guide 26 as shown in FIG. 5C, so that sheet pressing piece 26*b* of sheet guide 26 gradually presses the sheet from the lower part to the upper part.

In this way, air between the sheet surfaces can be pushed out gradually from one end (lower part) to the other end (upper part), to thereby ensure the alignment of the sheet with the adjacent sheet surface.

Referring to FIGS. 6A to 8C, still another embodiment of the invention will be described.

The mechanism newly added to the above embodiment is a gripping means 37, which is positioned above upright, post-processing tray 25 to grip the sheets discharged in post-processing tray 25 so that the sheets will not flex within post-processing tray 25.

This griping means 37 is composed of a sheet griping portion 37*a,* a link portion 37*b,* a solenoid 37*c* for actuation and the like. When solenoid 37*c* actuates link portion 37*b,* sheet gripping portion 37*a* acts on the upper part of the discharged sheet in post-processing tray 25, so as to hold the sheet substantially upright in post-processing tray 25.

Referring to FIGS. 6A to 8C, description will be made sequentially about the progressing steps of a sheet, i.e., the state where the sheet is discharged into post-processing tray 25, the way of sheet alignment and the manner of supporting the sheet upright.

Figure 6A:
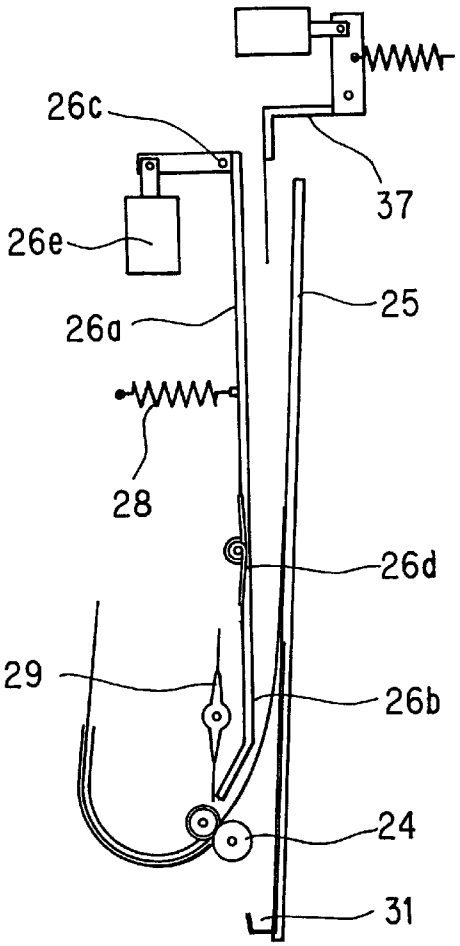
FIGS. 6A to 6C are the first, overall sectional views showing a sheet pressing and aligning device in a post-processing tray in accordance with still another embodiment of the present invention.
Figure 6B:
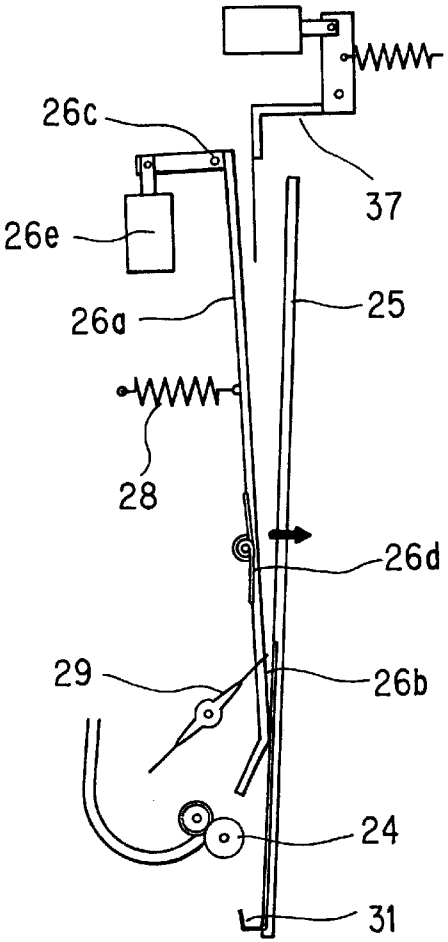

As a sheet is discharged by third discharge roller 24 disposed close to the lower end of post-processing tray 25, toward the upper part of post-processing tray 25, as shown in FIG. 6A, the action of solenoid 26*e* rotates sheet guide 26, which is composed of rotational piece 26*a* and sheet pressing piece 26*b* deflectably suspended at the lower end of rotational piece 26*a,* in the direction of the arrow. During this action, an unillustrated aligning means operates to act on both sides of the sheet so as to align the sheet in the predetermined state.

Figure 6C:
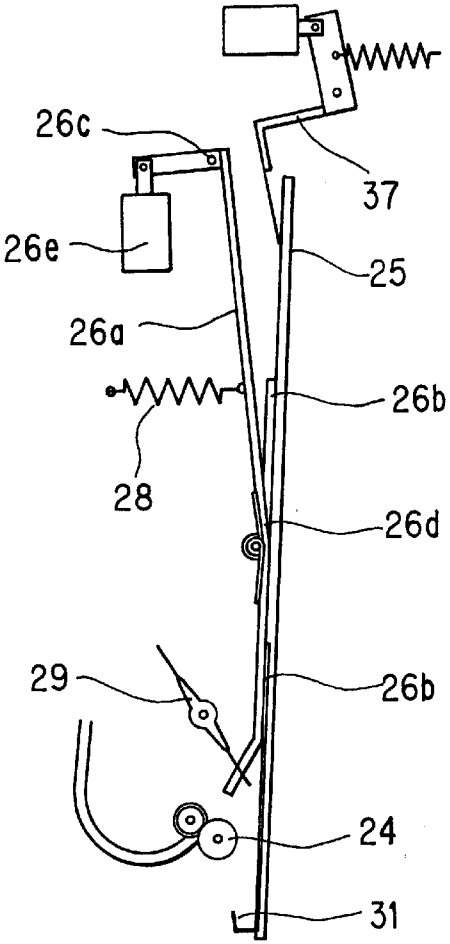

A further continuous action of solenoid 26*e* on rotational piece 26*a* of sheet guide 26, causes sheet pressing piece 26*b* to deflect about the lower end of rotational piece 26*a* of sheet guide 26 as shown in FIG. 6C, so that sheet pressing piece 26*b* of sheet guide 26 gradually presses the sheet from the lower part to the upper part.

In this way, air between the sheet surfaces can be pushed out gradually from one end (lower part) to the other end (upper part), to thereby produce enhanced alignment with the adjacent sheet surface. Further, when the whole part of sheet pressing piece 26*b* has pressed the sheet, sheet gripping portion 37*a* of sheet gripping means 37 urges the upper part of the sheet discharged in post-processing tray 25 so as to grip the sheet substantially upright in post-processing tray 25.

Figure 7C:
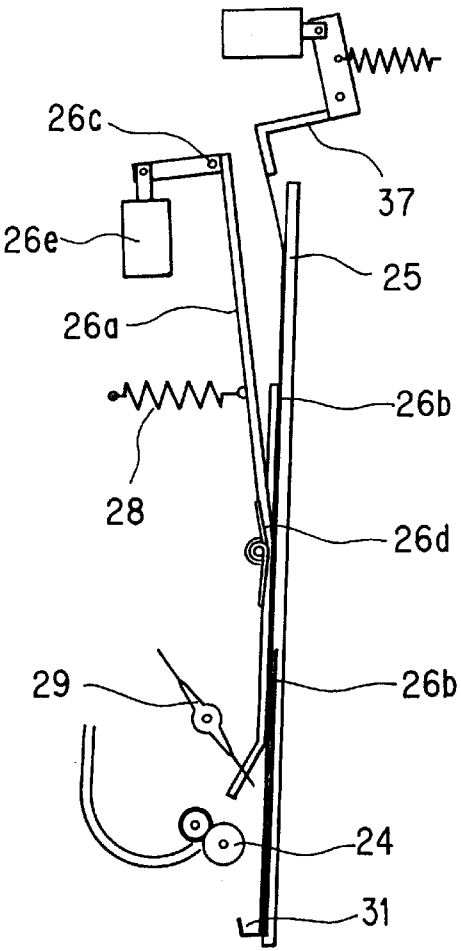
FIGS. 7A to 7C are the second, overall sectional views showing a sheet pressing and aligning device in a post-processing tray in accordance with still another embodiment of the present invention.
Figure 7B:
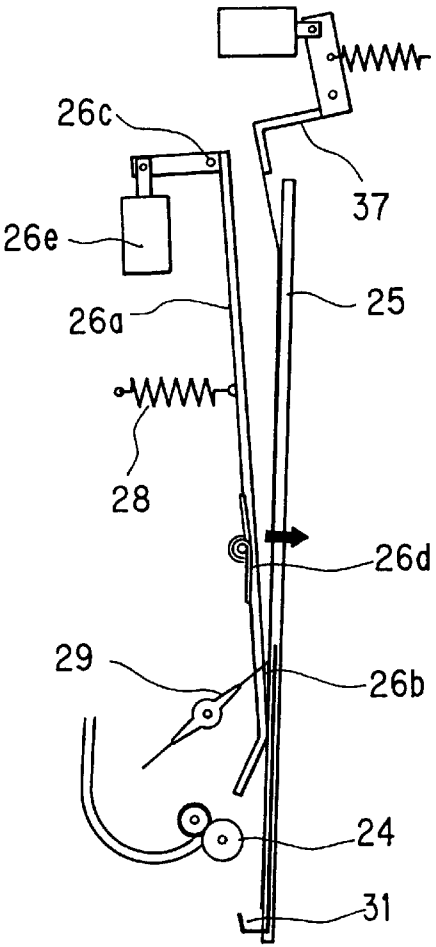
Figure 7A:
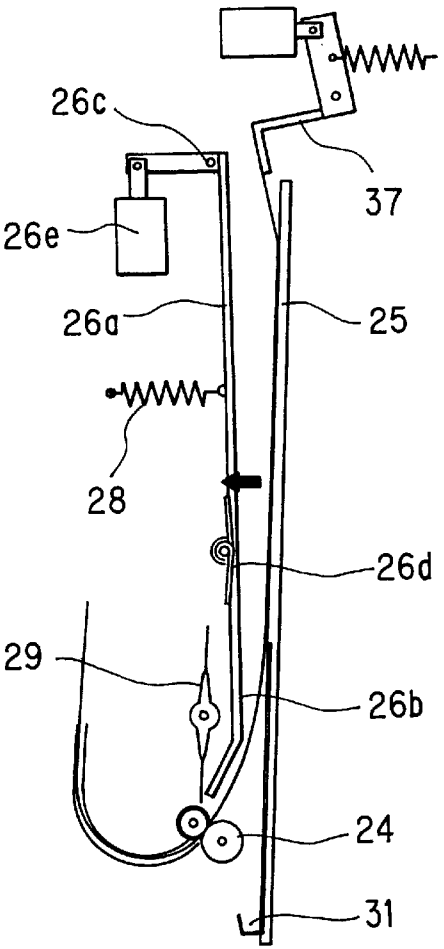

Next, in the state where sheet gripping portion 37*a* of sheet gripping means 37 is gripping the upper part of the sheet discharged in post-processing tray 25 as shown in FIG. 7A, when sheet guide 26 retracts from the surface of the sheet positioned upright, in the direction of the arrow, the following sheet is conveyed toward the upper part of post-processing tray 25 and discharged therein.

When the thus conveyed, following sheet has been discharged into post-processing tray 25, the sheet is gradually pressed by sheet guide 26 so as to be aligned in the same manner as stated above, as shown in FIG. 7B.

Thus, air between the sheet surfaces can be pushed out gradually from one end (lower part) to the other end (upper part) to thereby produce enhanced alignment with the adjacent sheet surface.

Figure 8A:
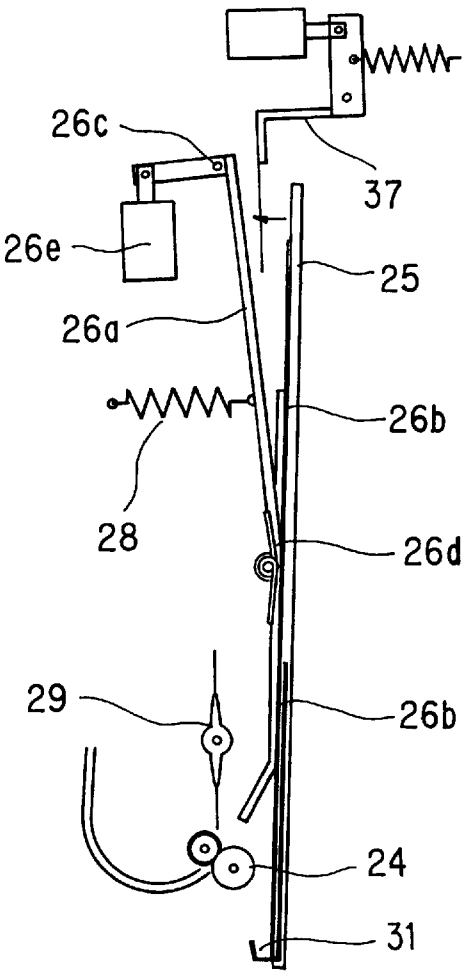
FIGS. 8A to 8C are the third, overall sectional views showing a sheet pressing and aligning device in a post-processing tray in accordance with still another embodiment of the present invention.
Figure 8B:
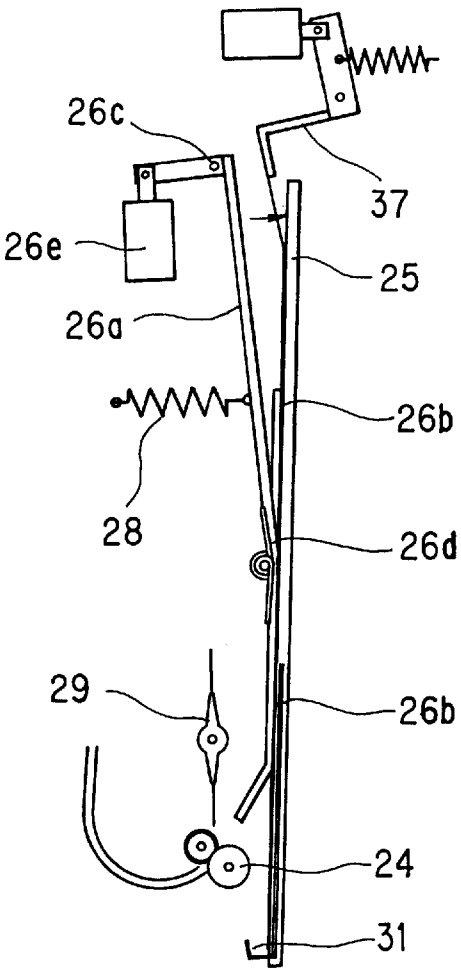
Figure 8C:
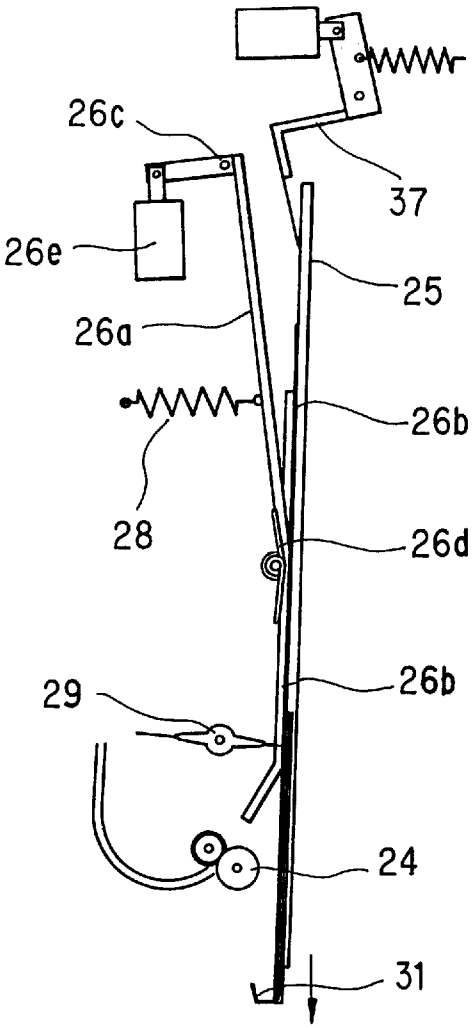

Next, when at least two sheets are collected in alignment as shown in FIG. 7C, sheet griping portion 37*a* of sheet gripping means 37 rotates in the direction of the arrow shown in FIG. 8A to temporarily release the sheets, and then rotates in the direction of the arrow shown in FIG. 8B to again grip the sheets upright in post-processing tray 25.

Here, sheet griping portion 37*a* is adapted to act on the sheets with high enough a pressure to maintain the upright, aligned state of the sheets in post-processing tray 25.

Finally, the stack of sheets thus aligned, is held by paddle mechanism 29 and the abutment surface of pusher mechanism 31, and is moved from the position shown in FIG. 2A to the station of stapler 33, shown in FIG. 2B, where the sheets are stapled without the alignment disrupted.

(The second embodiment of the present invention)

Figure 9C:
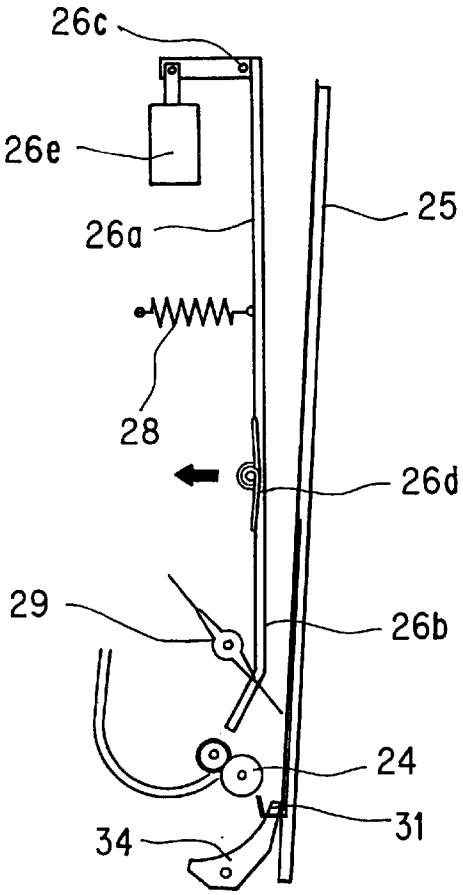
FIGS. 9A to 9C are the first, overall sectional views showing a sheet lower part pressing and aligning device in a post-processing tray in accordance with the second embodiment of the present invention.
Figure 9B:
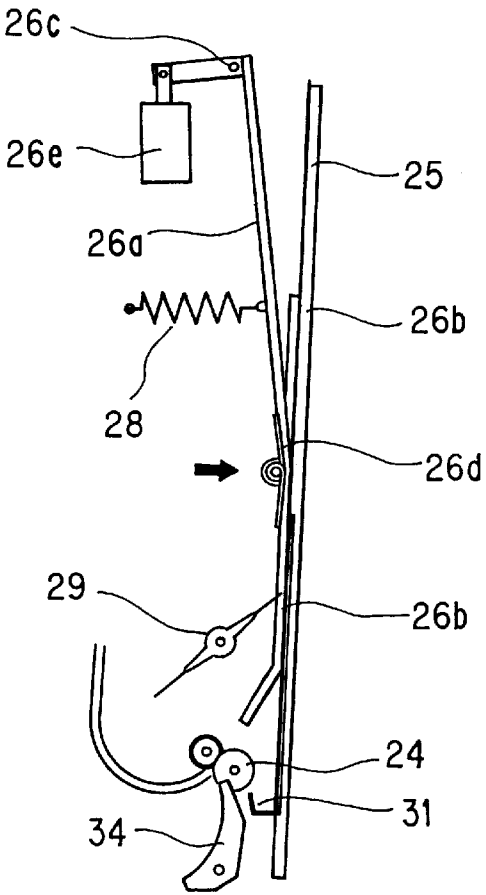
Figure 9A:
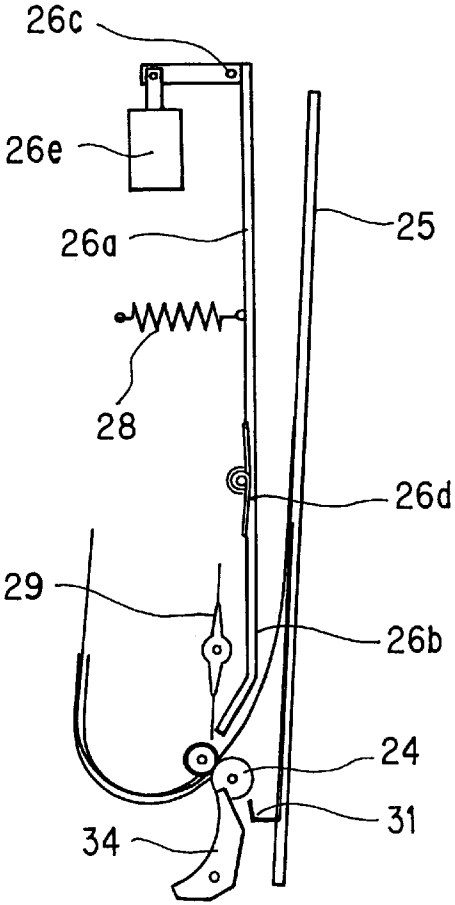

Referring next to FIGS. 9A to 9C, description will be made of a sheet aligning mechanism for the lower edge of the sheet conveyed toward post-processing tray 25. The additional mechanism here is a sheet aligning means 34 which is located opposing the lower part of upright, post-processing tray 25, and presses the discharged sheet in post-processing tray 25 to thereby align the sheet with the face of post-processing tray 25.

This sheet aligning means 34 also functions as the third switching gate 34 for directing the sheet stack that have been aligned and post-processed in post-processing tray 25, toward offset tray 13, as stated above.

Referring to FIGS. 9A to 11, description will be made sequentially about the manner in which the sheet is discharged into post-processing tray 25 and the manner in which the sheet lower portion is aligned.

As a sheet is directed by third discharge roller 24 disposed near the lower end of post-processing tray 25, toward the upper part of post-processing tray 25 set at the first position, as shown in FIG. 9A, the urging action of solenoid 26*e* rotates sheet guide 26, which is composed of rotational piece 26*a* and sheet pressing piece 26*b* deflectably suspended at the lower end of rotational piece 26*a,* in the direction of the arrow, so as to press the sheet discharged on post-processing tray 25 arranged upright as shown in FIG. 9B.

Then, as shown in FIG. 9C, sheet guide 26 composed of rotational piece 26*a* and sheet pressing piece 26*b* is released from the sheet surface, then sheet aligning means (third switching gate) 34 rotates to the right side acting on the lower end portion of the sheet to align the sheet with the post-processing tray 25 face.

Figure 10C:
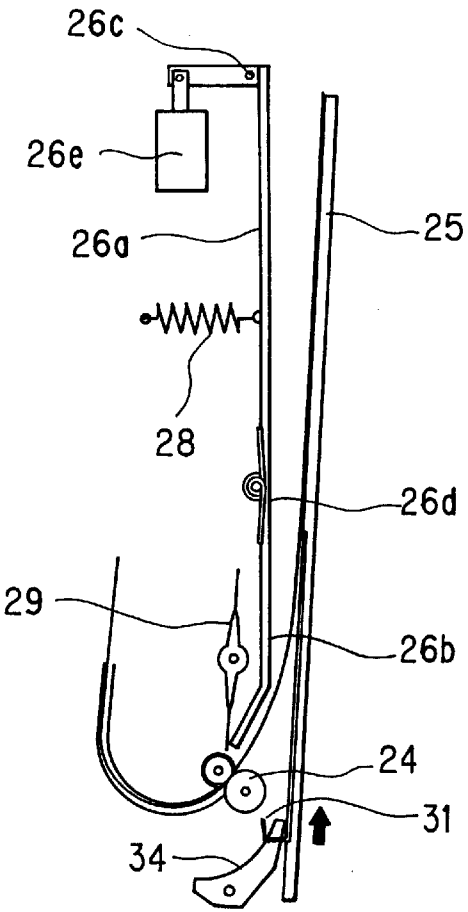
FIGS. 10A to 10C are the second, overall sectional views showing a sheet lower part pressing and aligning device in a post-processing tray in accordance with the second embodiment of the present invention.
Figure 10B:
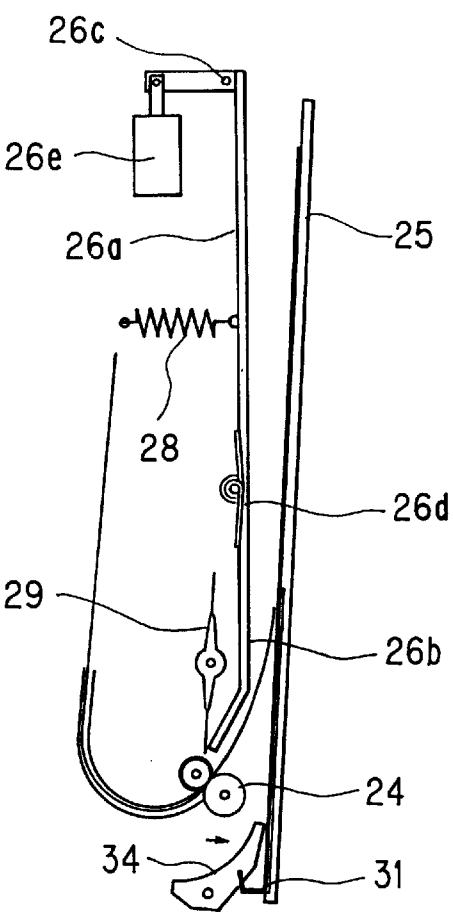
Figure 10A:
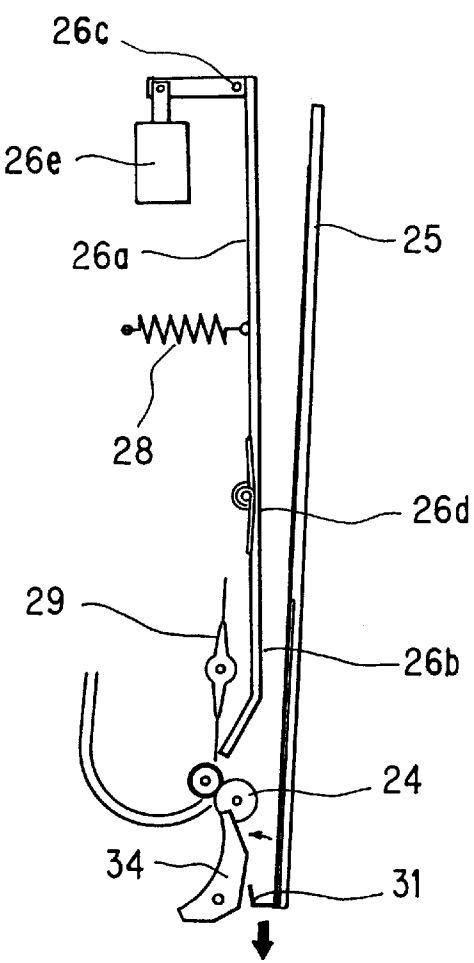

Thereafter, sheet aligning means (third switching gate) 34 temporarily releases the abutment against the sheet lower end portion as shown in FIG. 10A and returns to the original position while pusher mechanism 31 which suspends the sheet lower edge lowers to the second position to thereby impart vibrations to the sheet held and align it. Thus, the first sheet is aligned in the predetermined position in post-processing tray 25.

Next, when a second sheet is directed in, sheet aligning means (third switching gate) 34 again rotates toward the right side as shown in FIG. 10B, and presses the sheet lower end portion against the post-processing tray 25 face.

Then, as shown in FIG 10C, in synchronization with the introduction of the leading edge of the second sheet into post-processing tray 25, pusher mechanism 31 pushes up the sheet which is being pressed against post-processing tray 25, to the first position.

This completes the preparations for receiving the second sheet so that the alignment of the sheet being held by pusher mechanism 31 will not be disrupted by the friction and vibrations of the second sheet. Thereafter, the third and following sheets can be aligned as a stack of sheets by repeating the above-described flow of operation.

During this operation, though it is not shown, a sheet aligning mechanism is located at both sides of the sheet and acts on the side edges of the sheet at an appropriate timing so as to appropriately align the sheet with respect to the direction of the width of the sheet.

Next, a further manipulation of the sheet aligning mechanism in the sheet post-processing apparatus of the invention will be described.

Figure 11:
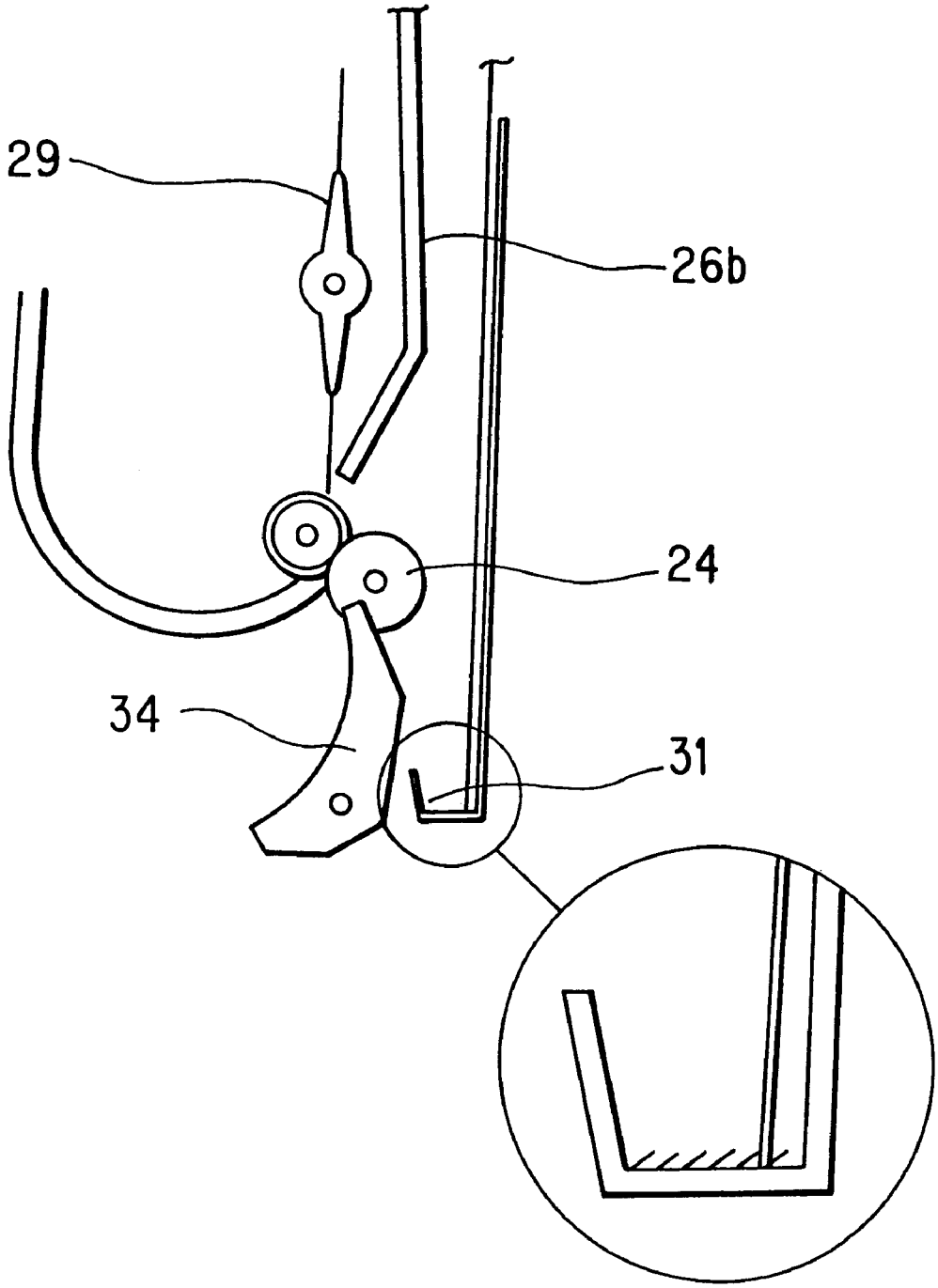
FIG. 11 is a partial enlarged sectional view showing a sheet abutment surface with a furred portion of the pusher mechanism for holding the lower end part of the sheets discharged to the upright, post-processing apparatus, in accordance with the second embodiment of the present invention.

First, as shown in FIG. 11, the abutment face of pusher mechanism 31 for holding the lower sheet edges is treated so that the lower sheet end moves easily in the pressed direction of sheets and is not liable to move in the opposite direction. This manipulation is to prevent the sheet once pressed and aligned from moving on the abutment surface of pusher mechanism 31. For example, a furred portion in which fibers are implanted slantwise in a uniform direction (directed toward post-processing tray 25, in this case) may be provided.

In the above description, sheet aligning means (third switching gate) 34 is adapted to press and align the sheet with the post-processing tray 25 face, from the first sheet, but it is possible to configure the device such that it becomes active to perform the aligning operation for the sheets or the stack of sheets, only after a certain number of sheets have been held in the post-processing tray. This eliminates unnecessary movement of the moving portions so that mechanical noise can be reduced as much as possible and yet it is possible to reliably hold the introduced sheets in the post-processing tray and align them as a sheet stack.

(The third embodiment of the present invention)

In the above first embodiment, the configuration of a sheet aligning means was described with reference to FIG. 3. Here, the sheet aligning mechanism around post-processing tray 25 in sheet post-processing apparatus 1 will be described in further detail with reference to FIG. 12.

Figure 12:
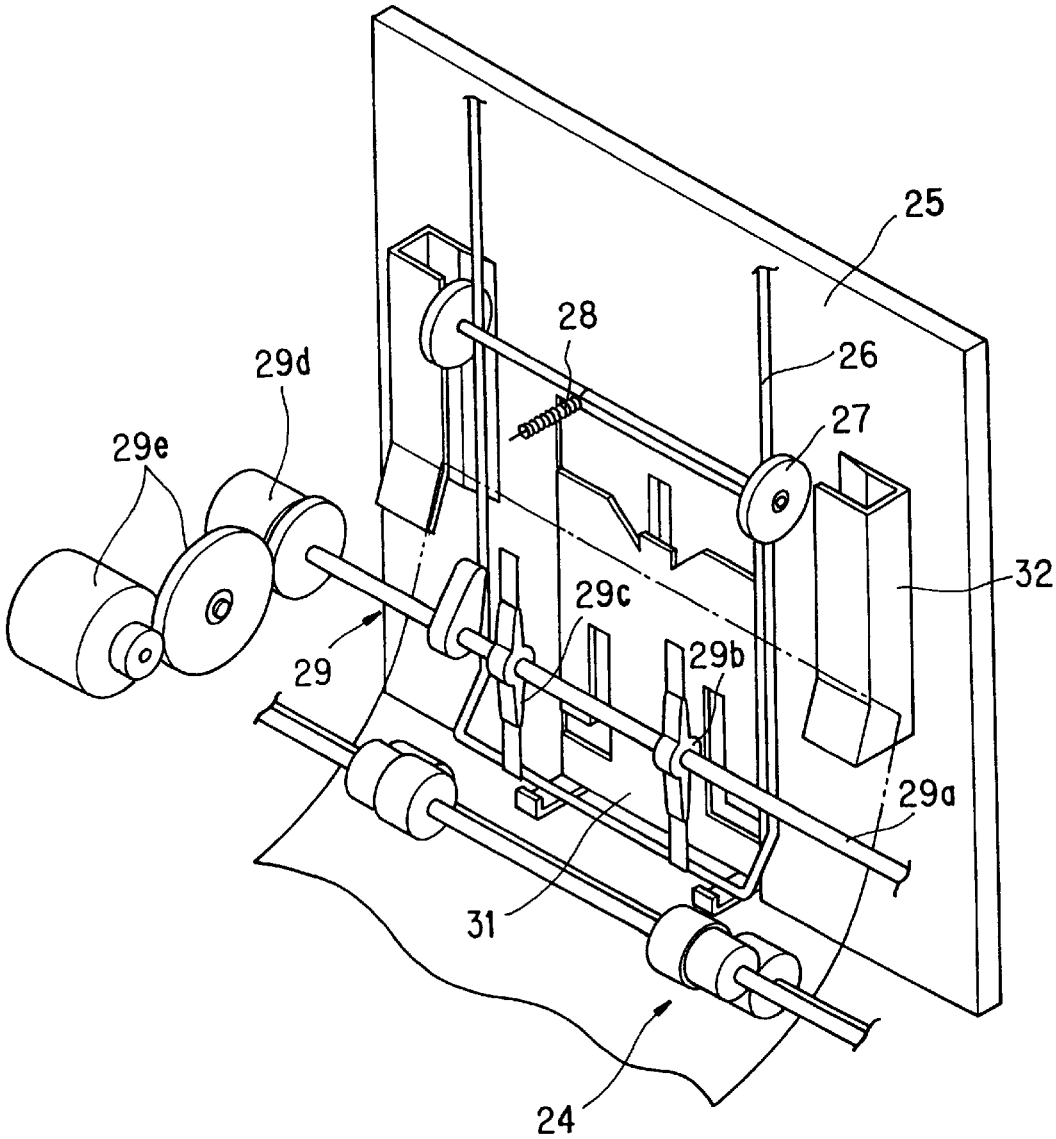
FIG. 12 is an overall perspective view showing a paddler mechanism pressing the sheets discharged to the upright, post-processing tray, and a sheet supporting means for holding the lower end part of the sheets and the sheet underside, in the third embodiment of the present invention.

First, paddler mechanism 29 for aligning the sheet toward the face of upright, post-processing tray 25 includes: as shown in FIG. 12, a rotary shaft 29*a* which is laid across the width of post-processing tray 25; multiple paddlers 29*b* and 29*c* fitted on rotary shaft 29*a* and separated a predetermined distance away from each other; and rotational driving couplings 29*d* and 29*e* for rotating rotary shaft 29*a* and multiple paddlers 29*b* and 29*c*. Further, sheet supporting means (pusher mechanism) 31 is arranged on the surface of post-processing tray 25 so that it can move up and down.

These rotary driving couplings 29*d* and 29*e* drive rotary shaft 29*a* and multiple paddlers 29*b* and 29*c* every time a sheet is discharged by third discharge roller 24 from the lower part to the upper part of post-processing tray 25, so that the sheet is aligned with sheet supporting means 31 on the surface of post-processing tray 25.

Since various types of sheets are discharged to post-processing tray 25, differing in their features, such as size, thickness, surface roughness, etc., the degree of alignment by paddler mechanism 29 and sheet-side aligning elements 32 of each sheet type may be different.

To deal with this, the number of revolutions of paddler mechanism 29 is changed in conformity with the features of the sheet to be aligned on post-processing tray 25, so that it is possible to achieve improved alignment of the sheet regardless of sheet characteristics.

For example, in the case of a large-sized sheet such as A3 or B4, the contact area of the sheet surface is greater than that of a small-sized sheet, so that multiple paddlers 29*b* and 29*c* are rotated two and a half times. On the other hand, in the case of a small-sized sheet such as A4 or B5, the contact area of the sheet surface is smaller than that of a large-sized sheet, so that multiple paddlers 29*b* and 29*c* are rotated two times. This switching of the number of revolutions can be controlled using a clutch 29*d* on the basis of sheet size information from image forming apparatus 2.

In the above configuration, the number of revolutions of paddler mechanism 29 is switched in accordance with the characteristics of the sheet. It is also possible to switch the number of reciprocating movement relating to sheet-side aligning means 32 to achieve improved sheet alignment.

Further, as shown in FIG. 3, it is also possible to make multiple paddlers 29*b* and 29*c* act on the sheet at different timings, to thereby improve the sheet alignment in post-processing tray 25. Illustratively, by pressing the sheet onto the face of post-processing tray 25, gradually from one end to the other, air between sheets can be pushed out slowly, to thereby improve the face alignment between adjacent sheets.

Figure 13:
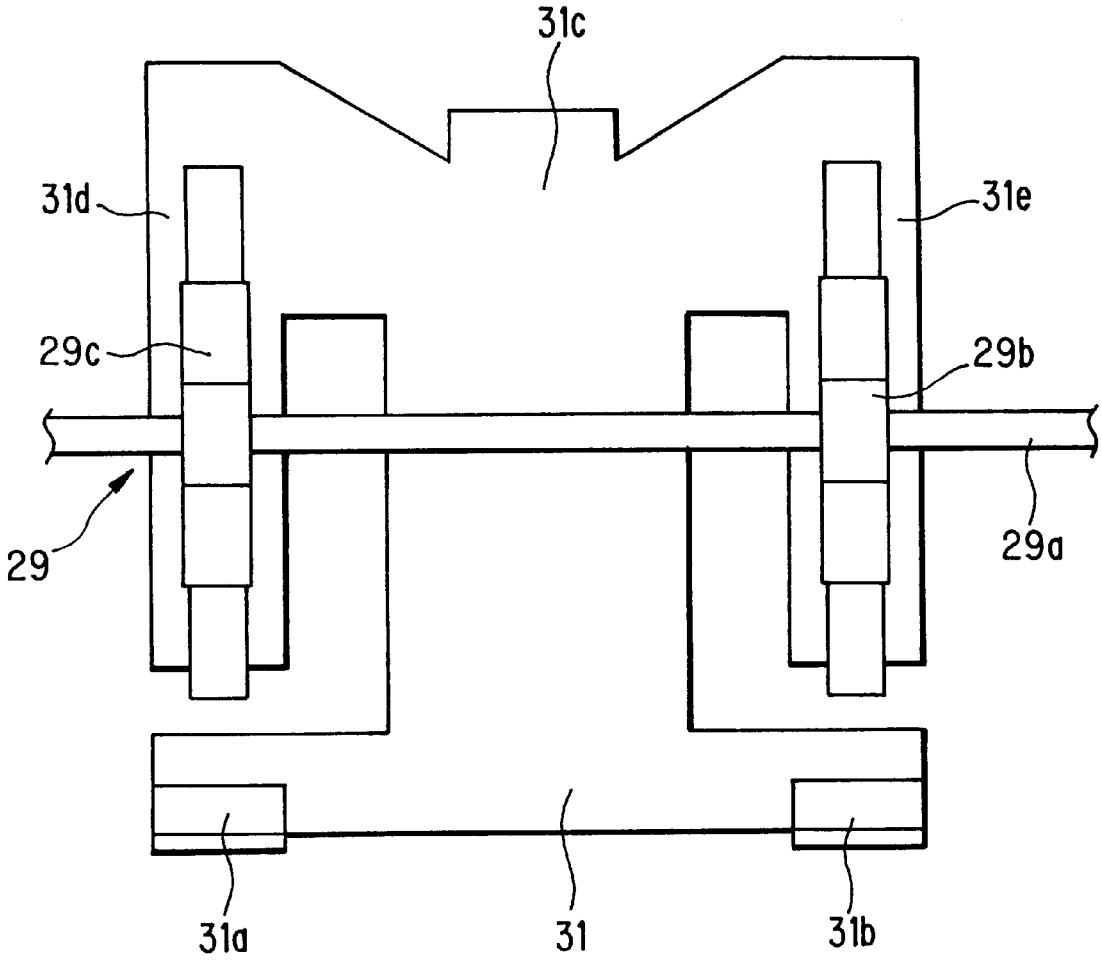
FIG. 13 is a front view showing the sheet supporting portion in the third embodiment of the present invention.

Referring next to FIG. 13, the relationship between paddler mechanism 29 illustrated with FIG. 12 and sheet supporting means 31 will be described in further detail.

As shown in FIG. 13, sheet supporting means 31 comprises: sheet supporting arms 31*a* and 31*b* for supporting the sheet lower end portion and a sheet-underside supporting surface 31*c*. Sheet-underside supporting surface 31*c* of sheet supporting means 31 is raised from the surface of post-processing tray 25.

When a sheet is introduced into post-processing tray 25, paddler mechanism 29 starts rotating to press the sheet toward the post-processing tray 25 face. Actually, in this operation, the paddler mechanism presses the sheet toward the aforementioned sheet-underside supporting surface 31*c* of sheet supporting means 31. The sheet thus pressed and aligned with the post-processing tray 25 face is set and supported by sheet-underside supporting surface 31*c* of sheet supporting means 31, without contact with the face of post-processing tray 25.

In a configuration other than above, when sheet supporting means 31 receives and aligns a sheet and moves up and down for introducing the sheets into the post-processing station, the stack of sheets, in particular, the lowermost sheet in contact with the post-processing tray 25 face would be displaced from the aligned position, due to friction with the post-processing tray 25 surface. However, the above configuration is able to prevent such disalignment of the sheets from occurring.

Further, concerning the up-and-down movement of sheet supporting means 31 holding a sheet stack therein, if paddler mechanism 29 is configured to be rotated in time with the downward movement of sheet supporting means 31 so that paddler mechanism 29 grips the stack of sheets in cooperation with sheet supporting surfaces 31*d* and 31*e* formed on both sides in sheet-underside supporting surface 31*c* of sheet supporting means 31, the downward movement of the stack of sheets can be further stabilized.

Figure 14:
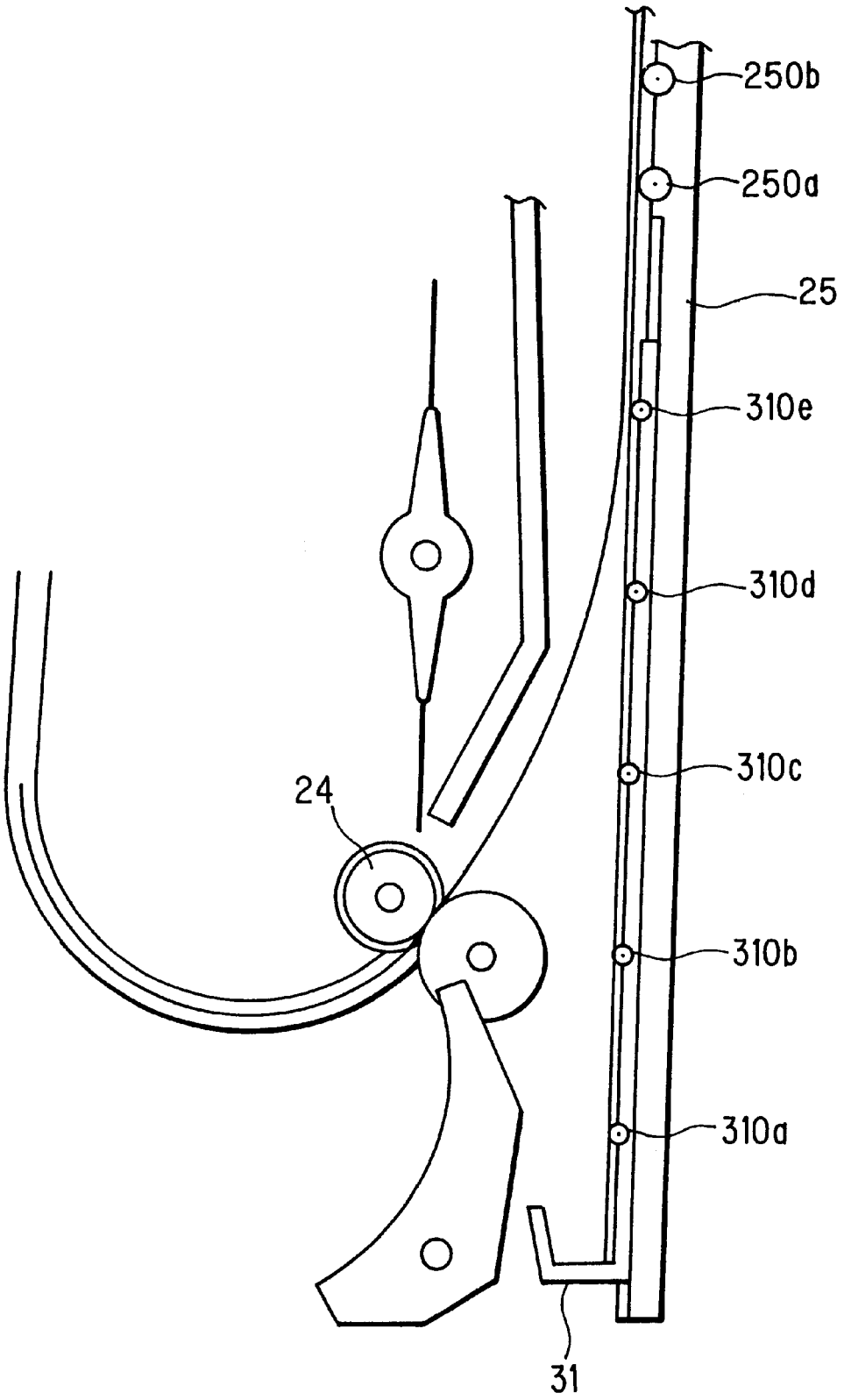
FIG. 14 is a sectional view for illustrating the positional relationship between a sheet supporting portion and rollers in the third embodiment of the present invention.

As another example, as shown in FIG. 14, in order to reduce the friction with the sheet, rollers are arranged in appropriate positions (for example, 310*a* to 310*e* on the sheet-underside supporting surface, 250*a* and 250*b* on the face of post-processing tray 25) on sheet supporting means 31 and the post-processing tray 25 face so as to smoothly receive and align the entering sheet. Further, this configuration permits the aligned sheet stack to smoothly move keeping its aligned state when it is conveyed into the stapling station.

Figure 15:
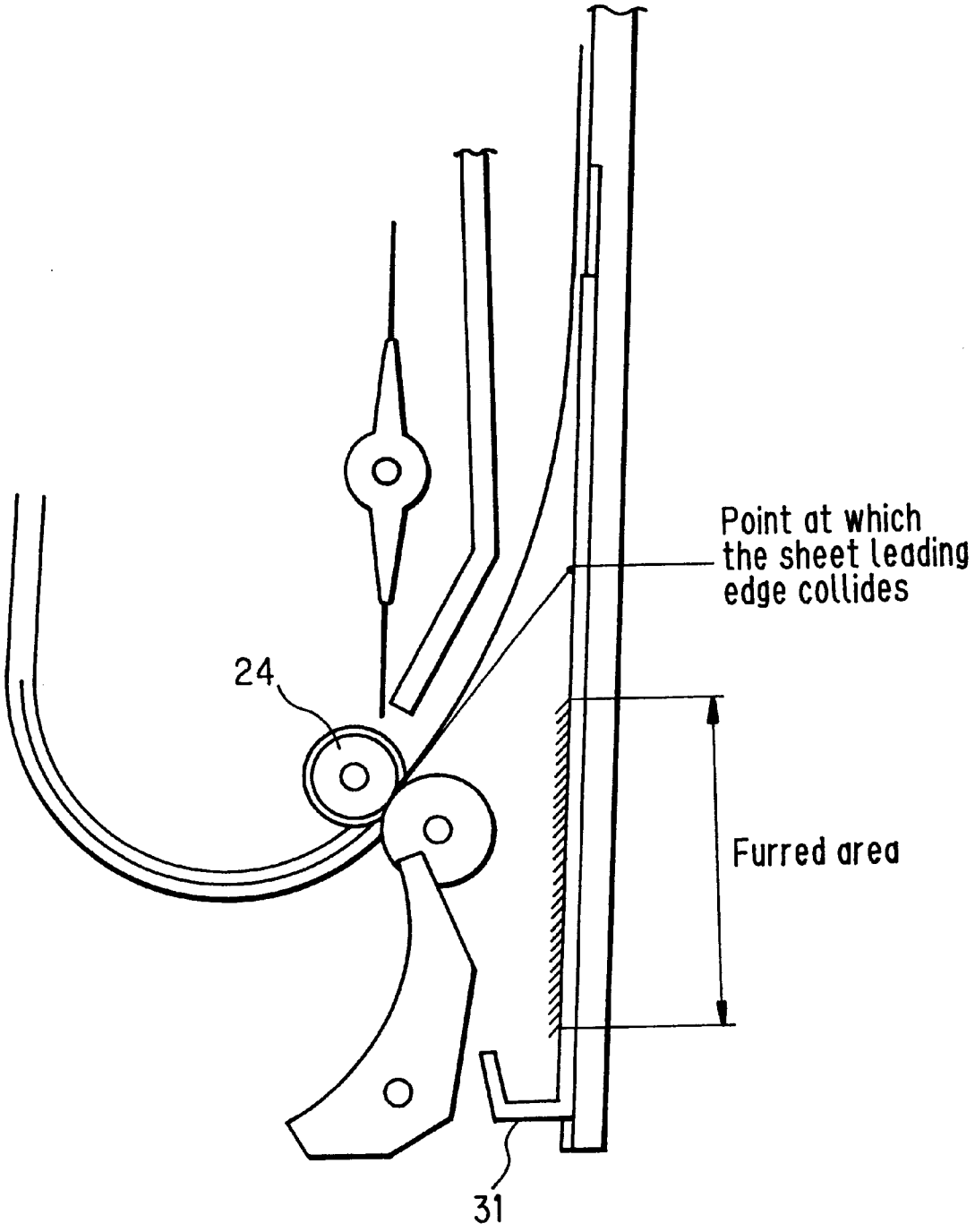
FIG. 15 is a sectional view showing the positional relationship between the sheet supporting portion and the furred area in the third embodiment of the present invention.

As still another example, as shown in FIG. 15, a furred portion in which fibers are implanted slantwise in a uniform direction (aligning direction) may be provided on sheet supporting means 31 and the post-processing tray 25 face, so as to smoothly receive and align the entering sheet. Further, this configuration permits the aligned sheet stack to smoothly move keeping its aligned state when it is conveyed into the stapling station. Here, the fibers inclined in a uniform direction act on the sheet surface in a manner that allows the sheet to easily move in the aligning direction while inhibiting the sheet from moving in the opposite direction.

In order to lead the sheet smoothly into post-processing tray 25 without causing any collision between the leading edge of the sheet and the furred portion, the furred portion needs to be attached on the sheet supporting means 31 and the surface of post-processing tray 25, carefully so as to achieve reliable entrance of the sheet into post-processing tray 25. In the example of FIG. 15, the furred portion is formed in a lower area a certain distance away from the position which the leading edge of the sheet will collide with.

(The fourth embodiment of the present invention)

For the explanation of this embodiment, the sequence of operations, that is, entrance of a sheet being conveyed, its alignment and post-processing will be described hereinbelow.

(Sheet entrance and alignment)

Figure 16C:
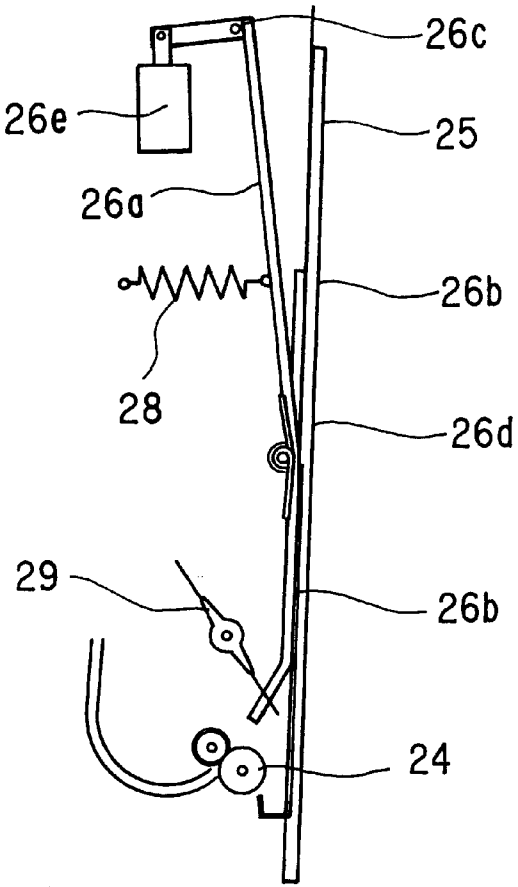
FIGS. 16A to 16C are overall perspective views showing a sheet lower part pressing and aligning device in a post-processing tray in accordance with the fourth embodiment of the present invention.
Figure 16B:
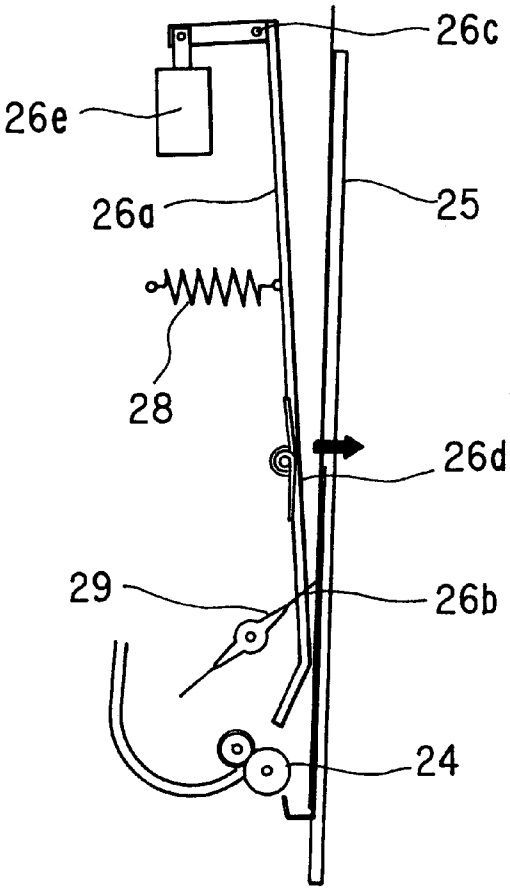
Figure 16A:
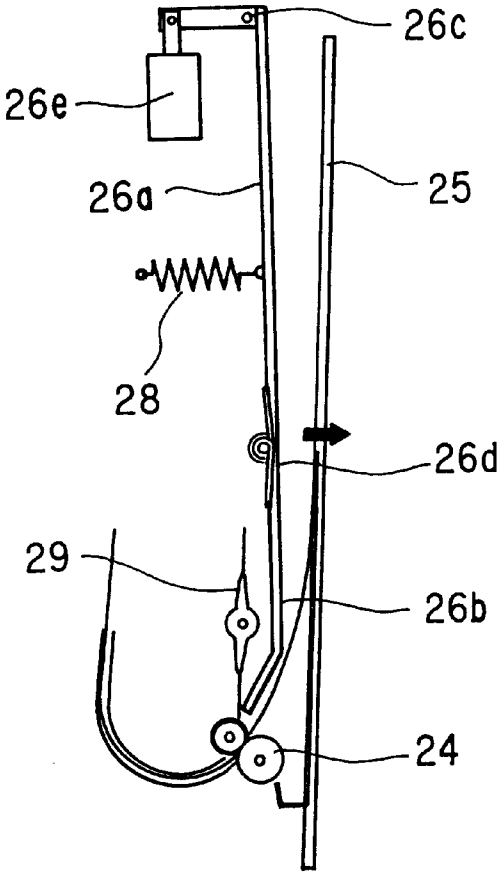

FIGS. 16A to 16C is a variation of a sheet guide 26 which guides the sheet discharged from the lower part to the upper part of post-processing tray 25, acting on the surface of the sheet in cooperation with paddler mechanism 29. This sheet guide 26 comprises a rotational piece 26*a* which pivots about an axle 26*c* located above post-processing tray 25; and a sheet pressing piece 26*b* which is suspended at the lower end of rotational piece 26*a* so as to be deflectable. This sheet guide 26 is rotated in the direction of the arrow by means of a solenoid 26*e*.

Here, sheet pressing piece 26*b* deflectably suspended at the lower end of rotational piece 26*a,* is kept in the predetermined position by the urging force of a spring 26*d* while kept away from post-processing tray 25 by spring 28 as shown in FIG. 16A so as to guide the sheet which is fed into post-processing tray 25 from its bottom to top.

Next, when the sheet is discharged into post-processing tray 25, solenoid 26*e* acts on rotational piece 26*a* of sheet guide 26 so as to rotate sheet guide 26 as a whole as shown in FIG. 16B whereby sheet pressing piece 26*b* of sheet guide 26 presses the lower part of the sheet.

A further continuous action of solenoid 26*e* on rotational piece 26*a* of sheet guide 26, causes sheet pressing piece 26*b* to deflect about the lower end of rotational piece 26*a* of sheet guide 26 as shown in FIG. 16C, so that sheet pressing piece 26*b* of sheet guide 26 gradually presses the sheet from the lower part to the upper part. This completes the explanation of the sheet entering post-processing tray 25 from the guidance of the sheet to its alignment.

(Sheet alignment and post-processing)

Figure 17A:
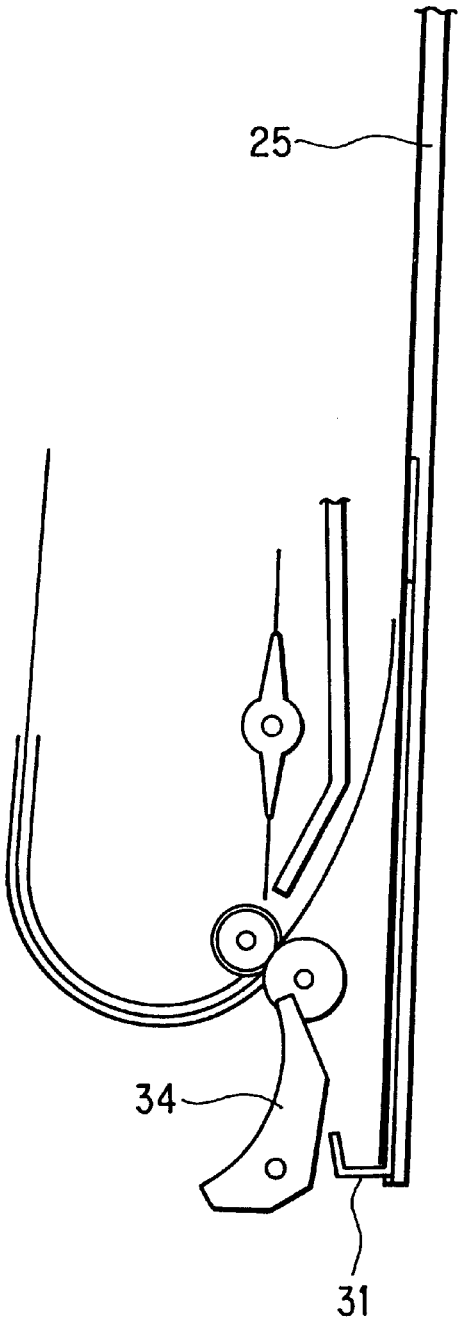
FIGS. 17A and 17B are sectional views of a sheet supporting portion in accordance with the fourth embodiment of the present invention, illustrating the change of the position for sheet reception, FIG. 17A showing the case where a large-sized sheet is used and FIG. 17B showing the case where a small-sized sheet is used.
Figure 17B:
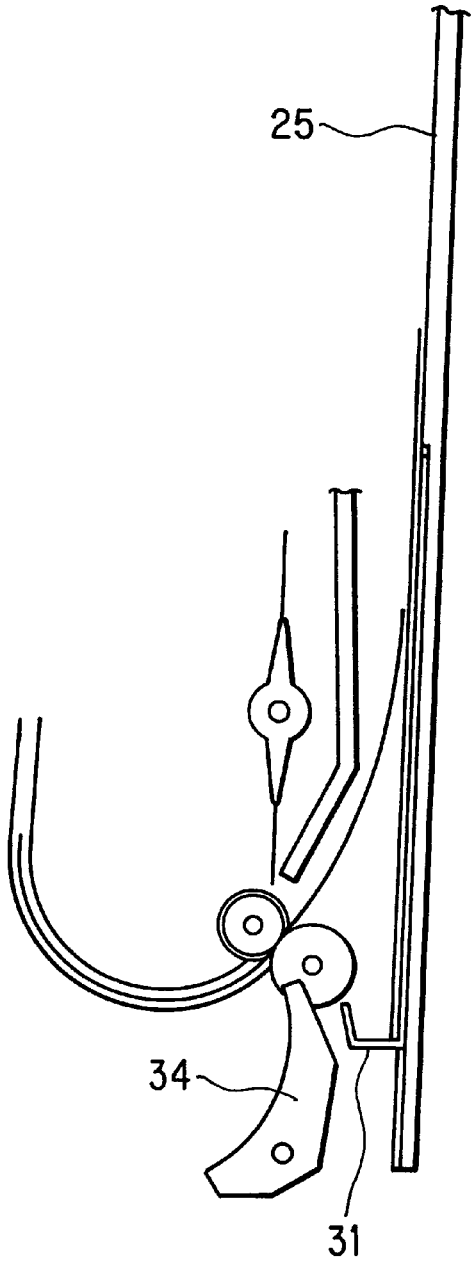

Referring next to FIGS. 17A to 17B, the mechanism for aligning the lower edge of the sheet being introduced into post-processing tray 25 will be described.

Here, since the manner of the sheet being discharged to post-processing tray 25 as well as the manner of alignment of the sheet at its lower part were already described in the description of the second embodiment with FIGS. 9A to 10C, a further description is omitted.

The feature of this embodiment is in that the standby position of pusher mechanism 31 for receiving the sheet introduced into upright, post-processing tray 25, is switched in accordance with the conditions of the sheet to be used. Now, the conditions relating to the switching of the position of pusher mechanism 31 for sheet reception will be described.

(Method 1 for switching in accordance with the sheet size)

In this embodiment, the standby position of pusher mechanism 31 for sheet reception is changed in accordance with the size of the sheet introduced into upright, post-processing tray 25. Actually, the greater the sheet size, the greater friction the sheet receives from the surface of the adjacent sheet. Therefore, it becomes difficult to align the sheet as a sheet stack. With a smaller sheet, the sheet receives so little influence from the friction with the adjacent sheet surface that alignment as a sheet stack becomes simple and easy.

This will be explained with reference to FIGS. 17A and 17B. That is, when, for example, a long-sized sheet is received (FIG. 17A), pusher mechanism 31 is positioned at a relatively low position while when a short-sized sheet is received (FIG. 17B), pusher mechanism 31 is positioned at a relatively high position. By this setting, the distance for the lower edge of a sheet discharged from discharge roller 24 to be dropped to abutment on the pusher mechanism 31, and the distance of the vertical movement of pusher mechanism 31 supporting the sheet are changed in accordance with the size of the sheet. As a result, it is possible to ensure proper alignment of the received sheet as a sheet stack.

(Method 2 for switching in accordance with the sheet size)

In this method, when pusher mechanism 31 receives the sheet discharged into post-processing tray 25, the position of the sheet, or the position of pusher mechanism 31 for sheet reception is changed such that the sheet edges on both sides (longitudinal edges of the sheet) are positioned in the predetermined relationship with sheet-side aligning means 32 for aligning the sheet with respect to the direction of its width.

Figure 18A:
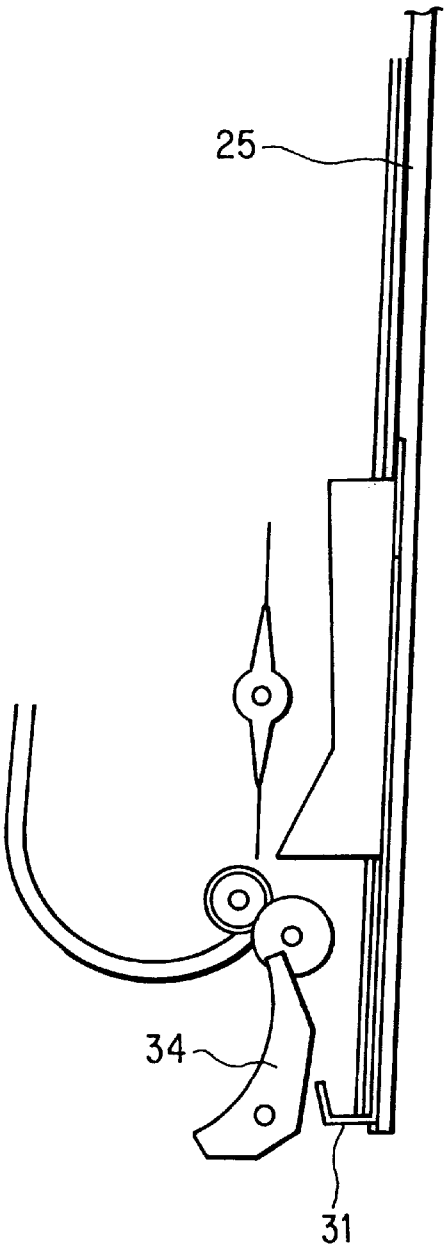
FIGS. 18A and 18B are sectional views of a sheet supporting portion in accordance with the fourth embodiment of the present invention, illustrating the change of the position for sheet reception, FIG. 18A showing the case where a large-sized sheet is used and FIG. 18B showing the case where a small-sized sheet is used.
Figure 18B:
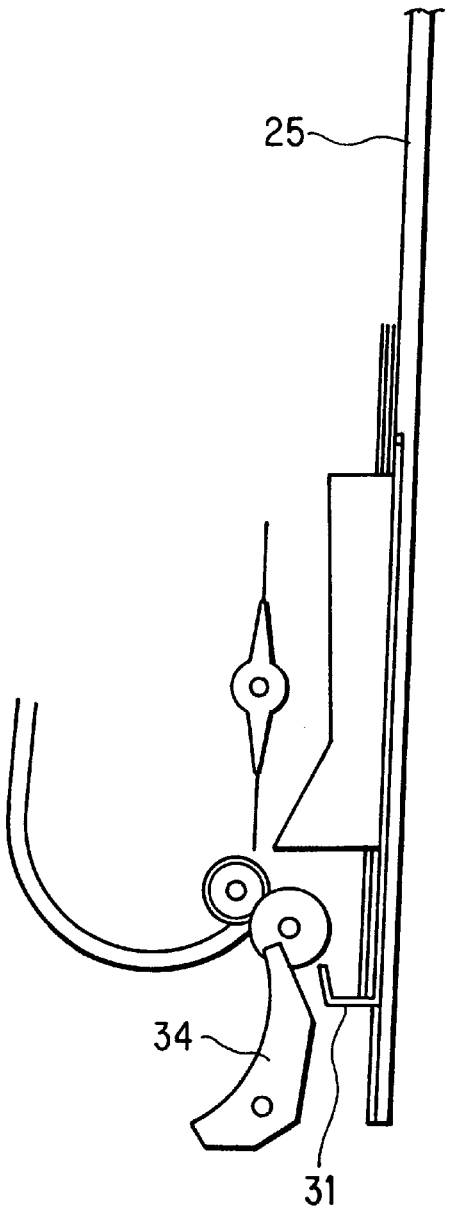

FIGS. 18A and 18B illustrate the states of this configuration. For example, when a long-sized sheet such as A3, B4 paper is received (FIG. 18A), pusher mechanism 31 is positioned at a relatively low position whereas a short-sized sheet such as A4, B5 paper is received (FIG. 18B), pusher mechanism 31 is positioned at a relatively high position so that aligning means 32 for aligning the edges on both sides of the sheet can be positioned acting on the sheet at the predetermined position of the sheet (i.e., the mid height of the sheet).

As a result, regardless of the sheet size, it is possible to align a sheet with respect to the direction of its width from both sides, at the mid height thereof. Hence aligning means 32 for sheet edges on both sides can effectively act on both sides of the sheet stack to thereby achieve improved sheet alignment.

(A method of switching in accordance with the amount of sheet curling)

In this embodiment, the position of pusher mechanism 31 for sheet reception is changed in accordance with the amount of curling of a sheet introduced into upright, post-processing tray 25.

It is known that when an imaged sheet is heated at the fixing portion, moisture contained in the sheet evaporates producing a curl in the sheet. This phenomenon is one which fluctuates depending upon the conditions of the fixing unit, the conditions of the sheet and the like, so that it is difficult to definitely determine the amount of curling.

For example, in a fixing unit having a pair of heat fixing rollers, the amount of curling of the sheet varies depending upon the difference in temperature between upper and lower rollers. In particular, the temperature difference between upper and lower rollers changes between the time immediately after power activation and after a predetermined period of time or longer has elapsed from power activation, producing difference in fixing conditions. Actually, in the state where fixing is ready immediately after power activation, the upper roller (heat roller) has a temperature of 210° C. and the lower roller (pressing roller) has a temperature of 90° C., for example. Due to this large temperature difference between the two rollers, the sheet has a difference in temperature between the upper and lower sides of the sheet, thus producing a large amount of curling.

Compared to this, in the state where the predetermined period of time or longer has elapsed after power activation, the upper roller (heat roller) has a temperature of 200° C. and the lower roller (pressing roller) has a temperature of 170° C., for example, producing a small temperature difference between the two rollers (the lower roller has taken hear from the upper roller). Due to this small temperature difference, the temperature difference between the upper and lower sides of the sheet is so small that the amount of curling in the sheet also becomes small.

Other factors producing difference in the amount of curling in a sheet are: the manufacturing method of sheet (paper making and orientation of fibers), the moisture content in the sheet (the moisture content at the time of manufacture is about 6%, but varies depending upon the storage environment and the installation environment of the apparatus). Thus, the state of the sheet is always changing, so that the amount of curling will be different when fixing the sheet through the aforementioned fixing unit.

Figure 19A:
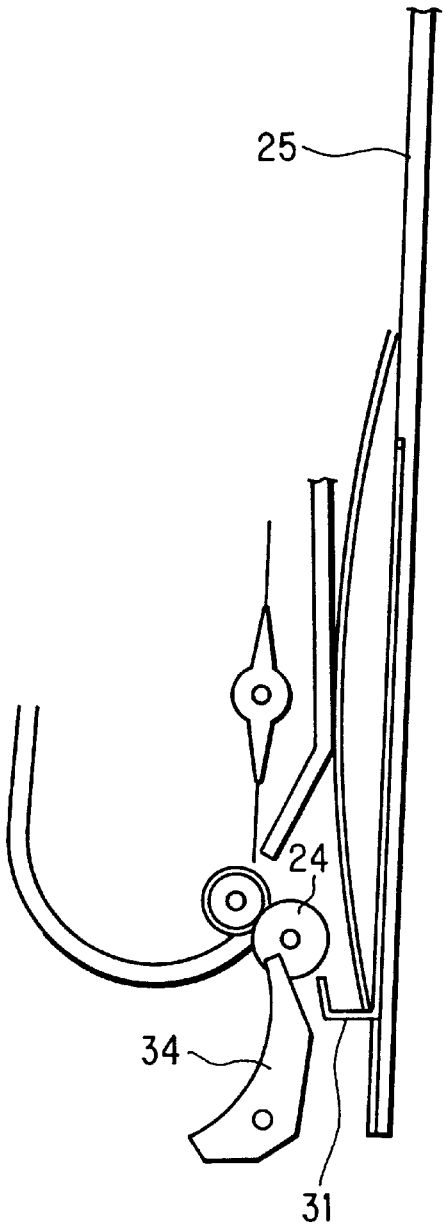
FIGS. 19A and 19B are sectional views of a sheet supporting portion in accordance with the fourth embodiment of the present invention, illustrating the change of the position for sheet reception, FIG. 19A showing the case of a sheet with a large curl and FIG. 19B showing the case of a small curl.
Figure 19B:
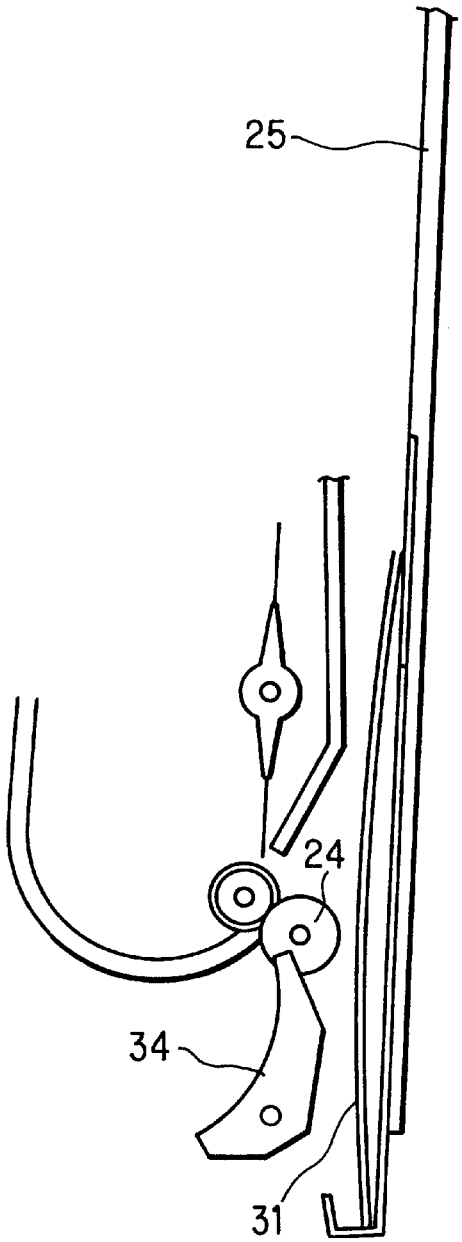

To deal with this, the feature of the embodiment is in that the status of the fixing unit is monitored by a temperature sensor etc., and the standby position of pusher mechanism 31 for sheet reception is switched based on the status of the fixing unit. FIGS. 19A and 19B illustrate the states of this configuration. When the amount of curling is not so large (FIG. 19B), the standby position is set at the normal position whereas, when a sheet has a large amount of curling (FIG. 19A), the pusher mechanism is set so that the sheet is received and aligned closer to third discharge roller 24.

This setting is based on the following reason. That is, when the amount of curling in a sheet is very large, there is a risk that the sheet could be snagged by guiding elements in its vicinity and hence will not drop to the predetermined position (the sheet abutment of pusher mechanism 31) before the sheet discharged from discharge roller 24 drops to the position of pusher mechanism 31. For this reason, the sheet is adapted to be received immediately after being delivered by discharge roller 24 and be aligned to the predetermined position (the sheet abutment of pusher mechanism 31) by means of the sheet aligning mechanism such as paddler mechanism 29 and the like. Thereby, it is possible to align the sheets discharged to post-processing tray 25, as a sheet stack without it being dependent upon the amount of curl arising in sheets.

(A method of switching in accordance with the orientation of sheet curling)

As stated above, a curl in a sheet will arise when the sheet has passed through the fixing unit. This sheet is conveyed by either of the two modes: that is, the mode(to be referred to as S-mode) in which the sheet is conveyed and discharged to post-processing apparatus 1; and the other mode (to be referred to as D-mode) in which the sheet with an image fixed thereon is inverted and conveyed again toward the image recording portion where an image is formed on the opposite side of the imaged side, and then is conveyed and discharged to post-processing apparatus 1.

Figure 20A:
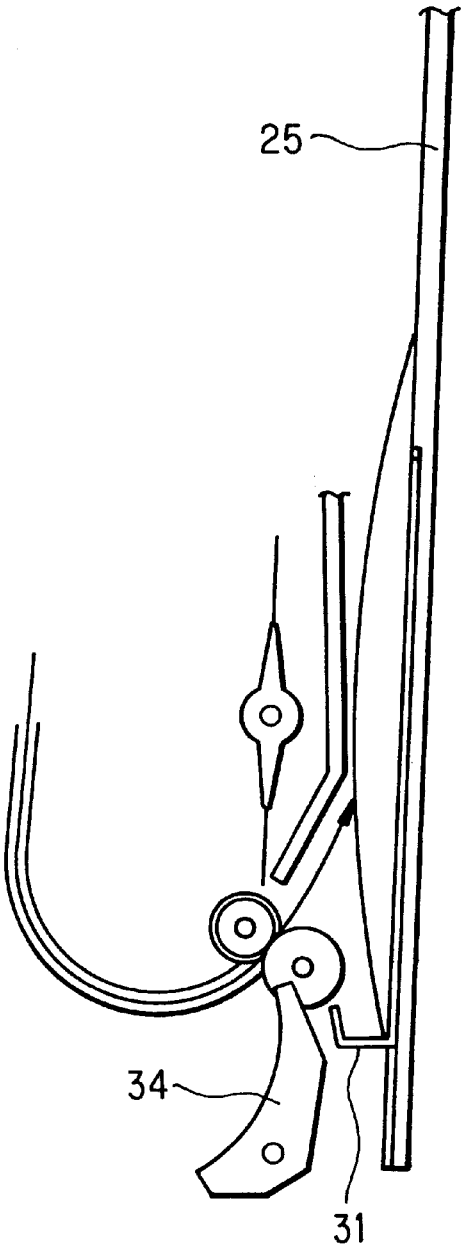
FIGS. 20A and 20B are sectional views of a sheet supporting portion in accordance with the fourth embodiment of the present invention, illustrating the change of the position for sheet reception in accordance with the direction of sheet curling, FIGS. 20A showing the case of S-mode and FIG. 20B showing the case of D-mode.
Figure 20B:
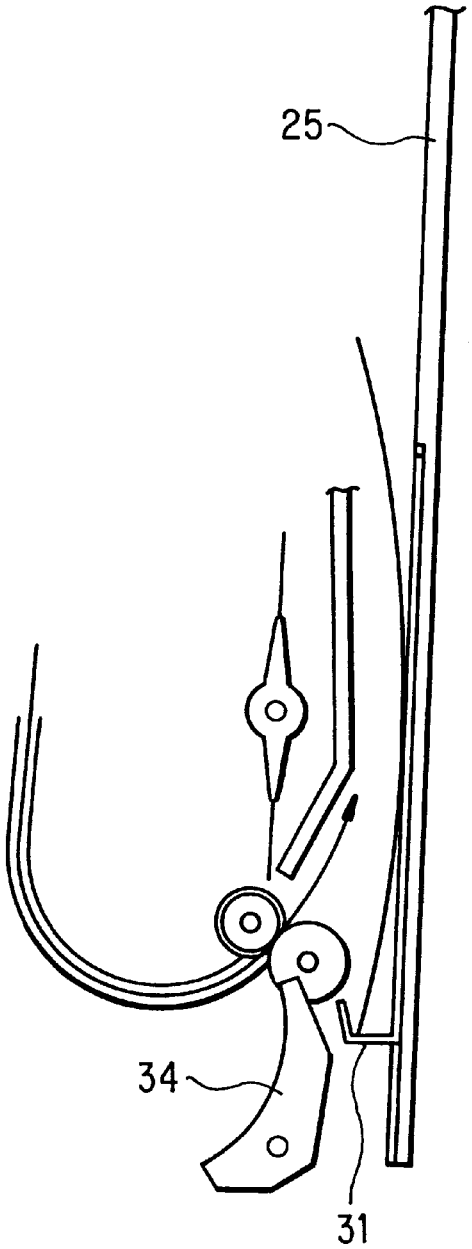

Therefore, the states of the sheets discharged to post-processing tray 25, i.e., the orientations of curling in the tray, will differ from each other, as shown in FIGS. 20A and 20B, depending upon the output mode. Here, the orientation of the curling of the sheets becomes opposite from one another depending upon the conveyance path from the fixing unit to post-processing tray 25.

In the case where a following sheet is input into post-processing tray 25 holding a sheet having a curl shown in either FIG. 20A or 20B, in particular, when the preceding sheet is projected toward the side to which the following sheet is introduced, the leading edge of the following sheet collides with the portion below the projected portion of the sheet previously held in post-processing tray 25, resultantly pushing the previously held sheet upwards (FIG. 20A).

Figure 21A:
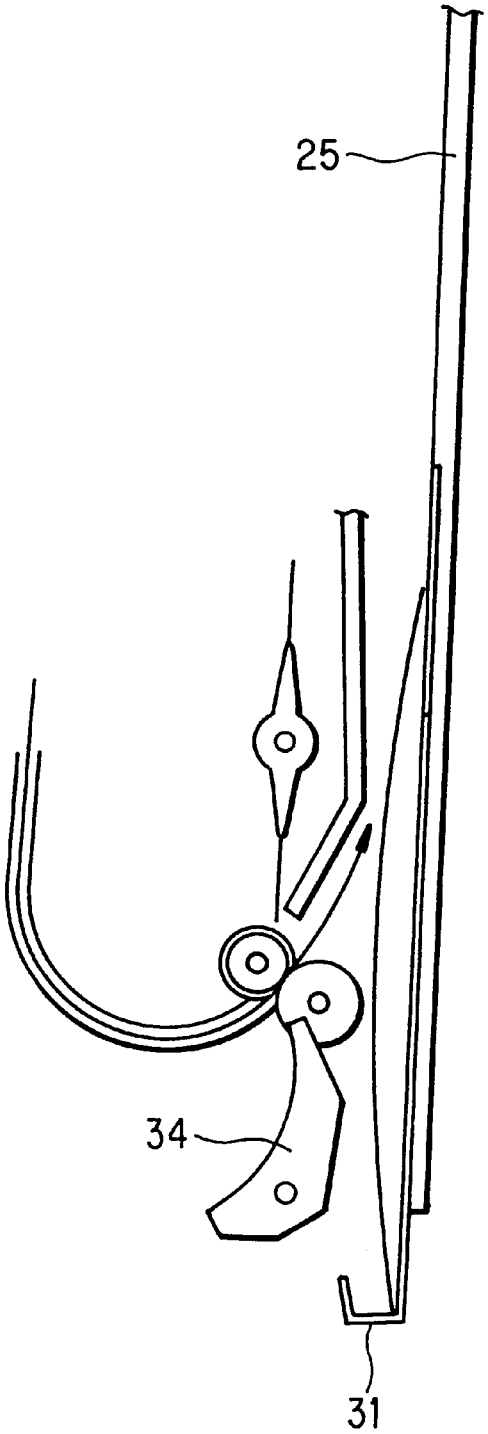
FIGS. 21A and 21B are sectional views of a sheet supporting portion in accordance with the fourth embodiment of the present invention, illustrating the change of the position for sheet reception in accordance with the direction of sheet curling, FIG. 21A showing the case where the sheets has a curl projected to the side to which the following sheet is introduced and FIG. 21B showing the case where the sheets has a curl projected to the side opposite to that shown in FIG. 21A.
Figure 21B:
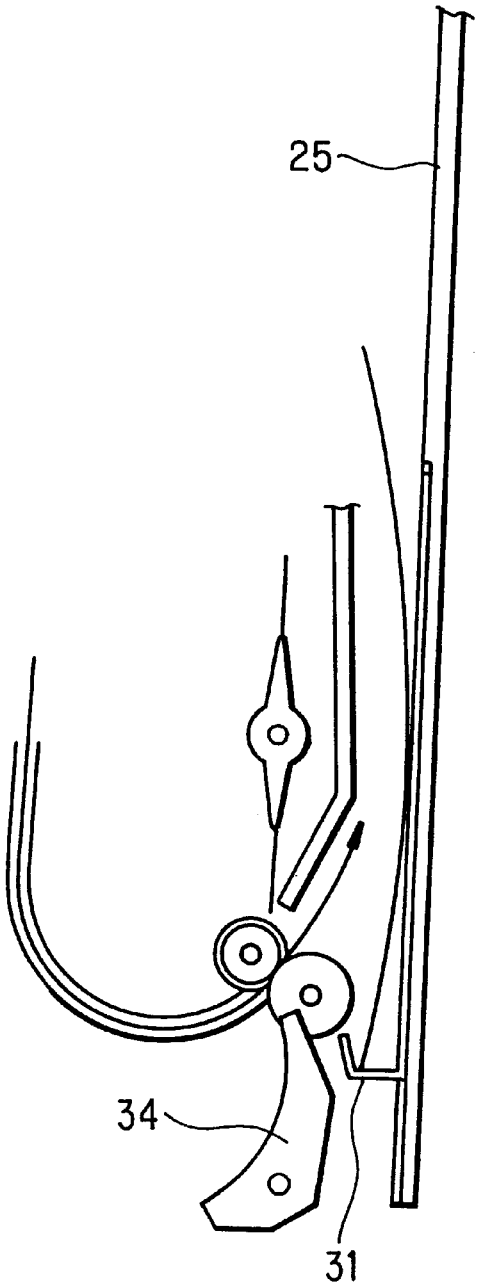

FIGS. 21A and 21B illustrate two states of this method. When a sheet has a curl projected to the side to which the following sheet is introduced (FIG. 21A), pusher mechanism 31 is set at a relatively low position to successively receive the following sheets. When a sheet has a curl projected away from the side to which the following sheet is introduced (FIG. 21B), pusher mechanism 31 is set at a relatively high position to successively receive the following sheets. Thus, this configuration makes it possible to receive subsequent sheets regardless of the direction of curling arising in the sheets and align the sheets including the following sheet, without disrupting the alignment.

In the case where a sheet has a curl projected to the side to which the following sheet is introduced and hence pusher mechanism 31 is set at a low position to successively receive the following sheets, there occurs a problem in that the sheet cannot be collected smoothly. More illustratively, the curled sheet interferes (collides) with surrounding components in its path, from the position where the sheet leaves discharge roller 24 toward post-processing tray 25 to the position where the sheet is supported by pusher mechanism 31 (in other words, during the period in which the discharged sheet is falling until the pusher mechanism 31 receives it).

To deal with such a situation where the sheet is projected to the side to which the following sheet is introduced, it is not enough good to simply set pusher mechanism 31 at a low position. That is, the post-processing tray is set at a low enough position so that it can collect the sheet discharged from the discharge roller thereinto, without the surrounding components having any influence.

Figure 22:
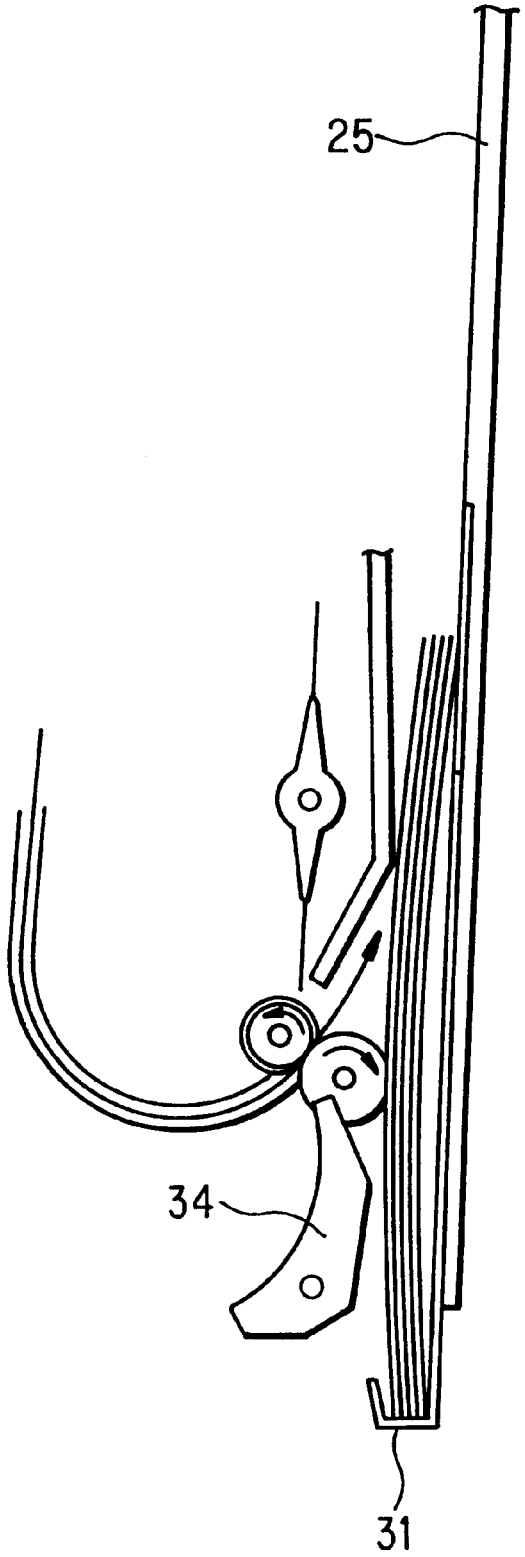
FIG. 22 is a sectional view of a sheet supporting portion in accordance with the fourth embodiment of the present invention, illustrating switching the position for sheet reception when the sheets have a curl which bulges to the side to which the following sheet is introduced.

Further, as shown in FIG. 22, when the sheet is projected to the side to which the sheet is introduced, the post-processing tray may be set into a position where the discharge roller for discharging sheets into the post-processing tray abuts part of the sheets collected in the post-processing tray. This configuration makes it possible to improve the alignment of the sheets making use of the existing mechanism without providing an extra mechanism for improved sheet alignment.

(A method of switching in accordance with the collected amount of sheets)

In this embodiment, the position of pusher mechanism 31 for sheet reception is changed in accordance with the amount of sheets collected in upright, post-processing tray 25.

In this configuration, in accordance with the amount of sheets introduced into upright, post-processing tray 25 and supported by pusher mechanism 31, the standby position of pusher mechanism 31 is set beforehand. As a greater amount of sheets are held by pusher mechanism 31, the sheets are packed more densely. So, there is less space for receiving the following sheet, making it more difficult to align the sheets.

Figure 23A:
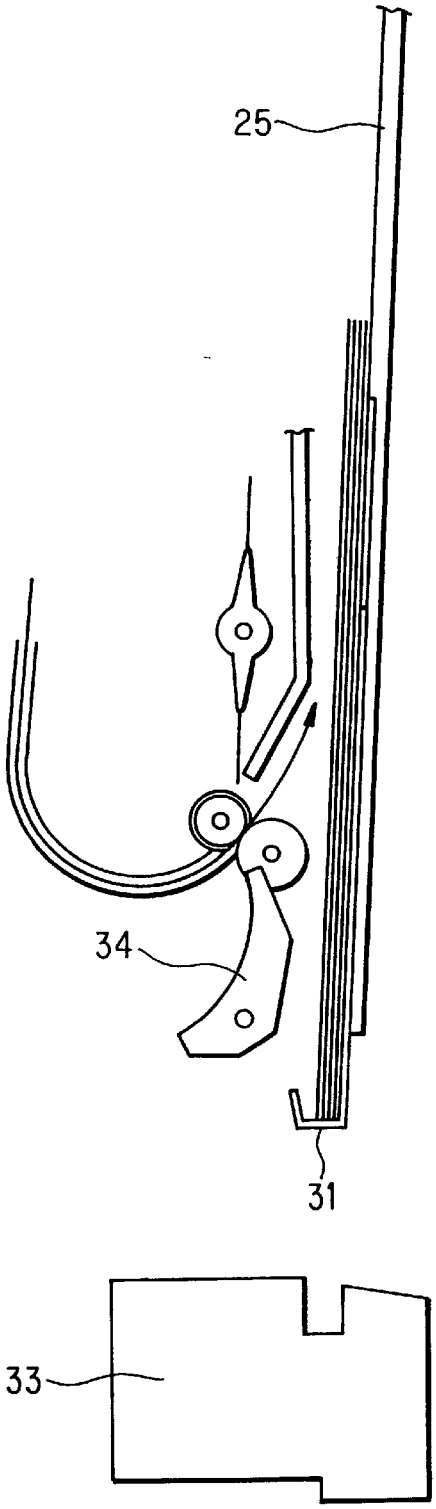
FIGS. 23A and 23B are sectional views of a sheet supporting portion in accordance with the fourth embodiment of the present invention, illustrating switching the position for sheet reception, FIG. 23A showing a case of a small amount of sheets and FIG. 23B showing a case of a large amount of sheets.
Figure 23B:
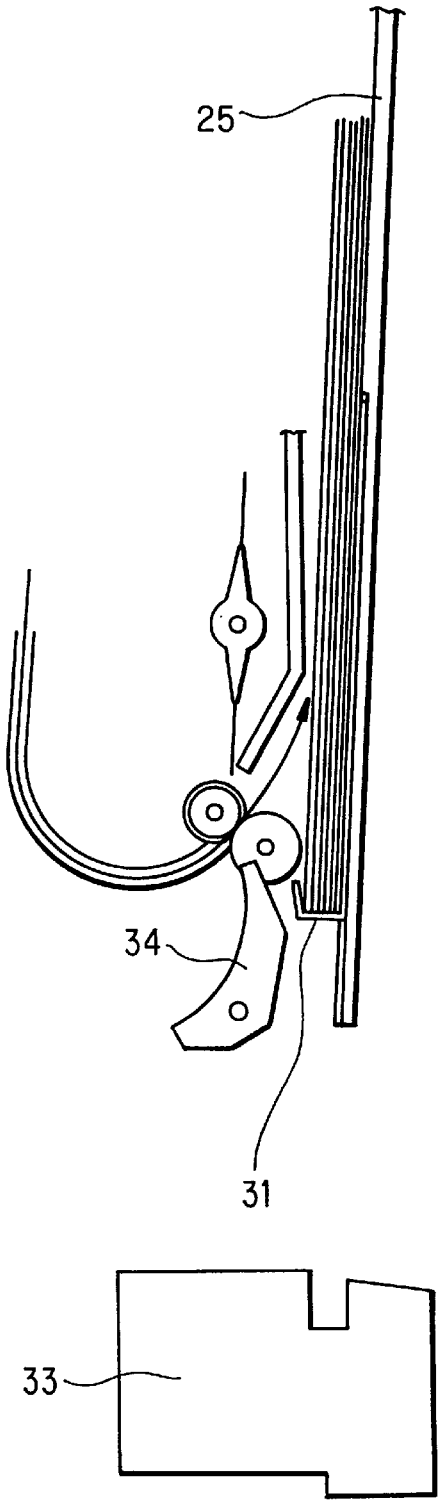
Figure 24A:
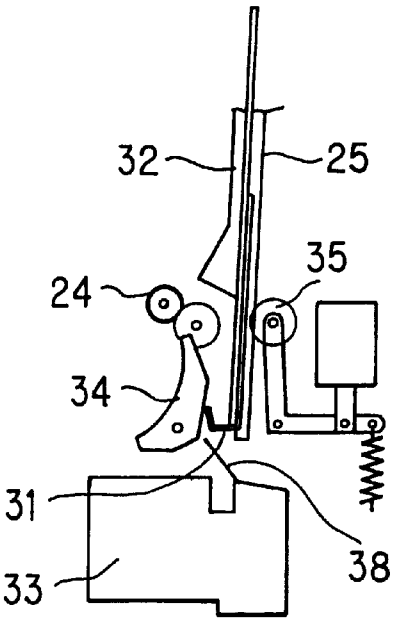
FIGS. 24A to 24D illustrate the procedural steps of stapling in the sheet post-processing apparatus in accordance with the fifth embodiment of the present invention.
Figure 24B:
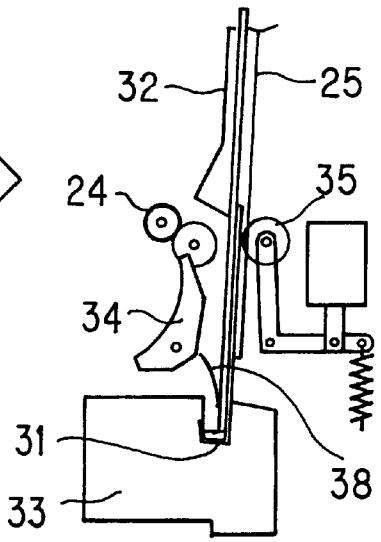
Figure 24C:
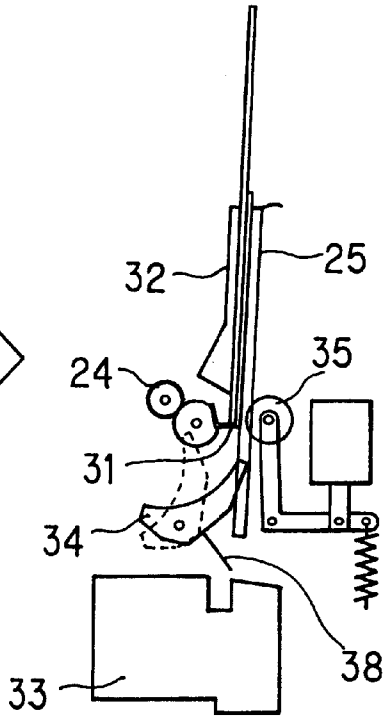
Figure 24D:
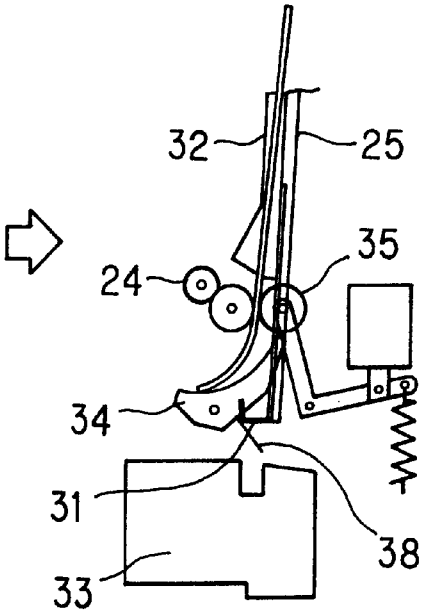

FIGS. 23A and 23B illustrate the states of this method. In this configuration, based on the advance knowledge of the amount of sheets to be discharged to post-processing tray 25 (obtained by monitoring number information from the apparatus side, for example), if a greater number of sheets than the predetermined number is going to be discharged, the pusher mechanism is set at a higher position than normal (FIG. 23B) so as to successively receive and align all sheets reliably and secure a greater downward movement of pusher mechanism 31. Thus, this configuration can produce a greater impact when pusher mechanism 31 moves (or comes down) than normal, thus aligning the whole of the sheets in a reliable manner.

There is another method in which the position of pusher mechanism 31 for sheet reception is moved stepwise in accordance with the amount of sheets held in upright, post-processing tray 25.

In this method, in accordance with the increase of the sheets introduced into upright post-processing tray 31 and supported by pusher mechanism 31, the standby position of pusher mechanism 31 is changed. As a greater amount of sheets are held by pusher mechanism 31 and the sheets are packed more densely, the space for receiving a subsequent sheet gradually becomes smaller, making it more difficult to align the sheets.

To deal with this, in accordance with the increase in the amount of sheets discharged and set aligned in post-processing tray 25, the pusher mechanism is set at a higher position than normal so as to successively receive and align all sheets reliably and secure a greater downward movement of pusher mechanism 31. Thereby, this configuration can produce a greater impact when pusher mechanism 31 moves (or comes down) than normal, thus ensuring proper alignment of all the sheets.

(The fifth embodiment of the present invention)

This embodiment is characterized by provision of a sheet pressing means 38 which acts on the sheet surface and presses the sheet toward the reference surface of post-processing tray 25 when the sheets aligned in post-processing tray 25 are moved relative to post-processing device 33. The manner of sheet pressing means 38 acting on the sheet surface will hereinbelow be described.

The basic sheet handling operation of sheet post-processing apparatus 1 is that as described heretofore. In this configuration, as shown in FIGS. 24A to 24D, an elastic piece 38 is arranged between post-processing tray 25 and post-processing device 33. When the sheets held in post-processing tray 25 comes down as pusher mechanism 31 moves, the distal end (free end) of elastic piece 38 acts on the sheet surface to press the sheets toward the sheet-underside supporting surface of pusher mechanism 31.

Thus, this configuration leads the sheet aligned in post-processing tray 25 toward post-processing device 33 while pressing and holding them without disrupting the alignment, thus making it possible to finish the sheets by stapling or the like as an aligned leaflet of sheets.

Figure 25:
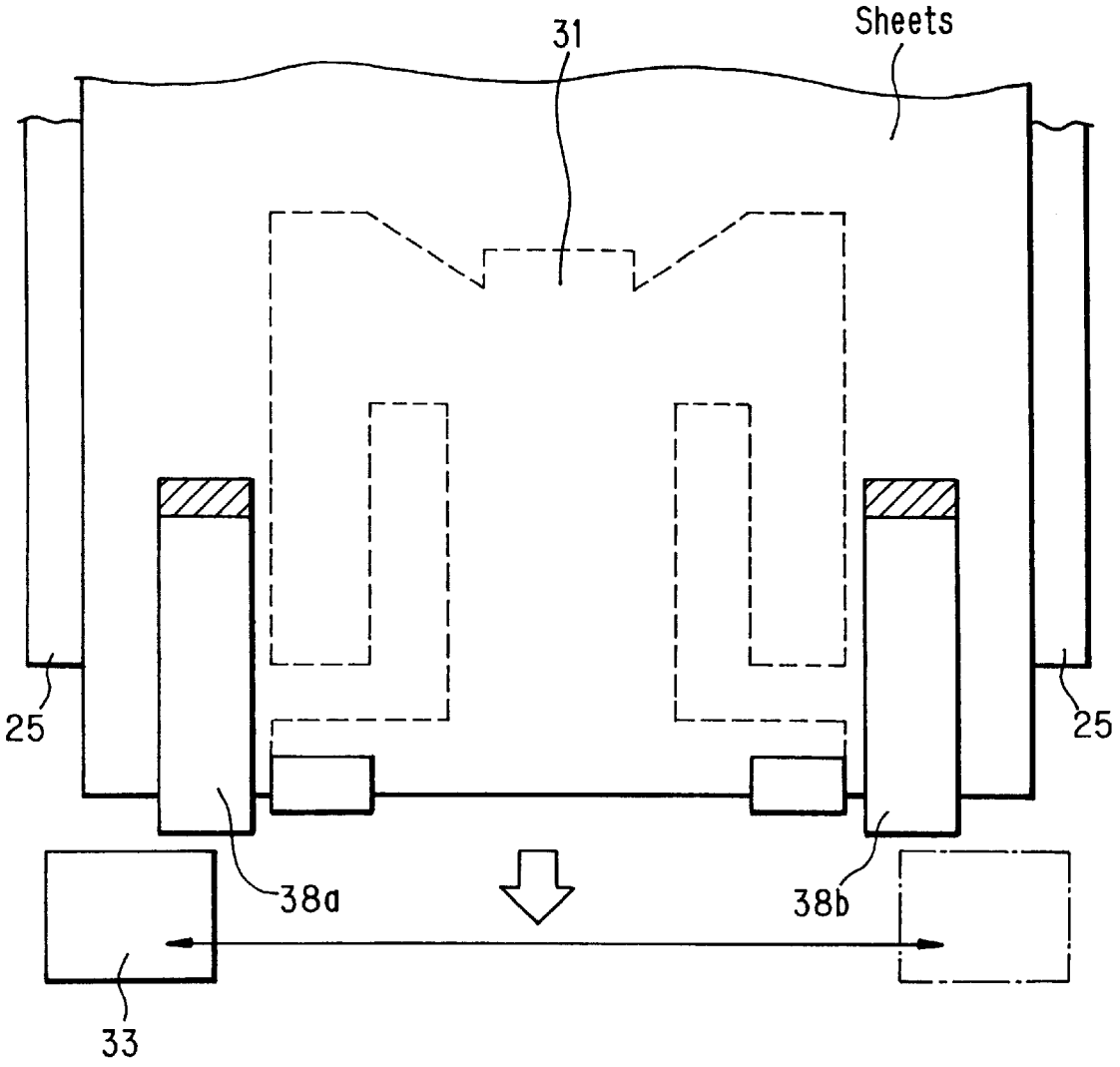
FIG. 25 is a front view showing the positional relationship between the sheet supporting means and sheet pressing means of a sheet post-processing apparatus in accordance with the fifth embodiment of the present invention.

As shown in FIG. 25, a pair of sheet pressing pieces 38 for pressing the sheets are arranged so that they act symmetrically (38*a* and 38*b*) with respect to the sheets and they press and hold the sheets in the vicinity of the areas where the post-processing operation is done for the sheets.

Thus, the sheets aligned in post-processing tray 25 can be pressed stably with a balanced pressure toward the sheet-underside supporting surface of pusher mechanism 31, thus enabling the sheets to be held without disrupting the alignment of the sheets.

In the description of this embodiment, the sheets are conveyed toward post-processing device 33 and sheet pressing means 38 so that the sheets can be pressed toward the sheet abutment surface (the reference surface side) of pusher mechanism 31. However, can also be arranged the configuration such that post-processing device 33 and sheet pressing means 38 are moved toward the sheets and then sheet pressing means 38 acts on the sheet surface to press the sheets toward the sheet abutment surface (the reference surface side) of pusher mechanism 31.

(The sixth embodiment of the present invention)

This embodiment is featured by provision of a sheet guiding means which acts on the lower edge of a sheet to guide the lower edge and align the sheet toward the predetermined alignment surface when the sheet has been discharged to upright, post-processing tray 25 and its lower edge is received. Hereinbelow, the flow of the sheet guiding means acting on the sheet surface will be described.

Figure 26A:
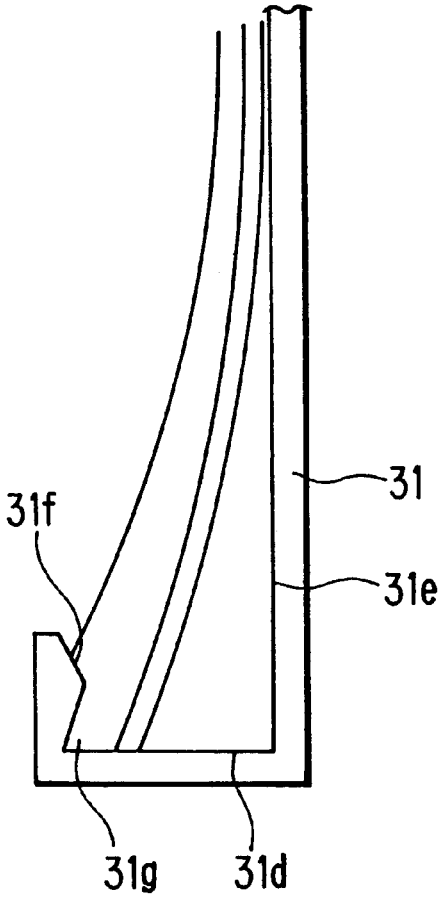
FIGS. 26A and 26B are sectional views showing the flow of sheet alignment before post-processing in a post-processing tray in accordance with the sixth embodiment of the present invention, FIG. 26A showing the state where a sheet is guided by the slope inclined with respect to the sheet aligning surface and FIG. 26B showing the state where sheets are aligned to the sheet abutment surface with the sheets released at the lower end.
Figure 26B:
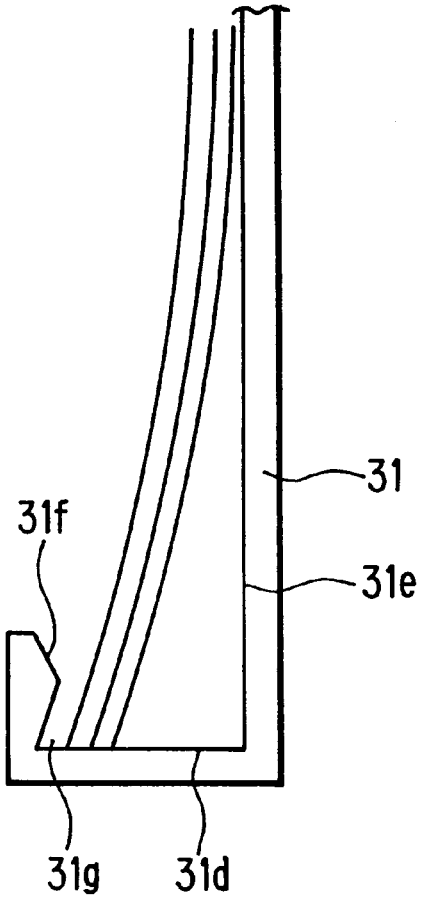

The basic sheet handling operation of sheet post-processing apparatus 1 is that as described heretofore. In this configuration, as shown in FIGS. 26A and 26B, formed near sheet abutment surface 31*d* of pusher mechanism 31 for receiving the sheet discharged to post-processing tray 25 is a sheet guiding slope 31*f* for guiding the lower edge of the sheet toward sheet alignment reference surface 31*e*. Further, a release space 31*g* for releasing the lower edge of a sheet is formed below this sheet guiding slope 31*f*.

FIG. 26A shows a situation in which the lower edge of the sheet discharged into post-processing tray 25 is received by guiding slope 31*f* and guided along the slope to sheet alignment reference surface 31*e*. FIG. 26B shows a situation in which the lower edge of the sheet guided by sheet guiding. slope 31*f* is released so as to reduce the load acting on the lower edge of the sheet to thereby align the lower edge with sheet abutment surface 31*d*.

Thus, this configuration enables the lower edge of the sheet discharged into upright, post-processing tray 25 to be received and aligned with the predetermined alignment surface side. Thereafter, the lower edge of the sheet will be released in release space 31*g*, hence the load acting on the sheet will become so small that the sheet can be aligned with the predetermined alignment surface. Further, this configuration is effective in receiving curled sheets and aligning them with the predetermined alignment surface, as shown in FIGS. 26A and 26B.

Figure 27A:
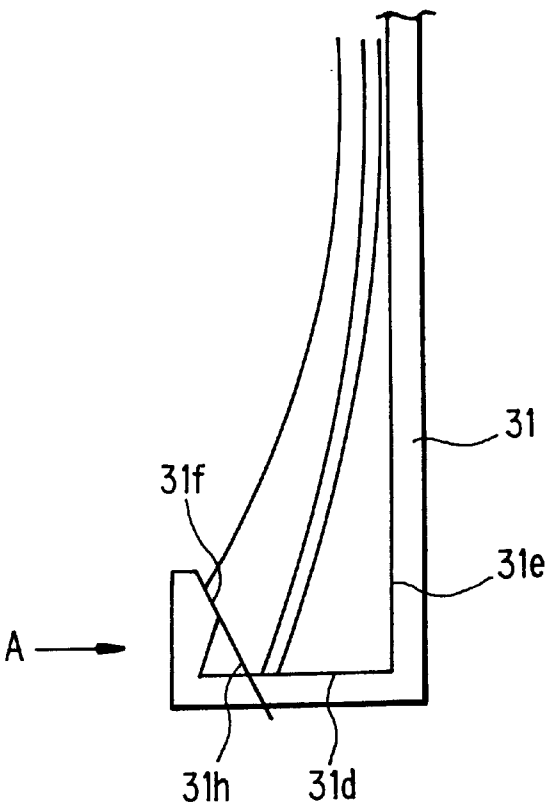
FIGS. 27A to 27C are sectional views showing the flow of sheet alignment before post-processing in a post-processing tray in accordance with the sixth embodiment of the present invention, FIG. 27A showing the state where a sheet is guided by the slope inclined with respect to the sheet aligning surface, FIG. 27B showing the state where sheets are aligned to the sheet abutment surface with the sheets released at the lower end and FIG. 27C being a view from A.
Figure 27B:
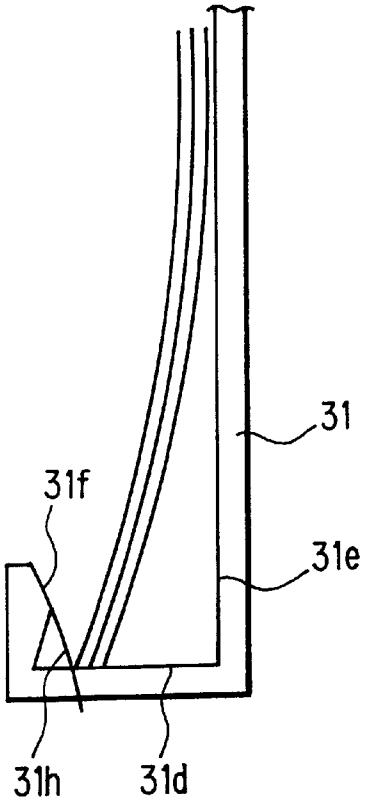
Figure 27C:
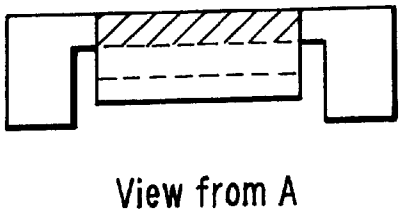

As shown in FIGS. 27A to 27C, it is also possible to obtain the equivalent function and effect by releasing the sheet lower edge in some degree with openings 31*g* below sheet guiding slope 31*f* and providing an elastic pressing means 31*h* which presses the sheet edge portion toward the aligning reference surface.

Illustratively, FIG. 27A shows a situation in which the lower edge of the sheet discharged into post-processing tray 25 is received by sheet guiding slope 31*f* and guided along the slope to sheet alignment reference surface 31*e*. FIG. 26B shows a situation in which the lower edge of the sheet guided by sheet guiding slope 31*f* is released in some degree while being pressed toward aligning reference surface 31*e* (by elastic pressing means 31*h*).

Thus, this configuration makes it possible to guide the lower sheet edge toward the predetermined aligning surface and then release the sheet lower edge and press and align the sheet toward aligning reference surface 31*e* with less load acting on the sheet.

Here, elastic pressing means 31*h* produces a pressing force which is just enough to press the end of the sheet guided along sheet guiding slope 31*f* toward aligning reference surface 31*e* and then can move the sheet along sheet abutment surface 31*d* so as to be aligned, after the edge has been pressed and aligned toward reference surface 31*e*.

Further, since elastic pressing means 31*h* is provided so as to extend below sheet abutment surface 31*d*, the lower end of the sheet will not be caught by the lower edge of the elastic pressing means, so that the sheet will neither be damaged (flexed) nor damage (break) the edge of elastic pressing means 31*h*.

As has been described, in accordance with the configuration of the invention, it is possible to minimize the installation footprint of the sheet post-processing apparatus as well as to ensure the alignment of the sheets discharged to the post-processing tray so as to be able to perform the predetermined post-processing for the stack of sheets thus aligned.

The effects of each configuration will be described herein below. In accordance with the first configuration of the invention, the sheet post-processing apparatus includes: a post-processing tray for stacking the discharged sheets; a post-processing portion for performing post-processing for the stacked sheets; an output tray for receiving the sheets discharged after post-processing; a conveying means for conveying sheets from the lower part of the post-processing tray arranged upright and discharging the sheets after post-processing to the output tray; and a sheet guiding means disposed opposing the post-processing tray which presses particular portions of the sheet when the sheet is introduced into the post-processing tray so as to align the stacked sheets onto the post-processing tray, with the sheets being stacked substantially upright. Therefore, it is possible to receive the sheet discharged from the image forming apparatus without delay and ensure proper alignment as a sheet stack to effect post-processing such as stapling etc. for the sheet stack.

In accordance with the second configuration of the invention, the sheet post-processing apparatus has the above first feature and is characterized in that the sheet guiding means can rotate about an axle located near the upper part of the post-processing tray so that the lower part of the sheet guiding means rotationally moves toward the post-processing tray; and the sheet guiding means guides the sheet upward with respect to the post-processing tray when the sheet is introduced into the post-processing tray and presses the sheet against the post-processing tray face when the sheet is discharged to the post-processing tray. Therefore, it is possible to receive the sheet discharged from the image forming apparatus without delay and ensure proper alignment of multiple sheets as a sheet stack to effect post-processing such as stapling etc. for the sheet stack.

In accordance with the third configuration of the invention, the sheet post-processing apparatus has the above first feature and is characterized in that the sheet guiding means guides the sheet upward with respect to the post-processing tray when the sheet is introduced into the post-processing tray and presses the sheet against the post-processing tray face gradually from the lower part to the upper part when the sheet is discharged to the post-processing tray. Therefore, it is possible to receive the sheet discharged from the image forming apparatus without delay and ensure proper alignment of multiple sheets as a sheet stack to effect post-processing such as stapling etc. for the sheet stack.

In accordance with the fourth and fifth configurations of the invention, the sheet post-processing apparatus has the above second or third feature and further comprises a paddler mechanism which operates in cooperation with the sheet guiding means when the sheet is pressed against the post-processing tray face. Therefore, the sheets are pressed against the post-processing tray face while the edge of the sheet to be stacked is aligned with the reference surface, thus enabling proper alignment of multiple sheets in a short time and hence ensuring implementation of post-processing such as stapling and the like.

Thus, post-processing for a sheet stack aligned in a short time can be done correctly so that no delay occurs in the image forming operation in the image forming apparatus side, hence it is possible to provide a high speed image forming and processing system.

Further, as the paddler mechanism, at least two paddlers are provided with respect to the direction of the width of the sheets to be stacked on the post-processing tray and can be configured to act on the sheet at different timings. The sheet guiding means opposing the upright, post-processing tray ensures proper guidance of the sheet discharged from the image forming apparatus, toward the upper part of the upright, post-processing tray by preventing the sheet from drooping down and correctly sets the sheet after discharge, with the rear edge (lower edge) of the sheet in proper alignment with the reference surface.

In this case, when the discharged sheet is aligned with the post-processing tray face and also the alignment reference surface by means of multiple paddlers, each paddler is set to act on the sheet at different timing from the others. Therefore, instead of pressing the sheet surface against the post-processing tray face in a rush, the sheet is pressed gradually from one side end to the other, to thereby ensure alignment of multiple sheets in a short time.

In accordance with the sixth and seventh configurations of the invention, the sheet post-processing apparatus has the above fourth or fifth feature and is characterized in that the sheet guiding means is pressed by the rotary part of the paddler mechanism so as to rotate toward the post-processing tray face. Therefore, the rotary part of the paddler mechanism acts on the sheet guiding means, so that the sheet guiding means can press the sheet discharged in the post-processing tray against the post-processing tray face and toward the alignment reference surface, in synchronism with the rotation of the paddler mechanism.

Accordingly, upon alignment of the sheet discharged to post-processing tray, the rear edge (lower edge) of the sheet can be set in alignment with the reference surface in time with pressing the sheet against the post-processing tray face. As a result, it is possible to receive the sheet discharged from the image forming apparatus, into the post-processing tray without delay and ensure alignment of the sheet as a sheet stack to effect post-processing such as stapling etc. for the sheet stack.

In accordance with the eighth configuration of the invention, the sheet post-processing apparatus has the above fourth, fifth, sixth or seventh feature and is characterized in that the paddler mechanism has a control means for switching the number of revolutions of the paddler mechanism in accordance with the characteristics of the sheets to be stacked on the post-processing tray. Therefore, the number of times the paddler mechanism acts on the sheet can be changed in accordance with the characteristics of the sheet.

Accordingly, with no dependency upon the characteristics of the sheet discharged to the post-processing tray, the rear edge (lower edge) of the sheet can be set in proper alignment with the reference surface while the sheet is pressed against the post-processing tray face. As a result, it is possible to receive the sheet discharged from the image forming apparatus, into the post-processing tray without delay and ensure alignment of the sheet as a sheet stack to effect post-processing such as stapling etc. for the sheet stack.

Further, length (height) information as to the sheet to be stacked on the post-processing tray may be selected as the sheet characteristics. In this case, the number of times the paddler mechanism acts on the sheet is switched in accordance with the length of the sheet.

In accordance with the ninth configuration of the invention, the sheet post-processing apparatus has the above fourth or fifth feature and is characterized in that the post-processing tray comprises: a first post-processing tray portion which holds and aligns the lower edge portion of the sheets discharged from the lower part of the post-processing tray; and a second post-processing tray portion which holds whole part of the sheets discharged in the post-processing tray, and the first post-processing tray portion conveys the aligned sheets in the post-processing tray to the post-processing portion, in cooperation with the rotation of the paddler mechanism. Therefore, the stack of sheets aligned in the upright, post-processing tray can be conveyed to the post-processing device such as stapler, etc., without disrupting the alignment, and hence it is possible to perform stapling and/or other post-processing for the stack of aligned sheets, in a reliable manner.

In accordance with the tenth configuration of the invention, the sheet post-processing apparatus has the above first feature and further comprises a rigidity imparting means for imparting rigidity to the sheet discharged to the post-processing tray so as to prevent the sheet from drooping down in the post-processing tray. Therefore, the sheet discharged to the upright, post-processing tray is made rigid as it is discharged so that the discharged sheet will not droop down in the post-processing tray.

Thereby, the sheet discharged to the post-processing tray will not droop down when it is set in alignment with other sheets, and hence it is possible to receive the sheet discharged from the image forming apparatus without delay and ensure proper alignment as a sheet stack to effect post-processing such as stapling etc. for the sheet stack.

The sheet guiding means may be configured to act on the areas to which the rigidity imparting means imparts rigidity. This configuration makes it possible to press the sheet, without flexing, against the post-processing tray face and hence press and align the sheets as a sheet stack. As a result, it is possible to receive the sheet discharged from the image forming apparatus without delay and ensure proper alignment as a sheet stack to effect post-processing such as stapling etc. for the sheet stack.

In accordance with the eleventh configuration of the invention the sheet post-processing apparatus includes: a tray arranged upright for successively receiving the discharged sheets; an aligning means for setting the sheets in proper alignment on the tray; and a rigidity imparting means for imparting rigidity to the sheets successively accommodated into the sheet tray in such a degree that each sheet can be kept substantially upright without drooping down and be aligned with the tray face while the sheet is accommodated in the tray. Therefore, the sheet discharged to the upright, post-processing tray is imparted rigidity in such a degree that the sheet will not droop down in the upright, post-processing tray until the aligned sheets are subjected to post-processing such as stapling etc.

Thereby, the sheets will be kept with aligned posture without drooping down in the upright, post-processing tray, at least until the sheets are subjected to post-processing such as stapling and the like, and hence it is possible to perform post-processing such as stapling etc., for the sheets as a sheet stack. Moreover, after the completion of post-processing, there is no fear of the problem of traces of ridges remaining because of the rigidity being imparted temporarily.

In accordance with the twelfth configuration of the invention, the sheet post-processing apparatus has the above tenth or eleventh feature and is characterized in that the rigidity imparting means comprises a pair of elastic rollers which are in partial contact with each other and deformed at their contact. Thus, a simple configuration, using elastic deformation of a pair of elastic rollers is used to impart rigidity to the sheet discharged to the upright, post-processing tray, to such a degree that the sheet will not droop down in the upright, post-processing tray until the aligned sheets are subjected to post-processing such as stapling etc.

Thereby, without the necessity of any extra special complicated mechanism, the sheets will be kept with an aligned posture without drooping down in the upright, post-processing tray, at least until the sheets are subjected to post-processing such as stapling and the like, and hence it is possible to perform post-processing such as stapling etc., for the sheets as a sheet stack. Moreover, after the completion of post-processing, there is no fear of the problem of traces of ridges remaining because of the rigidity being imparted temporarily.

In accordance with the thirteenth configuration of the invention, the sheet post-processing apparatus includes: a tray arranged upright for successively receiving the discharged sheets; an aligning means for setting the sheets in proper alignment on the tray; and a sheet gripping means which acts on the upper part of the sheets having been successively received and stacked substantially upright in the tray to grip the sheets in a substantially upright manner. Therefore, the sheet discharged to the upright, post-processing tray will not droop down until the aligned sheets are subjected to post-processing such as stapling etc. Further, it is possible to receive the sheet discharged from the image forming apparatus without delay and ensure proper alignment as a sheet stack to effect post-processing such as stapling etc. for the sheet stack.

In accordance with the fourteenth configuration of the invention, the sheet post-processing apparatus has the above thirteenth feature and is characterized in that the sheet gripping means is configured of a gripping element which acts with a strong enough force on the sheets set substantially upright in the tray to be able to maintain the aligned state of the sheets. Therefore, the sheets discharged to the upright, post-processing tray will be held and will not have their alignment disrupted until the aligned sheets are subjected to post-processing such as stapling etc. As a result, the sheets can be handled as an aligned stack of sheets and subjected to post-processing such as stapling etc.

In accordance with the fifteenth configuration of the invention, the sheet post-processing apparatus has the above first feature and further comprises a sheet aligning means which is disposed opposing the post-processing tray and presses the lower end part of the sheets having been introduced and held substantially upright in the post-processing tray so as to align the sheets in a substantially upright state, toward the post-processing tray face. Therefore, the lower edge of the sheet held in the upright, post-processing tray is pressed inward (toward the tray face) so as to push the sheets held in the post-processing tray toward the interior side, in preparation for smooth entrance of a following sheet.

It is also possible to produce a configuration in which the sheet aligning means also functions as the guiding part for guiding the stack of sheets which is finished by post-processing, from the post-processing tray to the output tray. This configuration can produce an additional advantage in that sheet alignment and discharge can be performed without any dedicated sheet pressing mechanism.

In accordance with the sixteenth configuration of the invention, the sheet post-processing apparatus has the above first feature and is characterized in that the sheet guiding means comprises a holding member for holding the lower end part of the introduced sheets and setting the sheets aligned in a substantially upright state, and the sheet lower edge abutment surface of the holding member is formed with a movement limiting element for limiting the movement in the direction opposite to the sheet pressing direction. Therefore, the abutment surface for supporting the lower end face of the stack of sheets aligned in the post-processing tray is formed with a treatment which makes the lower edges of the sheets move easily in the pressed direction of sheets and not liable to move in the opposite direction. Thus, lower edge portion of the sheets pressed and aligned toward the post-processing tray face will not return after the released of pressing from the sheet aligning means, hence this configuration is effective in preventing the alignment of the sheets from being disrupted.

In accordance with the seventeenth configuration of the invention, the sheet post-processing apparatus has the above fifteenth feature and is characterized in that the sheet post-processing tray can be moved vertically and receives the sheet introduced thereinto at the first, upper position and the sheet aligning means presses the introduced sheet against the post-processing tray face at the second, lower position. Therefore, it is possible to align the sheet by the vibrations arising during the movement from the first, upper position to the second, lower position and then further align the sheet toward the post-processing tray face. Thus, this configuration is effective in efficiently aligning and performing post-processing with a simple structure.

In this case, when another sheet is introduced into the post-processing tray while the sheet introduced to the second, lower position is pressed by the sheet aligning means toward the post-processing tray face, the post-processing tray may be moved toward the first, upper position in time with the sheet entrance. This configuration produces an additional advantage in that the topmost sheet of the sheet stack in alignment with the post-processing tray face will not be easily disrupted from its aligned state by the movement of the following sheet.

Further, when another sheet is introduced into the post-processing tray while the sheet introduced to the second, lower position is pressed by the sheet aligning means toward the post-processing tray face, the post-processing tray may be moved toward the first, upper position in time with the sheet entrance, with the sheet aligning means pressing the topmost sheet face of the already aligned sheets. This configuration produces an additional advantage in that the topmost sheet of the sheet stack in alignment with the post-processing tray face will not be easily disrupted from its aligned state by the movement of the following sheet.

In accordance with the eighteenth configuration of the invention, the sheet post-processing apparatus has the above fifteenth feature, and further comprises: a count storing means for counting the number of the sheets accommodated in the post-processing tray and storing the count result; and a control means for controlling the sheet aligning means so as to align a following sheet introduced into the post-processing tray and the sheet stack therein when the count result from the count storing means surpasses a predetermined number. Therefore, this configuration eliminates unnecessary movement of the moving portions so that mechanical noise can be reduced as much as possible and yet makes it possible to reliably hold and align the sheets.

In accordance with the nineteenth configuration of the invention, the sheet post-processing apparatus has the above first feature, and further comprises: a sheet supporting means which supports and aligns the lower end part of the sheets held in the post-processing tray and is able to move the held sheet stack, between the first position at which sheets are introduced thereinto and the second position at which the sheet stack is post-processed; and a support assisting means arranged in parallel with the post-processing tray and raised from the surface of the post-processing tray, for supporting the underside of the sheet stack in time with the movement of the sheet supporting means. Therefore, it is possible to prevent the bottommost sheet located on the underside of the sheet stack held in the post-processing tray from being rubbed and misplaced by the tray face when the supporting means moves up and down. Thus, this configuration makes it possible to move the aligned sheet stack to the predetermined post-processing station without disrupting the alignment of the sheet stack, and is effective in achieving reliable post-processing for the aligned sheet stack.

The support assisting means may be configured as a sheet underside supporting means which can move in relation with the movement of the sheet supporting means along the post-processing tray face. This configuration makes it possible to reduce the friction between the post-processing tray face and the underside of the sheet stack held in the post-processing tray, arising when the supporting means moves up and down, as much as possible, thus preventing disalignment of the sheets. Further, it is possible to move the aligned stack of sheets to the post-processing station without disrupting the alignment, and hence this configuration produces an additional advantage in achieving reliable post-processing for the aligned sheet stack.

Moreover, in this configuration, rotating members (rollers) may be arranged on the face of the upright, post-processing tray, as the support assisting means. In this case, it is possible to produce an additional advantage in that disalignment of the sheets caused by the friction between the post-processing tray face and the underside of the sheet stack held in the post-processing tray when the pusher moves up and down can be prevented by a simple structure.

In accordance with the twentieth configuration of the invention, the sheet post-processing apparatus has the above nineteenth feature, further comprises a sheet aligning means disposed opposing the support assisting means, for pressing and aligning the sheet introduced into the post-processing tray toward the post-processing tray face, wherein when the sheet supporting means moves, the sheet aligning means holds and conveys the sheet stack. Therefore, it is possible to assist the movement of the sheet stack aligned in the post-processing tray so that the alignment of the sheets will not be disrupted. Further, it is possible to move the aligned stack of sheets to the post-processing station without disrupting the alignment. Thus, this configuration is effective in achieving reliable post-processing for an aligned sheet stack.

In accordance with the twenty-first configuration of the invention, the sheet post-processing apparatus has the above nineteenth feature and is characterized in that the support assisting means is configured with a movement limiting element disposed on the post-processing tray face for limiting the sheets so that they do not move in the direction opposite to that for sheet alignment. Therefore, the sheets held in the post-processing tray can be smoothly guided toward the aligned position, and then the movement of the aligned sheets can be limited to thereby perform reliable post-processing.

In this configuration, the sheet movement limiting element may be arranged in a position other than the area which the leading edge of the sheet introduced into the post-processing tray by the conveyer means will collide with. In this case, it is possible to provide an additional advantage in that the leading edge of the sheet held in the post-processing tray can be smoothly guided toward the upper part of the tray.

In accordance with the twenty-second configuration of the invention, the sheet post-processing apparatus has the above first feature, and further comprises: a sheet supporting means which supports and aligns the lower end part of the sheets held in the post-processing tray and is able to move the held sheet stack, between the first position at which sheets are introduced thereinto and the second position at which the sheet stack is post-processed; a sheet dimension detecting means for detecting the dimensions of the sheet to be held in the post-processing tray; and a switching control means for switching the position at which the sheet supporting means introduces the sheet based on the detection result from the sheet dimension detecting means. Therefore, it is possible to smoothly receive various sizes of sheets discharged to the upright, post-processing tray and ensure proper alignment of the discharged sheets with respect to the direction of height. Accordingly, it is possible to smoothly receive a following sheet by preventing the following sheet from disrupting the posture of the sheet stack which was aligned in the predetermined manner. In this configuration, the same effect is produced when the sheet supporting means is configured to switch the position at which a sheet is introduced in accordance with the sheet size.

Further, the post-processing tray may have side-edge limiting elements which act on the edges on the both sides of the sheet to be received to produce predetermined alignment. In this case, the sheet supporting means is configured so as to switch its position for receiving a sheet in accordance with the sheet size so that the side-edge limiting elements will act on the edges on both sides of the received sheet in the most effective manner. In this case, the side-edge limiting elements also act on the side edges of the sheet at the most ideal positions, with respect to the direction of its width, thus producing further effectiveness in ensuring the alignment.

Moreover, the sheet supporting means may be configured so as to switch its position for receiving a sheet depending upon the size of the sheet with respect to the height direction of the upright, post-processing tray; that is, the position will be set lower when a small-sized (short) sheet is received than when a large-sized (long) sheet is received. This case also provides the same effect.

In accordance with the twenty-third configuration of the invention, the sheet post-processing apparatus has the above first feature, and further comprises: a sheet supporting means which supports and aligns the lower end part of the sheets held in the post-processing tray and is able to move the held sheet stack, between the first position at which sheets are introduced thereinto and the second position at which the sheet stack is post-processed; a sheet deformation detecting means for detecting the deformation and deformed direction of the sheet to be held in the post-processing tray; and a switching control means for switching the position at which the sheet supporting means introduces sheets based on the detection result, e.g., the direction of the curl or the amount of curling, from the sheet deformation detecting means. Therefore, this configuration is effective in smoothly receiving a following sheet by preventing the following sheet from disrupting the posture of the sheet stack which was aligned in the predetermined manner.

The sheet supporting means may be configured to switch its position for sheet reception so as to deal with the case where the sheets held in the tray have a curl projected to the side to which the following sheet is introduced. That is, the position for sheet reception is set so that the sheet discharged by the conveyer means can be received without being affected by surrounding components, or so that part of the curing of the sheets in the tray will abut the conveying means. This configuration also is effective in smoothly receiving the sheet discharged to the upright, post-processing tray and ensuring proper alignment of the sheet without difficulties.

In accordance with the twenty-fourth configuration of the invention, the sheet post-processing apparatus has the above first feature, and further comprises: a sheet supporting means which supports and aligns the lower end part of the sheets held in the post-processing tray and is able to move the held sheet stack, between the first position at which sheets are introduced thereinto and the second position at which the sheet stack is post-processed; a sheet amount detecting means for detecting the amount of sheets to be held in the post-processing tray; and a switching control means for switching the position at which the sheet supporting means introduces sheets based on the detection result from the sheet amount detecting means. Therefore, this configuration is effective in smoothly receiving the sheet discharged to the upright, post-processing tray and ensuring proper alignment of the sheet regardless of the amount of sheets held in the post-processing tray, without any difficulties.

Further, in accordance with this configuration, the sheet supporting means may be configured so that the position for sheet reception is gradually set higher in accordance with the amount of the sheets held by the sheet supporting means. This configuration produces an additional effect in that the position for sheet reception can be set in accordance with the sheet storage conditions which will vary over time.

In accordance with the twenty-fifth configuration of the invention, the sheet post-processing apparatus includes: a post-processing tray for stacking the discharged sheets; a post-processing portion for performing post-processing for the stacked sheets; an output tray for receiving the sheets discharged after post-processing; a conveying means for conveying sheets from the lower part of the post-processing tray arranged upright and discharging the sheets after post-processing to the output tray; a sheet aligning means for aligning the sheet introduced into the post-processing tray; a moving means for moving the sheets aligned in the post-processing tray relative to the post-processing portion in a vertical direction so as to produce the predetermined positional relationship therebetween; and a pressing means for pressing the sheets toward the reference surface of the post-processing tray when the sheets and the post-processing portion are moved relatively in a vertical direction.

According to this configuration, when the sheets discharged to the upright, post-processing tray have been set in alignment as a sheet stack and the pusher mechanism is moved down to (introduced into) the post-processing station, the lower edge face of the sheet stack is set to the reference surface of the post-processing tray and then the sheet stack is subjected to post-processing such as stapling. Therefore, this configuration is effective in performing post-processing for a stack of sheets at the predetermined position without disrupting the alignment of the sheet stack.

It is also possible to arrange the pressing means so as to act symmetrically with respect to the center of the sheets aligned in the post-processing tray. In this case, the sheet stack is pressed and supported uniformly toward the reference surface of the post-processing tray. Hence, this configuration can produce an additional effect in that the sheets can be supported in a stable manner without disrupting the alignment of the sheet stack, until the post-processing is completed.

In accordance with the twenty-sixth configuration of the invention the sheet post-processing apparatus has the above twenty-fifth feature and is characterized in that the pressing means does not act on the sheet surface during the step in which the sheet introduced into the post-processing tray is aligned but acts on the sheet surface during the step in which the aligned sheets are moved relative to the post-processing portion. Therefore, no load acts on the sheet discharged to the post-processing tray, so that it is possible to improve the alignment of the sheets. Further, since the sheet stack is set to the reference surface of the post-processing tray without the alignment of the sheet stack disrupted and then is subjected to post-processing such as stapling, this configuration is effective in performing post-processing for a stack of sheets at the predetermined position with the alignment maintained.

In accordance with the twenty-seventh configuration of the invention, the sheet post-processing apparatus includes: a post-processing tray for stacking the discharged sheets; a post-processing portion for performing post-processing for the stacked sheets; an output tray for receiving the sheets discharged after post-processing; a conveying means for conveying sheets from the lower part of the post-processing tray arranged upright and discharging the sheets after post-processing to the output tray; and a sheet supporting means for supporting and aligning the lower edges of the sheets discharged to the post-processing tray, and is characterized in that the sheet supporting means comprises: a sheet guiding slope for guiding the sheet lower edge to the reference surface side of the abutment portion; and a sheet releasing portion for releasing the lower edges of the guided sheets. Therefore, for example, even a sheet curling at its ends can be received and set in alignment with other sheets, in the abutment portion, thus making it possible to improve reliability and prevent the loss of operating time.

In accordance with the twenty-eighth configuration of the invention, the sheet post-processing apparatus has the above, twenty-seventh feature and is characterized in that the sheet supporting means further comprises an elastic pressing element for pressing the sheet guided by the sheet releasing portion toward the sheet reference surface. Therefore, the lower edge of the sheet discharged to the post-processing tray is guided to the abutment surface and then the lower edge of the sheet is pressed whilst being released in some degree. As a result, for example, even a sheet curling at its ends can be received, set to the reference surface side in the abutment portion and aligned with the other sheets.

In this configuration, it is also possible to configure the elastic pressing element so that it extends lower than the sheet edge abutment surface of the sheet supporting means. In this case, for example, even a sheet curling at its lower end can be received, set to the reference surface in the abutment portion and aligned with the other sheets. Thus, this configuration is markedly effective in preventing the lower edge of the sheet from catching into the lower side of the elastic pressing element and hence preventing the sheet edge and the edge of the pressing element from being damaged.

What is claimed is:

1. A sheet post-processing apparatus comprising:

a post-processing tray for stacking the discharged sheets;

a post-processing portion for performing post-processing for the stacked sheets, an output tray for receiving the sheets discharged after post-processing;

a conveying means for conveying sheets from the lower part of the post-processing tray arranged upright and discharging the sheets after post-processing to the output tray; and a sheet guiding means disposed opposing the post-processing tray which presses particular portions of the sheet when the sheet is introduced into the post-processing tray so as to align the stacked sheets onto the post-processing tray, with the sheets being stacked substantially upright;

wherein the sheet guiding means can rotate about an axle located near the upper part of the post-processing tray so that the lower part of the sheet guiding means rotationally moves toward the post-processing tray; and the sheet guiding means guides the sheet upward with respect to the post-processing tray when the sheet is introduced into the post-processing tray and presses the sheet against the post-processing tray face when the sheet is discharged to the post-processing tray.

2. A sheet post-processing apparatus according to claim 1 further comprising:

a tray arranged upright for successively receiving the discharged sheets;

an aligning means for setting the sheets in proper alignment on the tray; and a rigidity imparting means for imparting rigidity to the sheets successively accommodated into the sheet tray in such a degree that each sheet can be kept substantially upright and be aligned with the tray face while the sheet is accommodated in the tray.

3. The sheet post-processing apparatus according to claim 1, wherein the sheet guiding means comprises a holding member for holding the lower end part of the introduced sheets and setting the sheets aligned in a substantially upright state, and the sheet lower edge abutment surface of the holding member is formed with a movement limiting element for limiting the movement in the direction opposite to the sheet pressing direction.

4. The sheet post-processing apparatus according to claim 1, further comprising:

a sheet supporting means which supports and aligns the lower end part of the sheets held in the post-processing tray and is able to move the held sheet stack, between the first position at which sheets are introduced thereinto and the second position at which the sheet stack is post-processed;

a sheet dimension detecting means for detecting the dimensions of the sheet to be held in the post-processing tray; and a switching control means for switching the position at which the sheet supporting means introduces the sheet based on the detection result from the sheet dimension detecting means.

5. The sheet post-processing apparatus according to claim 1, further comprising:

a sheet supporting means which supports and aligns the lower end part of the sheets held in the post-processing tray and is able to move the held sheet stack, between the first position at which sheets are introduced thereinto and the second position at which the sheet stack is post-processed;

a sheet deformation detecting means for detecting the deformation and deformed direction of the sheet to be held in the post-processing tray; and a switching control means for switching the position at which the sheet supporting means introduces sheets based on the detection result from the sheet deformation detecting means.

6. The sheet post-processing apparatus according to claim 1, further comprising:

a sheet supporting means which supports and aligns the lower end part of the sheets held in the post-processing tray and is able to move the held sheet stack, between the first position at which sheets are introduced thereinto and the second position at which the sheet stack is post-processed;

a sheet amount detecting means for detecting the amount of sheets to be held in the post-processing tray; and a switching control means for switching the position at which the sheet supporting means introduces sheets based on the detection result from the sheet amount detecting means.

7. The sheet post-processing apparatus according to claim 1, wherein the sheet guiding means guides the sheet upward with respect to the post-processing tray when the sheet is introduced into the post-processing tray and presses the sheet against the post-processing tray face gradually from the lower part to the upper part when the sheet is discharged to the post-processing tray.

8. The sheet post-processing apparatus according to claim 7, further comprising a paddler mechanism which operates in cooperation with the sheet guiding means when the sheet is pressed against the post-processing tray face.

9. The sheet post-processing apparatus according to claim 8, wherein the sheet guiding means is pressed by the rotary part of the paddler mechanism so as to rotate toward the post-processing tray face.

10. The sheet post-processing apparatus according to claim 1, further comprising a paddler mechanism which operates in cooperation with the sheet guiding means when the sheet is pressed against the post-processing tray face.

11. The sheet post-processing apparatus according to claim 10, wherein the sheet guiding means is pressed by the rotary part of the paddler mechanism so as to rotate toward the post-processing tray face.

12. The sheet post-processing apparatus according to claim 10, wherein the paddler mechanism has a control means for switching the number of revolutions of the paddler mechanism in accordance with the characteristics of the sheets to be stacked on the post-processing tray.

13. The sheet post-processing apparatus according to claim 10, wherein the post-processing tray comprises: a first post-processing tray portion which holds and aligns the lower edge portion of the sheets discharged from the lower part of the post-processing tray; and a second post-processing tray portion which holds whole part of the sheets discharged in the post-processing tray, and the first post-processing tray portion conveys the aligned sheets in the post-processing tray to the post-processing portion, in cooperation with the rotation of the paddler mechanism.

14. The sheet post-processing apparatus according to claim 1, further comprising a rigidity imparting means for imparting rigidity to the sheet discharged to the post-processing tray so as to prevent the sheet from drooping down in the post-processing tray.

15. The sheet post-processing apparatus according to claim 14, wherein the rigidity imparting means comprises a pair of elastic rollers which are in partial contact with each other and deformed at their contact.

16. The sheet post-processing apparatus according to claim 1, further comprising a sheet aligning means which is disposed opposing the post-processing tray and presses the lower end part of the sheets having been introduced and held substantially upright in the post-processing tray so as to align the sheets in a substantially upright state, toward the post-processing tray face.

17. The sheet post-processing apparatus according to claim 16, wherein the sheet post-processing tray can be moved vertically and receives the sheet introduced thereinto at the first, upper position and the sheet aligning means presses the introduced sheet against the post-processing tray face at the second, lower position.

18. The sheet post-processing apparatus according to claim 16, further comprising:

a count storing means for counting the number of the sheets accommodated in the post-processing tray and storing the count result; and a control means for controlling the sheet aligning means so as to align a following sheet introduced into the post-processing tray and the sheet stack therein when the count result from the count storing means surpasses a predetermined number.

19. The sheet post-processing apparatus according to claim 1, further comprising:

a sheet supporting means which supports and aligns the lower end part of the sheets held in the post-processing tray and is able to move the held sheet stack, between the first position at which sheets are introduced thereinto and the second position at which the sheet stack is post-processed; and, a support assisting means arranged in parallel with the post-processing tray and raised from the surface of the post-processing tray, for supporting the underside of the sheet stack in time with the movement of the sheet supporting means.

20. The sheet post-processing apparatus according to claim 19, further comprising a sheet aligning means disposed opposing the support assisting means, for pressing and aligning the sheet introduced into the post-processing tray toward the post-processing tray face, wherein when the sheet supporting means moves, the sheet aligning means holds and conveys the sheet stack.

21. The sheet post-processing apparatus according to claim 19, wherein the support assisting means is configured with a movement limiting element disposed on the post-processing tray face for limiting the sheets so that they do not move in the direction opposite to that for sheet alignment.

22. A sheet post-processing apparatus comprising:

a tray arranged upright for successively receiving the discharged sheets;

an aligning means for setting the sheets in proper alignment on the tray; and a sheet gripping means which acts on the upper part of the sheets having been successively received and stacked substantially upright in the tray to grip the sheets in a substantially upright manner.

23. The sheet post-processing apparatus according to claim 22, wherein the sheet gripping means is configured of a gripping element which acts with a strong enough force on the sheets set substantially upright in the tray to be able to maintain the aligned state of the sheets.

24. A sheet post-processing apparatus comprising:

a post-processing tray for stacking the discharged sheets;

a post-processing portion for performing post-processing for the stacked sheets;

an output tray for receiving the sheets discharged after post-processing;

a conveying means for conveying sheets from the lower part of the post-processing tray arranged upright and discharging the sheets after post-processing to the output tray;

a sheet aligning means for aligning the sheet introduced into the post-processing tray;

a moving means for moving the sheets aligned in the post-processing tray relative to the post-processing portion in a vertical direction so as to produce the predetermined positional relationship therebetween; and a pressing means for pressing the sheets toward the reference surface of the post-processing tray when the sheets and the post-processing portion are moved relatively in a vertical direction.

25. The sheet post-processing apparatus according to claim 24, wherein the pressing means does not act on the sheet surface during the step in which the sheet introduced into the post-processing tray is aligned but acts on the sheet surface during the step in which the aligned sheets are moved relative to the post-processing portion.

26. A sheet post-processing apparatus comprising:

a post-processing tray for stacking the discharged sheets;

a post-processing portion for performing post-processing for the stacked sheets;

an output tray for receiving the sheets discharged after post-processing;

a conveying means for conveying sheets from the lower part of the post-processing tray arranged upright and discharging the sheets after post-processing to the output tray; and a sheet supporting means for supporting and aligning the lower edges of the sheets discharged to the post-processing tray, wherein the sheet supporting means comprises: a sheet guiding slope for guiding the sheet lower edge to the reference surface side of the abutment portion; and a sheet releasing portion for releasing the lower edges of the guided sheets.

27. The sheet post-processing apparatus according to claim 26, wherein the sheet supporting means further comprises an elastic pressing element for pressing the sheet guided by the sheet releasing portion toward the sheet reference surface.

* * * * *